US012385185B2

(12) United States Patent
Reeve-Larson et al.

(10) Patent No.: US 12,385,185 B2
(45) Date of Patent: Aug. 12, 2025

(54) MICROFIBRILLATED CELLULOSE CONTAINING PULP SHEETS WITH IMPROVED MECHANICAL PROPERTIES

(71) Applicant: FiberLean Technologies Limited, Par (GB)

(72) Inventors: Thomas Reeve-Larson, Par (GB); Mark Windebank, Par (GB); Daniel Ingle, Par (GB); Mark Paradis, Par (GB); David R. Skuse, Par (GB)

(73) Assignee: FIBERLEAN TECHNOLOGIES LIMITED (GB)

( * ) Notice: Subject to any disclaimer, the term of this patent is extended or adjusted under 35 U.S.C. 154(b) by 478 days.

(21) Appl. No.: 17/469,185

(22) Filed: Sep. 8, 2021

(65) Prior Publication Data

US 2022/0081840 A1 Mar. 17, 2022

Related U.S. Application Data

(63) Continuation of application No. PCT/US2021/049373, filed on Sep. 8, 2021.
(Continued)

(51) Int. Cl.
*D21H 11/18* (2006.01)
*D21D 1/20* (2006.01)
(Continued)

(52) U.S. Cl.
CPC ..... *D21H 11/18* (2013.01); *D21D 1/20* (2013.01); *D21F 7/003* (2013.01); *D21H 11/04* (2013.01); *D21H 17/675* (2013.01); *D21H 17/68* (2013.01)

(58) Field of Classification Search
CPC ..... D21H 11/18; D21D 1/20
See application file for complete search history.

(56) References Cited

U.S. PATENT DOCUMENTS 4,481,075 A * 11/1984 Dailly ..... D21H 13/40 162/146
9,127,405 B2 9/2015 Husband et al.
(Continued)

FOREIGN PATENT DOCUMENTS

CN 111304967 A 6/2020
EP 2971347 A1 1/2016
(Continued)

OTHER PUBLICATIONS

Paulapuro editor, Papermaking Part: 1 Stock Preparation and Wet End,2000, Fapet Oy, p. 76-88 and 160-165 (Year: 2000).*
(Continued)

*Primary Examiner* — Anthony Calandra
(74) *Attorney, Agent, or Firm* — Raymond G. Arner; Pierce Atwood LLP

(57) ABSTRACT

A method of manufacturing a partially-dried sheet comprising, consisting essentially of, or consisting of, microfibrillated cellulose suitable for use as a binder, or a dried sheet comprising, consisting essentially of, or consisting of, a blend of microfibrillated cellulose and a pulp suitable for use as a pulp source, wherein said sheet may be redispersed with a high shear disperser, mixer or refiner operated at energy inputs of about 10 kWh/t to about 2,000 kWh/t, wherein the sheet upon re-dispersion in a aqueous medium maintains, or is not substantially degraded in, tensile index, compared to the dried sheet prior to drying and re-dispersion.

36 Claims, 34 Drawing Sheets

| Study | MFC Dose | Lc(n) | Lc(l) | Lc(w) | Lc(n)ISO | Lc(l)ISO | Lc(w)ISO | Fibre Width | Curl | Optical Coarseness | Kink | FinesA | FinesB | Fines | Fibrillation |
|---|---|---|---|---|---|---|---|---|---|---|---|---|---|---|---|
| | | [mm] | [mm] | [mm] | [mm] | [mm] | [mm] | [µm] | [%] | [mg/m] | [1/m] | [%] | [%] | [%] | [%] |
| Part One-Addition to Pulp | 0 | 0.7 | 2.0 | 2.7 | 1.4 | 2.2 | 2.7 | 28.0 | 31.5 | 0.212 | 1982 | 11.3 | 5.4 | 78.0 | 0.8 |
| | 1 | 0.5 | 1.9 | 2.6 | 1.2 | 2.1 | 2.6 | 26.8 | 37.3 | 0.182 | 1931 | 15.1 | 8.2 | 76.9 | 0.9 |
| | 2 | 0.6 | 1.8 | 2.5 | 1.2 | 2.0 | 2.5 | 27.0 | 33.0 | 0.194 | 1672 | 14.2 | 7.0 | 75.6 | 0.9 |
| | 4 | 0.5 | 1.7 | 2.5 | 1.0 | 1.9 | 2.5 | 26.6 | 30.5 | 0.175 | 1863 | 19.3 | 9.7 | 77.9 | 1.0 |
| | 6 | 0.5 | 1.8 | 2.7 | 1.1 | 2.1 | 2.7 | 27.5 | 23.6 | 0.194 | 1646 | 17.8 | 8.1 | 77.8 | 1.0 |
| | 8 | 0.5 | 1.8 | 2.7 | 1.0 | 2.0 | 2.7 | 27.0 | 26.8 | 0.185 | 1641 | 19.7 | 9.4 | 77.8 | 1.1 |
| | 10 | 0.4 | 1.6 | 2.6 | 0.9 | 1.8 | 2.6 | 26.7 | 40.5 | 0.173 | 1746 | 24.2 | 10.5 | 79.1 | 1.2 |
| | 20 | 0.3 | 1.3 | 2.5 | 0.7 | 1.7 | 2.6 | 26.4 | 22.5 | 0.159 | 1578 | 31.8 | 14.3 | 81.8 | 1.4 |
| Part Two-Re-slushed Handsheets | 0 | 0.7 | 2.1 | 2.7 | 1.5 | 2.3 | 2.7 | 26.9 | 30.2 | 0.199 | 1546 | 9.4 | 5.5 | 73.3 | 0.8 |
| | 1 | 0.6 | 1.9 | 2.6 | 1.2 | 2.1 | 2.7 | 26.4 | 25.9 | 0.189 | 1581 | 11.9 | 6.7 | 71.7 | 0.9 |
| | 2 | 0.6 | 2.0 | 2.6 | 1.3 | 2.2 | 2.6 | 26.6 | 30.1 | 0.194 | 1484 | 13.0 | 5.3 | 76.4 | 0.9 |
| | 4 | 0.4 | 1.7 | 2.7 | 1.0 | 2.0 | 2.7 | 25.7 | 21.1 | 0.172 | 1338 | 20.8 | 6.3 | 79.9 | 0.8 |
| | 6 | 0.4 | 1.7 | 2.6 | 1.0 | 2.0 | 2.7 | 26.6 | 29.9 | 0.179 | 1546 | 21.6 | 11.1 | 80.4 | 0.9 |
| | 8 | 0.4 | 1.7 | 2.6 | 1.0 | 1.9 | 2.6 | 26.3 | 23.4 | 0.170 | 1552 | 23.0 | 10.2 | 79.7 | 1.0 |
| | 10 | 0.4 | 1.5 | 2.5 | 0.8 | 1.8 | 2.6 | 26.0 | 27.5 | 0.166 | 1513 | 25.8 | 8.6 | 80.4 | 1.1 |
| | 20 | 0.3 | 1.3 | 2.4 | 0.8 | 1.7 | 2.4 | 27.0 | 21.5 | 0.173 | 1531 | 33.3 | 12.5 | 85.8 | 1.3 |

Related U.S. Application Data

(60) Provisional application No. 63/076,998, filed on Sep. 11, 2020.

(51) Int. Cl.

| | |
|---|---|
| ***D21F 7/00*** | (2006.01) |
| ***D21H 11/04*** | (2006.01) |
| ***D21H 17/67*** | (2006.01) |
| ***D21H 17/68*** | (2006.01) |

(56) References Cited

U.S. PATENT DOCUMENTS

| | | | | |
|---|---|---|---|---|
| 10,900,169 | B2 * | 1/2021 | Heiskanen | D21C 9/005 |
| 2016/0024718 | A1 * | 1/2016 | Lee | D21H 17/675 162/157.6 |

FOREIGN PATENT DOCUMENTS

| | | | | |
|---|---|---|---|---|
| EP | 3612675 | A1 | 2/2020 | |
| WO | 2010/131016 | A2 | 11/2010 | |
| WO | 2014/147295 | A1 | 9/2014 | |
| WO | WO-2019075184 | A1 * | 4/2019 | D21C 9/005 |
| WO | WO-2019227187 | A1 * | 12/2019 | D21H 1/00 |

OTHER PUBLICATIONS

Nanko et al., The World of Market Pulp, 2005, Womp, LLC, p. 148-149 (Year: 2005).*

TAPPI Monograph Series No. 30, Paper Coating Pigments, pp. 34-35.

Lindström T., Fellers, C., Ankerfors, M., Nordmark, G. G., 2016, "On the Nature of Joint Strength of Paper—Effect of Dry Strength Agents—Revisiting the Page Equation", Nordic Pulp & Paper Research Journal, 31(3): 459-4680.

Ebringerová, A., 2006, "Structural Diversity and Application Potential of Hemicelluloses," Macromol. Symp., 232: 1-12.

Fengel, D., Wegener, G., 1983, Wood—Chemistry, Ultrastructure, Reactions, 40 pages.

Klemm, D., Heublein, B., Fink, H. P., Bohn, A., 2005, "Cellulose: Fascinating Biopolymer and Sustainable Raw Material" Angew. Chem. Int. Ed., 44: 3358-3393.

Liitiä, T., Maunu, S. L., Hortling, B., Tamminen, T., Pekkala, O., Varhimo, A., 2003, "Cellulose Crystallinity and Ordering of Hemicelluloses in Pine and Birch Pulps as Revealed by Solid-State NMR Spectroscopic Methods," Cellulose, 10:307-316.

Hult, E.-L., Larsson, P. T., Iversen T., 2001, "Cellulose Fibril Aggregation—An Inherent Property of Kraft Pulps," Polymer, 42: 3309-3314.

Virtanen, T., Maunu, S. L., Tamminen, T., Hortling, B., Liitiä, T., 2008, "Changes in Fiber Ultrastructure During Various Kraft Pulping Conditions Evaluated by 13C CPMAS NMR Spectroscopy," Carbohydrate Polymers, 73:156-163.

Duchesne, I., Hult, E. L., Molin, U., Daniel, G., Iversen, T., Lennholm, H., 2001, "The Influence of Hemicellulose on Fibril Aggregation of Kraft Pulp Fibres as Revealed by FE-SEM and CP/MAS 13C-NMR," Cellulose, 8:103-111.

Makelä, P., Bergnor, E., Wallbäcks, L., Öhman, F., 2010, "Sorption of Birch Xylan to Softwood Kraft Pulps and its Influence on the Tensile Properties of Previously-dried Papers Under Different Papermaking Conditions," Innventia Report No. 121 2nd Version.

Iwamoto, S., Abe, K., Yano, H., 2008, "The Effect of Hemicelluloses on Wood Pulp Nanofibrillation and Nanofiber Network Characteristics," Biomacromolecules, 9:1022-1026.

Spence, K. L., Venditti, R. A., Habibi, Y., Rojas, O. J., Pawlak, J. J., 2010, "The Effect of Chemical Composition on Microfibrillar Cellulose Films From Wood Pulps: Mechanical Processing and Physical Properties," Bioresource Technology, 101: 5961-5968.

Zeng, X., Retulainen, E., Heinemann, S., Fu, S., 2012, "Fibre Deformations Induced by Different Mechanical Treatments and Their Effect On Zero-span Dtrength," Nordic Pulp and Paper Research Journal, 27(2): 335-342.

Joutsimo, O., Wathén, R., Tamminenm T., 2005, "Effects of Fiber Deformations On Pulp Sheet Properties and Fiber Strength," Paperi Ja Puu/Paper and Timber, 87(6).

Nevell, T. P., Nugawela, D., 1987, "Effect of Treatment with Very Dilute Acids on the Wet Tensile Strength and Chemical Properties of Paper," Carbohydrate Polymers, 7:169-181.

Wathén, R., 2006, "Studies On Fiber Strength and Its Effect On Paper Properties," PHD Thesis, King's College London. ISSN 1457-6252.

Uetani, K., Yano, H., 2012, "Zeta Potential Time Dependence Reveals the Swelling Dynamics of Wood Cellulose Nanofibrils," Langmuir, 28: 818-827.

International Search Report and Written Opinion mailed Jan. 4, 2022 in International Application No. PCT/IB2021/000606, 17 pages.

Thermo Electron Corporation: "Gamma Based Consistency Measurement in the Pulp and Paper Industry", Mar. 1, 2001 (Mar. 1, 2001), XP055872917, Retrieved from the Internet: URL:http://thermo.com.cn/Resources/200802/productPDF_14149.pdf.

* cited by examiner

FIG. 13

| Study | MFC Dose | Lc(n) | Lc(l) | Lc(w) | Lc(n)ISO | Lc(l)ISO | Lc(w)ISO | Fibre Width | Curl | Optical Coarseness | Kink | FinesA | FinesB | Fines | Fibrillation |
|---|---|---|---|---|---|---|---|---|---|---|---|---|---|---|---|
| | | [mm] | [mm] | [mm] | [mm] | [mm] | [mm] | [μm] | [%] | [mg/m] | [1/m] | [%] | [%] | [%] | [%] |
| Part One-Addition to Pulp | 0 | 0.7 | 2.0 | 2.7 | 1.4 | 2.2 | 2.7 | 28.0 | 31.5 | 0.212 | 1982 | 11.3 | 5.4 | 78.0 | 0.8 |
| | 1 | 0.5 | 1.9 | 2.6 | 1.2 | 2.1 | 2.6 | 26.8 | 37.3 | 0.182 | 1931 | 15.1 | 8.2 | 76.9 | 0.9 |
| | 2 | 0.6 | 1.8 | 2.5 | 1.2 | 2.0 | 2.6 | 27.0 | 33.0 | 0.194 | 1672 | 14.2 | 7.0 | 75.6 | 0.9 |
| | 4 | 0.5 | 1.7 | 2.5 | 1.0 | 1.9 | 2.5 | 26.6 | 30.5 | 0.175 | 1863 | 19.3 | 9.7 | 77.9 | 1.0 |
| | 6 | 0.5 | 1.8 | 2.7 | 1.1 | 2.1 | 2.7 | 27.5 | 23.6 | 0.194 | 1646 | 17.8 | 8.1 | 77.8 | 1.0 |
| | 8 | 0.5 | 1.8 | 2.7 | 1.0 | 2.0 | 2.7 | 27.0 | 26.8 | 0.185 | 1641 | 19.7 | 9.4 | 77.8 | 1.1 |
| | 10 | 0.4 | 1.6 | 2.6 | 0.9 | 1.8 | 2.6 | 26.7 | 40.5 | 0.173 | 1746 | 24.2 | 10.5 | 79.1 | 1.2 |
| | 20 | 0.3 | 1.3 | 2.5 | 0.7 | 1.7 | 2.6 | 26.4 | 22.5 | 0.159 | 1578 | 31.8 | 14.3 | 81.8 | 1.4 |
| Part Two-Re-slushed Handsheets | 0 | 0.7 | 2.1 | 2.7 | 1.5 | 2.3 | 2.7 | 26.9 | 30.2 | 0.199 | 1546 | 9.4 | 5.5 | 73.3 | 0.8 |
| | 1 | 0.6 | 1.9 | 2.6 | 1.2 | 2.1 | 2.7 | 26.4 | 25.9 | 0.189 | 1581 | 11.9 | 6.7 | 71.7 | 0.9 |
| | 2 | 0.6 | 2.0 | 2.6 | 1.3 | 2.2 | 2.6 | 26.6 | 30.1 | 0.194 | 1484 | 13.0 | 5.3 | 76.4 | 0.9 |
| | 4 | 0.4 | 1.7 | 2.7 | 1.0 | 2.0 | 2.7 | 25.7 | 21.1 | 0.172 | 1338 | 20.8 | 6.3 | 79.9 | 0.8 |
| | 6 | 0.4 | 1.7 | 2.6 | 1.0 | 2.0 | 2.7 | 26.6 | 29.9 | 0.179 | 1546 | 21.6 | 11.1 | 80.4 | 0.9 |
| | 8 | 0.4 | 1.7 | 2.6 | 1.0 | 1.9 | 2.6 | 26.3 | 23.4 | 0.170 | 1552 | 23.0 | 10.2 | 79.7 | 1.0 |
| | 10 | 0.4 | 1.5 | 2.5 | 0.8 | 1.8 | 2.6 | 26.0 | 27.5 | 0.166 | 1513 | 25.8 | 8.6 | 80.4 | 1.1 |
| | 20 | 0.3 | 1.3 | 2.4 | 0.8 | 1.7 | 2.4 | 27.0 | 21.5 | 0.173 | 1531 | 33.3 | 12.5 | 85.8 | 1.3 |

MICROFIBRILLATED CELLULOSE CONTAINING PULP SHEETS WITH IMPROVED MECHANICAL PROPERTIES

CROSS REFERENCE TO RELATED APPLICATIONS

This application is a continuation of International Patent Application No. PCT/US2021/049373 filed Sep. 8, 2021 and claims the benefit of U.S. Provisional Patent Application No. 63/076,998, filed Sep. 11, 2020, the entire contents of which are incorporated herein by reference.

BACKGROUND

Field of Invention

The present invention relates to methods of manufacturing partially-dried or dried sheets comprising microfibrillated cellulose ("MFC") and blends of MFC and pulp, which sheets demonstrate improved mechanical properties that are maintained or not substantially degraded after drying and re-dispersing in an aqueous medium.

Background of the Invention

Wood pulps utilized in the paper and board industry come in a variety of forms from commercial pulp manufacturing companies. These pulp forms include mechanical pulp, thermomechanical pulp, chemi-thermomechanical pulp and chemical pulp, including, for example, Northern Bleached Softwood Kraft pulp ("NSBK"), Bleached Softwood Kraft pulp, Bleached Hardwood pulp, unbleached softwood and hardwood Kraft pulps, Sulfite Bleached pulp, Bleached Chemi-Thermo Mechanical Pulp ("BCTMP"), and recycled pulp.

Pulp may be obtained from many wood sources, which typically are classified into two classes, namely softwood and hardwood pulps. Softwood pulps are favored in many applications, since the cellulose fibres are typically longer. Softwood pulps may be processed from spruce, pine, fir, larch and hemlock, whereas hardwood pulps are typically processed from eucalyptus, aspen and birch, for example.

Pulps are processed conventionally from wood chips into pulp sheets that are shipped, for example, to paper mills for processing into paper and paperboards. Sawmill residue chips from sapwood are typically used for Kraft chemical processing, but also whole-log wood chips may be used, which in addition to sapwood contain heartwood from the wood logs. Sapwood is favored for chemical processing, since sapwood has fibres with less lignin, lower density, less wood extractives, less acidic, higher moisture content and more living cells; and, consequently is easier to cook. Heartwood is more difficult to penetrate with cooking liquors than sapwood.

Regardless of the source of wood chips, and especially if multiple sources of wood chips are pulped together, the resulting wood pulp produced by the Kraft process has numerous variables, including, for example, rejects, bark content, moisture content, Kappa number variability, biological knots, decayed wood, sulfidity percentage and numerous other variables. These variables are impacted by the type of pulping process utilized. The objective of Kraft processing is to provide uniform delignification and high cooking yield and pulp quality.

Wood chips processed into wood pulps have three main components, apart from water, which are cellulose fibres, lignins and hemicelluloses. These three components are profoundly differentiated based on the type of processing employed to pulp the wood chips from softwood or hardwood sources.

One of the most commercially significant wood pulps available for a variety of end-use applications is Northern Bleached Softwood Kraft pulp, or NBSK. The commercially available NBSK pulp comprises long slender cellulose-containing fibres that provide excellent bonding and tensile properties. NBSK pulp is conventionally used for manufacturing a variety of paper products, including printing and writing paper, specialty grades, and a range of tissue products.

Various methods of producing microfibrillated cellulose ("MFC") are known in the art. Certain methods and compositions comprising microfibrillated cellulose produced by grinding procedures are described in WO-A-2010/131016. Husband, J. C., Svending, P., Skuse, D. R., Motsi, T., Likitalo, M., Coles, A., FiberLean Technologies Ltd., 2015, "Paper filler composition," PCT International Application No. WO-A-2010/131016, the contents of which is hereby incorporated by reference in its entirety. Paper products comprising such microfibrillated cellulose have been shown to exhibit excellent paper properties, such as paper burst and tensile strength. The methods described in WO-A-2010/131016 also enable the production of microfibrillated cellulose economically.

WO2010/131016 describes a grinding procedure for the production of microfibrillated cellulose with or without inorganic particulate material. Such a grinding procedure is described below. In an embodiment of the process set forth in WO-A-2010/131016, the process utilizes mechanical disintegration of cellulose fibres to produce microfibrillated cellulose ("MFC") cost-effectively and at large scale, without requiring cellulose pre-treatment. An embodiment of the method uses stirred media detritor grinding technology, which disintegrates fibres into MFC by agitating grinding media beads. In this process, a mineral such as calcium carbonate or kaolin is added as a grinding aid, greatly reducing the energy required. Husband, J. C., Svending, P., Skuse, D. R., Motsi, T., Likitalo, M., Coles, A., FiberLean Technologies Ltd., 2015, "Paper filler composition," U.S. Pat. No. 9,127,405B2, the contents of which is hereby incorporated by reference in its entirety.

Notwithstanding the foregoing advances, there remains a need to prepare sheets of microfibrillated cellulose and microfibrillated cellulose and pulp blends that may be partially-dried or dried, and transported to a second location for instance to a paper mill; and wherein such sheets demonstrate increases tensile properties if used as a sheet, and may be re-dispersed in a liquid media, such as water, whereupon the MFC containing sheet maintains its beneficial tensile properties and may be added to a papermaking furnish for paper or paperboard, thereby enhancing the tensile properties of the final paper or paperboard products.

SUMMARY OF THE INVENTION

In accordance with the description, Figures, examples and claims of the present specification, the inventors have invented processes for the manufacture of sheets comprising (or consisting essentially of, or consisting of) microfibrillated cellulose and, alternatively, sheets comprising (or consisting essentially of, or consisting of) microfibrillated cellulose and pulp blends, which have improved mechanical properties that are maintained, or are not substantially degraded, after drying and re-dispersing in an aqueous medium. In an aspect of the present disclosure directed to sheets comprising microfibrillated cellulose and pulp blends, the MFC can be used to enhance the properties of a market pulp rendering it suitable for transport to another manufacturing location while maintaining the beneficial properties conferred by incorporation of MFC in the MFC and pulp blend sheet.

The present invention is based on the use of compositions comprising microfibrillated cellulose, which are added to market pulp before drying and formed into sheets having enhanced mechanical properties compared to pulp sheets produced without MFC and, further wherein, the enhanced mechanical properties of the MFC are maintained, or are not substantially degraded, although the furnish strength may be reduced, as usual, due to drying and re-slushing production cycles.

In an aspect of the present invention, a pulp stock is prepared from a pulp selected from the group comprising (or consisting essentially of, or consisting of) a mechanical pulp, a thermomechanical pulp, a chemi-thermomechanical pulp, a chemical pulp (e.g., Kraft, Soda or Sulfite), a bleached pulp, a recycled pulp (optionally combining cleaning and de-inking steps), a steam exploded fibre pulp or a biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC), which is then added to the pulp stock in the range of 0.5 wt. % to 99.5 wt. % of the total dry mass.

In an another embodiment, a liquid composition of microfibrillated cellulose is provided and mixed with the pulp stock selected from the group comprising (or consisting essentially of, or consisting of) a mechanical pulp, a thermomechanical pulp, a chemi-thermomechanical pulp, a chemical pulp (e.g., Kraft, Soda or Sulfite), a bleached pulp, a recycled pulp (optionally combining cleaning and de-inking steps), a steam exploded fibre pulp or a biologically (enzymatically) treated pulp. The solids content of the pulp stock (or slurry) is in the range of about 0.5 wt. % to about 30 wt. %.

The present invention in another aspect is based on the use of compositions comprising microfibrillated cellulose, and optionally inorganic particulate material, which are formed into MFC sheets having enhanced mechanical properties, wherein the enhanced mechanical properties are maintained or are not substantially degraded when the MFC sheets are partially-dried or dried and re-pulped.

The addition of MFC in dosages of about 0.5 wt. % to about 50 wt. % to market pulp before drying and forming into sheets results in improvements in mechanical properties and opacity. Drainability, bulk, porosity and roughness are reduced and there is also a marginal reduction in brightness. The improvements in mechanical properties of the MFC-containing pulp sheets are maintained or are not substantially degraded when the MFC and pulp sheets are dried and re-pulped. Accordingly, MFC-containing pulp sheets provide a commercially useful alternative pulp form for end-use applications, wherein pulp refining may be reduced or eliminated and mechanical properties, including bulk and tear index are improved. Dosages of about 0.5 to about 50 wt. % MFC to market pulp before drying or partial drying and formation into sheets have been shown to profoundly impact the mechanical properties of the market pulp, including, for example Bulk and Tear Index.

In an embodiment of the foregoing aspect of preparing MFC containing pulp blended sheets. MFC may be added in dosages of about 0.5 wt. % to about 40 wt. %, or about 0.5 wt. % to about 30 wt. %, or about 0.5 wt. % to about 25 wt. %, or about 0.5 wt. % to about 20 wt. %, or about 0.5 wt. % to about 15 wt. %, or about or about 0.5 wt. % to about 12.5 wt. %, or about 0.5 wt. % to about 10 wt. %, or about 0.5 wt. % to about 9 wt. %, or about 0.5 wt. % to about 8 wt. %, or about 0.5 wt. % to about 7 wt. %, or about 0.5 wt. % to about 6 wt. %, or about 0.5 wt. % to about 5 wt. %, or about 0.5 wt. % to about 4 wt. %, or about 0.5 wt. % to about 3 wt. %, or about 0.5 wt. % to about 2.5 wt. %, or about 0.5 wt. % to about 2 wt. %, or about 0.5 wt. % to about 1.5 wt. %, or about 0.5 wt. % to about 1 wt. %.

In further embodiments of the foregoing aspects and embodiments of the present disclosure, the MFC in a dried or partially-dried MFC sheet or a dried or partially-dried MFC and pulp blend sheet may further comprise at least one or more inorganic particulate material either as a result of the addition of the one or more inorganic particulate material added to the MFC prior to producing the MFC sheets or the MFC and pulp blended sheets, or due to a co-grinding microfibrillation process wherein a fibrous substrate comprising cellulose is microfibrillated in an aqueous environment in a grinding apparatus in the presence of at least one inorganic particulate material, wherein the fibrous substrate to the inorganic particulate material are in a ratio of about 99.5:0.5 to about 0.5:99.5, and wherein the microfibrillated cellulose has a fibre steepness of from about 20 to about 50; and, optionally, wherein the microfibrillating is performed in the presence of a grinding medium which is to be removed after completion of grinding, or by both manners of addition.

In the various aspects and embodiments of the present disclosure, the term "dried sheet" means a sheet comprising 20% by weight or less of moisture (e.g., water).

In the various aspects and embodiments of the present disclosure, the term "partially dried sheet" means a sheet comprising greater than about 20% by weight to about 60% by weight, or about 20% by weight to about 85% by weight, of moisture (e.g., water).

In the various aspects and embodiments of the present disclosure, the term "mechanical properties" means one or more of Tensile Strength, Tensile Elongation, Tensile Index, Burst Strength, Tear Strength, Tear Index, Scott Bond, Breaking Energy and Breaking Elongation.

In an aspect of the present disclosure there is presented, a method of manufacturing a partially-dried sheet or a dried sheet comprising microfibrillated cellulose suitable for use as a binder, the method comprising the steps of:

- preparing a pulp slurry in a range of about 0.5 wt. % to about 30 wt. % total solids;
- preparing a slurry of microfibrillated cellulose;
- mixing the pulp slurry and the slurry of microfibrillated cellulose, wherein the content of microfibrillated cellulose in the pulp slurry may be about 0.5 wt. % to about 99.5 wt. % of the total dry mass;
- forming a sheet comprising microfibrillated cellulose and pulp; and
- dewatering and drying the sheet to a desired moisture content;
- wherein the moisture content of the partially-dried sheet is in the range of about 20% by weight to about 85% by weight moisture; or wherein the moisture content of the dried sheet is about 20% by weight or less; and
- wherein, when the partially-dried sheet or the dried sheet is re-dispersed in an aqueous medium with a disperser, mixer, or refiner operated at energy inputs of about 10 kWh/t to about 2,000 kWh/t, the partially-dried sheet or dried sheet upon re-dispersion in an aqueous medium maintains, or is not substantially degraded in, mechanical properties of the MFC compared to a sheet comprising a comparable amount of microfibrillated cellulose prior to drying and re-dispersion.

In another aspect of the present disclosure, the foregoing aspect and embodiments of the present disclosure of the partially-dried sheet or the dried sheet further comprises one or more inorganic particulate material.

In a further aspect of the present disclosure, in the foregoing aspects and embodiments of the present disclosure the microfibrillated cellulose is obtained by a co-grinding microfibrillation process wherein a fibrous substrate comprising cellulose is microfibrillated in an aqueous environment in a grinding apparatus in the presence of at least one inorganic particulate material, wherein the fibrous substrate to the inorganic particulate material are in a ratio of about 99.5:0.5 to about 0.5:99.5, wherein the microfibrillated cellulose has a fibre steepness of from about 20 to about 50; and, optionally, wherein the microfibrillating is performed in the presence of a grinding medium which is to be removed after completion of grinding.

In another aspect of the present disclosure there is presented, a method of manufacturing a partially-dried sheet comprising microfibrillated cellulose suitable for use as a binder; wherein the moisture content of the partially-dried sheet is in the range of greater than about 20% to about 60%, or about 20% by weight to 85% by weight moisture (e.g., water); wherein, when the partially-dried sheet is re-dispersed in a aqueous medium with a disperser, mixer, or refiner operated at energy inputs of about 10 kWh/t to about 2,000 kWh/t, the partially-dried sheet upon re-dispersion in a aqueous medium maintains, or is not substantially degraded in, mechanical properties of the MFC compared to a sheet comprising a comparable amount of microfibrillated cellulose prior to drying and re-dispersion. The partially-dried sheet may be dried to a moisture content of greater than about 20% by weight to about 60% by weight, or about 20% by weight to about 85% weight (e.g., water) by any conventional dewatering and drying techniques.

In an embodiment of the foregoing aspect of the present disclosure, a pulp stock is prepared from a pulp selected from the group comprising (or consisting essentially of, or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC), which is then added to the pulp stock in the range of 0.5 wt. % to 99.5 wt. % of the total dry mass.

In an another embodiment, a liquid composition of microfibrillated cellulose is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp.

In an aspect of the present disclosure there is presented, a method of manufacturing a partially-dried sheet consisting essentially of microfibrillated cellulose suitable for use as a binder; wherein the moisture content of the partially-dried sheet is in the range of greater than about 20% by weight to about 60%, or about 20% by weight to 85% by weight of moisture (e.g., water); by weight of water; wherein, when the partially-dried sheet is re-dispersed in a aqueous medium with a disperser, mixer, or refiner operated at energy inputs of about 10 kWh/t to about 2,000 kWh/t, the partially-dried sheet upon re-dispersion in a aqueous medium maintains, or is not substantially degraded in, mechanical properties of the MFC compared to a partially-dried sheet comprising a comparable amount of microfibrillated cellulose prior to drying and re-dispersion.

In an embodiment of the foregoing aspect of the present disclosure, a pulp stock is prepared from a pulp selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC), which is then added to the pulp stock in the range of 0.5 wt. % to 99.5 wt. % of the total dry mass.

In an another embodiment, a liquid composition of microfibrillated cellulose is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp.

In an aspect of the present disclosure there is presented, a method of manufacturing a partially-dried sheet consisting of microfibrillated cellulose suitable for use as a binder; wherein the moisture content of the sheet is in the range of greater than about 20% by weight to about 60%, or about 20% by weight to about 85% by weight moisture (e.g., water); wherein, when the partially-dried sheet is re-dispersed in a aqueous medium with a disperser, mixer, or refiner operated at energy inputs of about 10 kWh/t to about 2,000 kWh/t, the partially-dried sheet upon re-dispersion in a aqueous medium maintains, or is not substantially degraded in, mechanical properties of the MFC compared to a sheet comprising a comparable amount of microfibrillated cellulose prior to drying and re-dispersion.

In an embodiment of the foregoing aspect of the present disclosure, a pulp stock is prepared from a pulp selected from the group comprising (or consisting essentially of, or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the pulp stock is processed into a liquid suspension (or slurry) of microfibrillated cellulose (MFC).

In an aspect of the present disclosure there is presented, a method of manufacturing a partially-dried sheet comprising a blend of microfibrillated cellulose and a pulp suitable for use as a pulp source; wherein the moisture content of the sheet is in the range of about 20% by weight to about 60%, or about 20% by weight to 85% by weight moisture (e.g., water); wherein, when the partially-dried sheet is re-dispersed in a aqueous medium with a disperser, mixer, or refiner operated at energy inputs of about 10 kWh/t to about 2,000 kWh/t, the partially-dried sheet upon re-dispersion in a aqueous medium maintains, or is not substantially degraded in, mechanical properties of the MFC compared to a sheet comprising a comparable amount of microfibrillated cellulose prior to drying and re-dispersion.

In an embodiment of the foregoing aspect of the present disclosure, a pulp stock is prepared from a pulp selected from the group comprising (or consisting essentially of, or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC), which is then added to the pulp stock in the range of 0.5 wt. % to 99.5 wt. % of the total dry mass.

In an another embodiment, a liquid composition of microfibrillated cellulose is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC), which is then added to the pulp stock in the range of 0.5 wt. % to 99.5 wt. % of the total dry mass.

In an another embodiment, a liquid composition of microfibrillated cellulose is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp.

In an aspect of the present disclosure there is presented, a method of manufacturing a partially-dried sheet consisting essentially of, a blend of microfibrillated cellulose and a pulp suitable for use as a pulp source; wherein the moisture content of the sheet is in the range of greater than about 20% by weight to about 60%, or about 20% by weight to about 85% by weight moisture (e.g., water); wherein, when the partially-dried sheet is re-dispersed in a aqueous medium with a disperser, mixer or refiner operated at energy inputs of about 10 kWh/t to about 2,000 kWh/t, the partially-dried sheet upon re-dispersion in a aqueous medium maintains, or is not substantially degraded in, mechanical properties of the MFC compared to a sheet comprising a comparable amount of microfibrillated cellulose prior to drying and re-dispersion.

In an embodiment of the foregoing aspect of the present disclosure, a pulp stock is prepared from a pulp selected from the group comprising (or consisting essentially of, or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC), which is then added to the pulp stock in the range of 0.5 wt. % to 99.5 wt. % of the total dry mass.

In an another embodiment, a liquid composition of microfibrillated cellulose is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp.

In an aspect of the present disclosure there is presented, a method of manufacturing a partially-dried sheet consisting of, a blend of microfibrillated cellulose and a pulp suitable for use as a pulp source; wherein the moisture content of the sheet is in the range of greater than about 20% by weight to about 60%, or about 20% by weight to 85% by weight moisture (e.g., water); wherein, when the partially-dried sheet is re-dispersed in a aqueous medium with a disperser, mixer or refiner operated at energy inputs of about 10 kWh/t to about 2,000 kWh/t, the partially-dried sheet upon re-dispersion in a aqueous medium maintains, or is not substantially degraded in, mechanical properties of the MFC compared to a sheet comprising a comparable amount of microfibrillated cellulose prior to drying and re-dispersion.

In an embodiment of the foregoing aspect of the present disclosure, a pulp stock is prepared from a pulp selected from the group comprising (or consisting essentially of, or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC), which is then added to the pulp stock in the range of 0.5 wt. % to 99.5 wt. % of the total dry mass.

In an another embodiment, a liquid composition of microfibrillated cellulose is provided and mixed with the pulp stock selected from the group comprising (or consisting essentially of, or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp.

In an aspect of the present disclosure there is presented, a method of manufacturing a dried sheet comprising microfibrillated cellulose suitable for use as a binder; wherein the moisture content of the dried sheet is about 20% by weight or less (e.g., water); wherein, when the dried sheet is re-dispersed in a aqueous medium with a disperser, mixer, or refiner operated at energy inputs of about 10 kWh/t to about 2,000 kWh/t, the dried sheet upon re-dispersion in a aqueous medium maintains, or is not substantially degraded in, mechanical properties of the MFC compared to a dried sheet comprising a comparable amount of microfibrillated cellulose prior to drying and re-dispersion.

In an embodiment of the foregoing aspect of the present disclosure, a pulp stock is prepared from a pulp selected from the group comprising (or consisting essentially of, or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC), which is then added to the pulp stock in the range of 0.5 wt. % to 99.5 wt. % of the total dry mass.

In an another embodiment, a liquid composition of microfibrillated cellulose is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp In an aspect of the present disclosure there is presented, a method of manufacturing a dried sheet consisting essentially of microfibrillated cellulose suitable for use as a binder; wherein the moisture content of the dried sheet is about 20% by weight or less of water; wherein, when the dried sheet is re-dispersed in a aqueous medium with a disperser, mixer, or refiner operated at energy inputs of about 10 kWh/t to about 2,000 kWh/t, the dried sheet upon re-dispersion in a aqueous medium maintains, or is not substantially degraded in, mechanical properties of the MFC compared to a dried sheet comprising a comparable amount of microfibrillated cellulose prior to drying and re-dispersion.

In an embodiment of the foregoing aspect of the present disclosure, a pulp stock is prepared from a pulp selected from the group comprising (or consisting essentially or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC), which is then added to the pulp stock in the range of 0.5 wt. % to 99.5 wt. % of the total dry mass.

In an another embodiment, a liquid composition of microfibrillated cellulose is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp In an aspect of the present disclosure there is presented, a method of manufacturing a dried sheet consisting of microfibrillated cellulose suitable for use as a binder; wherein the moisture content of the dried sheet is about 20% by weight or less of water; wherein, when the dried sheet is re-dispersed in a aqueous medium with a disperser, mixer, or refiner operated at energy inputs of about 10 kWh/t to about 2,000 kWh/t, the dried sheet upon re-dispersion in a aqueous medium maintains, or is not substantially degraded in, mechanical properties of the MFC compared to a dried sheet comprising a comparable amount of microfibrillated cellulose prior to drying and re-dispersion.

In an aspect of the present disclosure there is presented, a method of manufacturing a dried sheet comprising a blend of microfibrillated cellulose and a pulp suitable for use as a pulp source; wherein the moisture content of the dried sheet is about 20% by weight or less of water; wherein, when the dried sheet is re-dispersed in a aqueous medium with a disperser, mixer, or refiner operated at energy inputs of about 10 kWh/t to about 2,000 kWh/t, the dried sheet upon re-dispersion in a aqueous medium maintains, or is not substantially degraded in, mechanical properties of the MFC compared to a dried sheet comprising a comparable amount of microfibrillated cellulose prior to drying and re-dispersion.

In an embodiment of the foregoing aspect of the present disclosure, a pulp stock is prepared from a pulp selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC), which is then added to the pulp stock in the range of 0.5 wt. % to 99.5 wt. % of the total dry mass.

In an another embodiment, a liquid composition of microfibrillated cellulose is provided and mixed with the pulp stock selected from the group comprising (or consisting essentially of, or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp.

In an aspect of the present disclosure there is presented, a method of manufacturing a dried sheet consisting essentially of, a blend of microfibrillated cellulose and a pulp suitable for use as a pulp source; wherein the moisture content of the dried sheet is about 20% by weight or less of water; wherein, when the dried sheet is re-dispersed in a aqueous medium with a disperser, mixer or disperser operated at energy inputs of about 10 kWh/t to about 2,000 kWh/t, the dried sheet upon re-dispersion in a aqueous medium maintains, or is not substantially degraded in, mechanical properties of the MFC compared to a dried sheet comprising a comparable amount of microfibrillated cellulose prior to drying and re-dispersion.

In an aspect of the present disclosure there is presented, a method of manufacturing a dried sheet consisting of, a blend of microfibrillated cellulose and a pulp suitable for use as a pulp source; wherein the moisture content of the dried sheet is about 20% by weight or less of water; wherein, when the dried sheet is re-dispersed in a aqueous medium with a disperser or mixer operated at energy inputs of about 10 kWh/t to about 2,000 kWh/t, the dried sheet upon re-dispersion in a aqueous medium maintains, or is not substantially degraded in, mechanical properties of the MFC compared to a sheet comprising a comparable amount of microfibrillated cellulose prior to drying and re-dispersion.

In an embodiment of the foregoing aspect of the present disclosure, a pulp stock is prepared from a pulp selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC), which is then added to the pulp stock in the range of 0.5 wt. % to 99.5 wt. % of the total dry mass.

In an another embodiment, a liquid composition of microfibrillated cellulose is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp In a further aspect of the previous aspects and embodiments of the present disclosure there is presented a method of manufacturing a partially-dried sheet comprising a blend of microfibrillated cellulose and at least one inorganic particulate material and a pulp suitable for use as a pulp source; wherein the moisture content of the sheet is in the range of greater than about 20% by weight to about 60% by weight, or about 20% by weight to about 85% by weight moisture (e.g., water); wherein, when the partially dried sheet is re-dispersed in a aqueous medium with a disperser, mixer or refiner operated at energy inputs of about 10 kWh/t to about 2,000 kWh/t, the partially-dried sheet upon re-dispersion in a aqueous medium maintains, or is not substantially degraded in, mechanical properties of the MFC compared to a partially-dried sheet comprising a comparable amount of microfibrillated cellulose and at least one inorganic material and a pulp source prior to drying and re-dispersion; wherein the microfibrillated cellulose is obtained by a co-grinding microfibrillation process wherein a fibrous substrate comprising cellulose is microfibrillated in an aqueous environment in a grinding apparatus in the presence of at least one inorganic particulate material; wherein the fibrous substrate to the inorganic particulate material are in a ratio of about 99.5:0.5 to about 0.5:99.5; wherein the microfibrillated cellulose has a fibre steepness of from about 20 to about 50; and, optionally, wherein the microfibrillating is performed in the presence of a grinding medium which is to be removed after completion of grinding.

In an embodiment of the foregoing aspect of the present disclosure, a pulp stock is prepared from a pulp selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp. The solids content of the pulp stock (or slurry) is in the range of about 0.5 wt. % to about 30 wt. %. In an embodiment, of the foregoing aspect of the present invention, a portion of the pulp stock is processed into a liquid suspension (or slurry) of microfibrillated cellulose (MFC) and at least one inorganic particulate material. Which is then added to the pulp stock in the range of 0.5 wt. % to 99.5 wt. % of the total dry mass. In an embodiment, of the foregoing aspect of the present invention, a portion of the pulp stock is processed into a liquid suspension (or slurry) of microfibrillated cellulose (MFC) and one or more inorganic particulate material, which is then added to the pulp stock in the range of 0.5 wt. % to 99.5 wt. % of the total dry mass.

In an another embodiment, a liquid composition of microfibrillated cellulose and one or more inorganic particulate material is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp In an another embodiment, a liquid composition of microfibrillated cellulose and one or more inorganic particulate material is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp.

In a further aspect of the previous aspects and embodiments of the present disclosure there is presented a method of manufacturing a partially-dried sheet consisting essentially of a blend of microfibrillated cellulose and one or more inorganic particulate material and a pulp suitable for use as a pulp source; wherein the moisture content of the sheet is in the range of greater than about 20% by weight to about 60% by weight, or about 20% by weight to about 85% by weight moisture (e.g., water); wherein, when the partially dried sheet is re-dispersed in a aqueous medium with a disperser, mixer or refiner operated at energy inputs of about 10 kWh/t to about 2,000 kWh/t, the partially-dried sheet upon re-dispersion in a aqueous medium maintains, or is not substantially degraded in, mechanical properties of the MFC compared to a partially-dried sheet comprising a comparable amount of microfibrillated cellulose and at least one inorganic material and a pulp source prior to drying and re-dispersion; wherein the microfibrillated cellulose is obtained by a co-grinding microfibrillation process wherein a fibrous substrate comprising cellulose is microfibrillated in an aqueous environment in a grinding apparatus in the presence of at least one inorganic particulate material, wherein the fibrous substrate to the inorganic particulate material are in a ratio of about 99.5:0.5 to about 0.5:99.5, wherein the microfibrillated cellulose has a fibre steepness of from about 20 to about 50; and, optionally, wherein the microfibrillating is performed in the presence of a grinding medium which is to be removed after completion of grinding.

In an another embodiment, a liquid composition of microfibrillated cellulose and one or more inorganic particulate material is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp.

In a further aspect of the previous aspects and embodiments of the present disclosure there is presented a method of manufacturing a partially-dried sheet consisting of a blend of microfibrillated cellulose and one or more inorganic particulate material and a pulp suitable for use as a pulp source; wherein the moisture content of the sheet is in the range of greater than about 20% by weight to about 60% by weight, or about 20% by weight to about 85% by weight moisture (e.g., water); wherein, when the partially dried sheet is re-dispersed in a aqueous medium with a disperser, mixer or refiner operated at energy inputs of about 10 kWh/t to about 2,000 kWh/t, the partially-dried sheet upon re-dispersion in a aqueous medium maintains, or is not substantially degraded in, mechanical properties of the MFC compared to a partially-dried sheet comprising a comparable amount of microfibrillated cellulose and one or more inorganic material and a pulp source prior to drying and re-dispersion; wherein the microfibrillated cellulose is obtained by a co-grinding microfibrillation process wherein a fibrous substrate comprising cellulose is microfibrillated in an aqueous environment in a grinding apparatus in the presence of at least one inorganic particulate material; wherein the fibrous substrate to the inorganic particulate material are in a ratio of about 99.5:0.5 to about 0.5:99.5; wherein the microfibrillated cellulose has a fibre steepness of from about 20 to about 50; and, optionally, wherein the microfibrillating is performed in the presence of a grinding medium which is to be removed after completion of grinding.

In an another embodiment, a liquid composition of microfibrillated cellulose and one or more inorganic particulate material is provided and mixed with the pulp stock selected from the group comprising (or consisting essentially of, or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp.

In a further aspect of the previous aspects and embodiments of the present disclosure there is presented a method of manufacturing a dried sheet comprising a blend of microfibrillated cellulose and at least one inorganic particulate material and a pulp suitable for use as a pulp source; wherein the moisture content of the dried sheet is about 20% by weight or less of water; wherein, when the dried sheet is re-dispersed in a aqueous medium with a disperser, mixer or refiner operated at energy inputs of about 10 kWh/t to about 2,000 kWh/t, the dried sheet upon re-dispersion in a aqueous medium maintains, or is not substantially degraded in, mechanical properties of the MFC compared to a dried sheet comprising a comparable amount of microfibrillated cellulose and at least one inorganic material and a pulp source prior to drying and re-dispersion; wherein the microfibrillated cellulose is obtained by a co-grinding microfibrillation process wherein a fibrous substrate comprising cellulose is microfibrillated in an aqueous environment in a grinding apparatus in the presence of at least one inorganic particulate material, wherein the fibrous substrate to the inorganic particulate material are in a ratio of about 99.5:0.5 to about 0.5:99.5; wherein the microfibrillated cellulose has a fibre steepness of from about 20 to about 50; and, optionally, wherein the microfibrillating is performed in the presence of a grinding medium which is to be removed after completion of grinding.

In an another embodiment, a liquid composition of microfibrillated cellulose and one or more inorganic particulate material is provided and mixed with the pulp stock selected from the group comprising (or consisting essentially of, or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp In a further aspect of the previous aspects and embodiments of the present disclosure there is presented a method of manufacturing a dried sheet consisting essentially of a blend of microfibrillated cellulose and at least one inorganic particulate material and a pulp suitable for use as a pulp source; wherein the moisture content of the dried sheet is about 20% by weight or less of water; wherein, when the dried sheet is re-dispersed in a aqueous medium with a disperser, mixer or refiner operated at energy inputs of about 10 kWh/t to about 2,000 kWh/t, the dried sheet upon re-dispersion in a aqueous medium maintains, or is not substantially degraded in, mechanical properties of the MFC compared to a dried sheet comprising a comparable amount of microfibrillated cellulose and at least one inorganic material and a pulp source prior to drying and re-dispersion; wherein the microfibrillated cellulose is obtained by a co-grinding microfibrillation process wherein a fibrous substrate comprising cellulose is microfibrillated in an aqueous environment in a grinding apparatus in the presence of at least one inorganic particulate material, wherein the fibrous substrate to the inorganic particulate material are in a ratio of about 99.5:0.5 to about 0.5:99.5, wherein the microfibrillated cellulose has a fibre steepness of from about 20 to about 50; and, optionally, wherein the microfibrillating is performed in the presence of a grinding medium which is to be removed after completion of grinding.

In an another embodiment, a liquid composition of microfibrillated cellulose and one or more inorganic particulate material is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp.

In a further aspect of the previous aspects and embodiments of the present disclosure there is presented a method of manufacturing a dried sheet consisting of a blend of microfibrillated cellulose and at least one inorganic particulate material and a pulp suitable for use as a pulp source; wherein the moisture content of the dried sheet is about 20% by weight or less of water; wherein, when the dried sheet is re-dispersed in a aqueous medium with a disperser, mixer or refiner operated at energy inputs of about 10 kWh/t to about 2,000 kWh/t, the dried sheet upon re-dispersion in a aqueous medium maintains, or is not substantially degraded in, mechanical properties of the MFC compared to a dried sheet comprising a comparable amount of microfibrillated cellulose, at least one inorganic material and a pulp source prior to drying and re-dispersion; wherein the microfibrillated cellulose is obtained by a co-grinding microfibrillation process wherein a fibrous substrate comprising cellulose is microfibrillated in an aqueous environment in a grinding apparatus in the presence of at least one inorganic particulate material; wherein the fibrous substrate to the inorganic particulate material are in a ratio of about 99.5:0.5 to about 0.5:99.5; wherein the microfibrillated cellulose has a fibre steepness of from about 20 to about 50; and, optionally, wherein the microfibrillating is performed in the presence of a grinding medium which is to be removed after completion of grinding.

In an another embodiment, a liquid composition of microfibrillated cellulose and one or more inorganic particulate material is provided and mixed with the pulp stock selected from the group comprising (or consisting essentially of or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp In an embodiment of any of the foregoing aspects and embodiments, dried or partially dried sheets are prepared by adding MFC in dosages of about 0.5 wt. % to about 40 wt. %, or about 0.5 wt. % to about 30 wt. %, or about 0.5 wt. % to about 25 wt. %, or about 0.5 wt. % to about 20 wt. %, or about 0.5 wt. % to about 15 wt. %, or about or about 0.5 wt. % to about 12.5 wt. %, or about 0.5 wt. % to about 10 wt. %, or about 0.5 wt. % to about 9 wt. %, or about 0.5 wt. % to about 8 wt. %, or about 0.5 wt. % to about 7 wt. %, or about 0.5 wt. % to about 6 wt. %, or about 0.5 wt. % to about 5 wt. %, or about 0.5 wt. % to about 4 wt. %, or about 0.5 wt. % to about 3 wt. %, or about 0.5 wt. % to about 2.5 wt. %, or about 0.5 wt. % to about 2 wt. %, or about 0.5 wt. % to about 1.5 wt. %, or about 0.5 wt. % to about 1 wt. %.

In an embodiment of any of the foregoing aspects and embodiments, dried or partially dried sheet may be a wet lap.

In an embodiment of any of the foregoing aspects and embodiments, the sheet may be a pad.

In an embodiment of any of the foregoing aspects and embodiments, the sheet may be a reel.

In an embodiment of any of the foregoing aspects and embodiments, the sheet may be baled.

In an embodiment of any of the foregoing aspects and embodiments, may be further molded or shaped as an object.

In an embodiment of any of the foregoing aspects and embodiments, the MFC may have a fibre steepness of from about 20 to about 50.

In an embodiment of any of the foregoing aspects and embodiments, fibre steepness determined by the formula: Steepness$=100\times(d_{30}/d_{70})$.

In an embodiment of any of the foregoing aspects and embodiments, the dried sheet maintains, or is not substantially degraded in mechanical properties of the MFC and viscosity, compared to the sheet prior to drying and re-dispersion.

In an embodiment of any of the foregoing aspects and embodiments, the partially-dried sheet maintains, or is not substantially degraded in both mechanical properties of the MFC and viscosity, compared to the sheet prior to drying and re-dispersion.

In an embodiment of any of the foregoing aspects and embodiments, the dried sheet comprises MFC and further comprises one or more inorganic particulate material.

In an embodiment of any of the foregoing aspects and embodiments, the partially-dried sheet comprises MFC and further comprises one or more inorganic particulate material.

In an embodiment of any of the foregoing aspects and embodiments, the microfibrillated cellulose is obtained by a co-grinding process comprising grinding a fibrous substrate comprising cellulose in an aqueous medium in the presence of one or more inorganic particulate material, wherein the fibrous substrate to the inorganic particulate material are in a ratio of about 99.5:0.5 to about 0.5:99.5, and optionally wherein the microfibrillating is performed in the presence of a grinding medium which is to be removed after completion of grinding, wherein the microfibrillated cellulose has a fibre steepness of from about 20 to about 50.

In an another embodiment, a liquid composition of microfibrillated cellulose is provided and mixed with the pulp stock selected from the group comprising (or consisting essentially of, or consisting of) a mechanical pulp, thermomechanical pulp, chemi-thermomechanical pulp, chemical pulp (e.g., Kraft, Soda or Sulfite), bleached pulp, recycled pulp (optionally combining cleaning and de-inking steps), steam exploded fibre pulp or biologically (enzymatically) treated pulp.

In an embodiment of any of the foregoing aspects and embodiments, the fibrous substrate comprising cellulose has a Canadian Standard Freeness equal to or less than 450 $cm^3$.

In an embodiment of any of the foregoing aspects and embodiments, the method further comprises a grinding medium. In a further embodiment, the grinding medium is present in an amount of at least about 10% by volume of the aqueous medium, or up to about 70% by volume of the aqueous medium. In another embodiment, the grinding medium comprises particles having an average diameter in ranging from about 0.5 mm to about 6 mm. In another embodiment, the grinding medium comprises particles having a specific gravity of at least about 2.5.

In an embodiment of any of the foregoing aspects and embodiments, the fibrous substrate comprising cellulose is present in the aqueous medium at an initial solids content of at least about 5 wt. %.

In an embodiment of any of the foregoing aspects and embodiments, the initial solids content is at least about 0.5 wt. %.

In an embodiment of any of the foregoing aspects and embodiments, the solids content may be in the range of about 0.5 wt. % to about 30 wt. %.

In an embodiment of any of the foregoing aspects and embodiments, the grinding is performed in a tower mill or a screened grinder.

In an embodiment, the screened grinder is a stirred media detritor.

In another embodiment, the screened grinder comprises one or more screens having a nominal aperture size of at least about 250 μm.

In an embodiment of any of the foregoing aspects and embodiments, the grinding is performed in a cascade of grinding vessels.

In an embodiment of any of the foregoing aspects and embodiments, the grinding medium is selected from (or selected from the group consisting of) alumina, zirconia, zirconium silicate, aluminum silicate or the mullite-rich material which is produced by calcining kaolinitic clay at a temperature in the range of from about 1300° C. to about 1800° C.

In an embodiment of any of the foregoing aspects and embodiments, the grinding medium is the mullite-rich material which is produced by calcining kaolinitic clay at a temperature in the range of from about 1300° C. to about 1800°.

In an embodiment of any of the foregoing aspects and embodiments, the one or more inorganic particulate material comprises a platy mineral, kaolin and/or talc.

In an embodiment of any of the foregoing aspects or embodiments, the one or more inorganic particulate material is calcium carbonate or kaolin, or mixtures thereof.

In an embodiment of any of the foregoing aspects and embodiments, the one or more inorganic particulate material comprises calcium carbonate.

In an embodiment of any of the foregoing aspects and embodiments, the calcium carbonate is ground calcium carbonate.

In an embodiment of any of the foregoing aspects and embodiments, the ground calcium carbonate is natural ground calcium carbonate, selected from marble, limestone and/or chalk; and mixtures thereof.

In an embodiment of any of the foregoing aspects and embodiments, the calcium carbonate is precipitated calcium carbonate.

In an embodiment of any of the foregoing aspects and embodiments, the calcium carbonate is vateritic, calcitic or aragonitic crystal structure.

In an embodiment of any of the foregoing aspects and embodiments, the precipitated calcium carbonate is ultrafine discrete prismatic, scalenohedral or rhombohedral precipitated calcium carbonate.

In an embodiment of any of the foregoing aspects and embodiments, the one or more inorganic particulate material is calcium carbonate or kaolin, or mixtures thereof.

In an embodiment of any of the foregoing aspects and embodiments, the calcium carbonate is ground calcium carbonate, precipitated calcium carbonate, or mixtures thereof.

In an embodiment of any of the foregoing aspects and embodiments, the one or more inorganic particulate material is selected from (or selected form the group consisting of) an alkaline earth metal carbonate or sulphate, calcium carbonate, magnesium carbonate, dolomite, gypsum, bentonite, a hydrous kandite clay such as kaolin, halloysite, ball clay, an anhydrous (calcined) kandite clay such as metakaolin or fully calcined kaolin, talc, mica, perlite sepiolite, huntite, diatomite, magnesite, silicates, or diatomaceous earth, or combinations thereof.

In an embodiment of any of the foregoing aspects and embodiments, the microfibrillated cellulose is obtained from a chemical pulp (e.g., Kraft, Soda or Sulfite), or a chemi-thermomechanical pulp, or a mechanical pulp, or thermo-mechanical pulp, including, for example, Northern Bleached Softwood Kraft pulp ("NBSK"), Bleached Chemi-Thermo Mechanical Pulp ("BCTMP"), or a recycled pulp (optionally combining cleaning and deinking steps), or a paper broke pulp, or a papermill waste stream, or waste from a papermill, or combinations thereof.

In an embodiment of any of the foregoing aspects and embodiments, the pulp source is kraft pulp, or bleached long fibre kraft pulp.

In an embodiment of any of the foregoing aspects and embodiments, the pulp source is softwood pulp selected from spruce, pine, fir, larch and hemlock or mixed softwood pulps.

In an embodiment of any of the foregoing aspects and embodiments, the pulp source is hardwood pulp selected from eucalyptus, aspen and birch, or mixed hardwood pulps.

In an embodiment of any of the foregoing aspects and embodiments, the pulp source is eucalyptus pulp, spruce pulp, pine pulp, beech pulp, hemp pulp, acacia cotton pulp, and mixtures thereof.

In an embodiment of any of the foregoing aspects and embodiments, the pulp source for preparation of microfibrillated cellulose having increased tensile properties, further comprises the steps of:

(i) providing a multiplicity of fibrous substrates comprising cellulose;

(ii) determining the zero-span tensile index in Nm/g and hemicellulose content of the fibrous substrates comprising cellulose;

(iii) predicting the MFC tensile index in Nm/g from the product of the hemicellulose content and fibre zero-span tensile index of the fibrous substrates comprising cellulose; and (iv) selecting the fibrous substrates comprising cellulose having a desired MFC tensile index.

In an embodiment of any of any of the foregoing aspects and embodiments, the dried or partially-dried sheet is re-dispersed in the presence of one or more additives selected from the group consisting of one or more salts, one or more sugars, one or more glycols, urea, carboxymethylcellulose and guar gum.

In an embodiment of any of the foregoing aspects and embodiments, the sugar is selected from one or more of monosaccharides, disaccharides, oligosaccharides and polysaccharides.

In an embodiment of any of the foregoing aspects and embodiments, the one or more salts comprise sodium chloride.

In an embodiment of any of the foregoing aspects and embodiments, the one or more glycols comprise ethylene glycol.

In an embodiment of any of the foregoing aspects and embodiments, said method further comprises use of the re-dispersed partially-dried or dried sheet in, or in the manufacture of, an article, product or composition.

In an embodiment of any of the foregoing aspects and embodiments, said re-dispersing comprises using a high shear disperser.

In an embodiment of any of the foregoing aspects and embodiments, said re-dispersing comprises using a high shear mixer.

In an embodiment of any of the foregoing aspects and embodiments, the fibrous substrate comprising cellulose has a Canadian Standard Freeness equal to or less than 450 $cm^3$.

In an embodiment of any of the foregoing aspects and embodiments, the dried or partially-dried sheet comprising, consisting essentially or, or consisting of, microfibrillated cellulose, and optionally inorganic particulate material, with enhanced viscosity and/or tensile index properties obtained by the method is suitable for use in a method of making paper or coating paper, paints and coatings, inks, oilfield chemicals, composites, consumer products, cosmetic products, pharmacological products and food products.

BRIEF DESCRIPTION OF THE DRAWINGS

For a more complete understanding of the principles disclosed herein, and the advantages thereof, reference is made to the following descriptions taken in conjunction with the accompanying drawings, in which:

For a more complete understanding of the principles disclosed herein, and the advantages thereof, reference is made to the following descriptions taken in conjunction with the accompanying drawings, in which:

FIG. 7A is a plot of drainage time (sheet former) versus MFC dose for 100% Södra Blue furnish (unrefined) at 80 g/m$^2$ handsheets. FIG. 7B is a plot of Canadian Standard Freeness (CSF) versus MFC dose for 100% Södra Blue furnish (unrefined). FIG. 7C is a plot of (calculated) Schopper Riegler degrees versus MFC dose for 100% Södra Blue furnish (unrefined). FIG. 7D is a plot of ash content versus MFC dose for 100% Södra Blue furnish (unrefined) at 80 g/m$^2$ handsheets.

FIG. 8A is a plot of fibre length (ISO) versus MFC dose. FIG. 8B is a plot of fibre width versus MFC dose. FIG. 8C is plot of optical coarseness versus MFC dose. FIG. 8D is a plot of fibrillation percentage versus MFC dose.

FIG. 10A is a plot of Scott Bond values versus MFC dose for 100% Södra Blue furnish (unrefined) at 80 g/m$^2$ handsheets.

FIG. 10B is a plot of Bendtsen Porosity versus MFC dose for 100% Södra Blue furnish (unrefined) at 80 g/m$^2$ handsheets. FIG. 10C is a plot of Roughness versus MFC dose for 100% Södra Blue furnish (unrefined) at 80 g/m$^2$ handsheets. FIG. 10D is a plot of Bulk versus MFC dose for 100% Södra Blue furnish (unrefined) at 80 g/m$^2$ handsheets. The paper properties plotted are TL=Scott Bond, TR=Bendtsen Porosity, BL=PPS Roughness, and BR=Bulk.

FIG. 11A is a plot of =Burst Index versus MFC dose for 100% Södra Blue furnish (unrefined) at 80 g/m$^2$ handsheets. FIG. 11B is a plot of Tensile Breaking Energy versus MFC dose for 100% Södra Blue furnish (unrefined) at 80 g/m$^2$ handsheets. FIG. 11C is a plot of Tensile Elongation versus MFC dose for 100% Södra Blue furnish (unrefined) at 80 g/m$^2$ handsheets. FIG. 11D is a plot of Tensile Index versus MFC dose for 100% Södra Blue furnish (unrefined) at 80 g/m$^2$ handsheets. The paper properties plotted are TL=Burst Index, TR=Tensile Breaking Energy, BL=Tensile Elongation, BR=Tensile Index.

FIG. 12A is a plot of opacity versus MFC dose for 100% Södra Blue furnish (unrefined) at 80 g/m$^2$ handsheets.

FIG. 12B is a plot of Brightness versus MFC dose for 100% Södra Blue furnish (unrefined) at 80 g/m$^2$ handsheets. FIG. 12C is a plot of Light Scattering Coefficient versus MFC dose for 100% Södra Blue furnish (unrefined) at 80 g/m$^2$ handsheets. FIG. 12D is a plot of Light Absorption Coefficient versus MFC dose for 100% Södra Blue furnish (unrefined) at 80 g/m$^2$ handsheets. The paper properties plotted are TL=Opacity, TR=Brightness, BL=Light Scattering Coefficient, BR=Light Absorption Coefficient.

FIG. 13 is a Table of fibre analysis data recorded with the Valmet FS5 fibre analyzer for the experimental sample where MFC is added to the NBSK furnish.

FIG. 20 shows the Tensile strength (FLT Index) of the control and of the re-suspended dry sheets as measured in accordance with Example 2. These data indicate that the sheets have FLT index's that are no lower than that of the control slurry prior to drying thus indicating that sheets of MFC/pulp can be re-suspended to the original FLT Index. These data show that mineral free MFC/Botnia pulp blends can be dried into sheets, easily re-dispersed, and the tensile strength does not suffer.

FIG. 21 illustrates the effect of subjecting the 50 wt. % POP H60/Botnia MFC and Botnia pulp blends to 1 minute of Silverson mixing, as described in Example 11

FIG. 22 shows the Tensile strength (FLT Index) of the control and of the re-suspended dry sheets as measured according to Example 2. These data indicate that the sheets have FLT index's that are no lower than that of the control slurry prior to drying thus indicating that sheets of MFC/pulp can be re-suspended to the original FLT Index. These data show that 50 wt. % POP H60/Botnia MFC/Botnia pulp blends can be dried into sheets, easily re-dispersed, and the tensile strength does not suffer.

FIG. 23 shows the Tensile strength (FLT Index) of the control and of the re-suspended dry sheets as measured in accordance with Example 2. These data indicate that the sheets have FLT index's that are no lower than that of the control slurry prior to drying thus indicating that sheets of MFC/pulp can be re-suspended to the original FLT Index. These data show that 50 wt. % POP H60/Botnia FiberLean/

Figure 1:
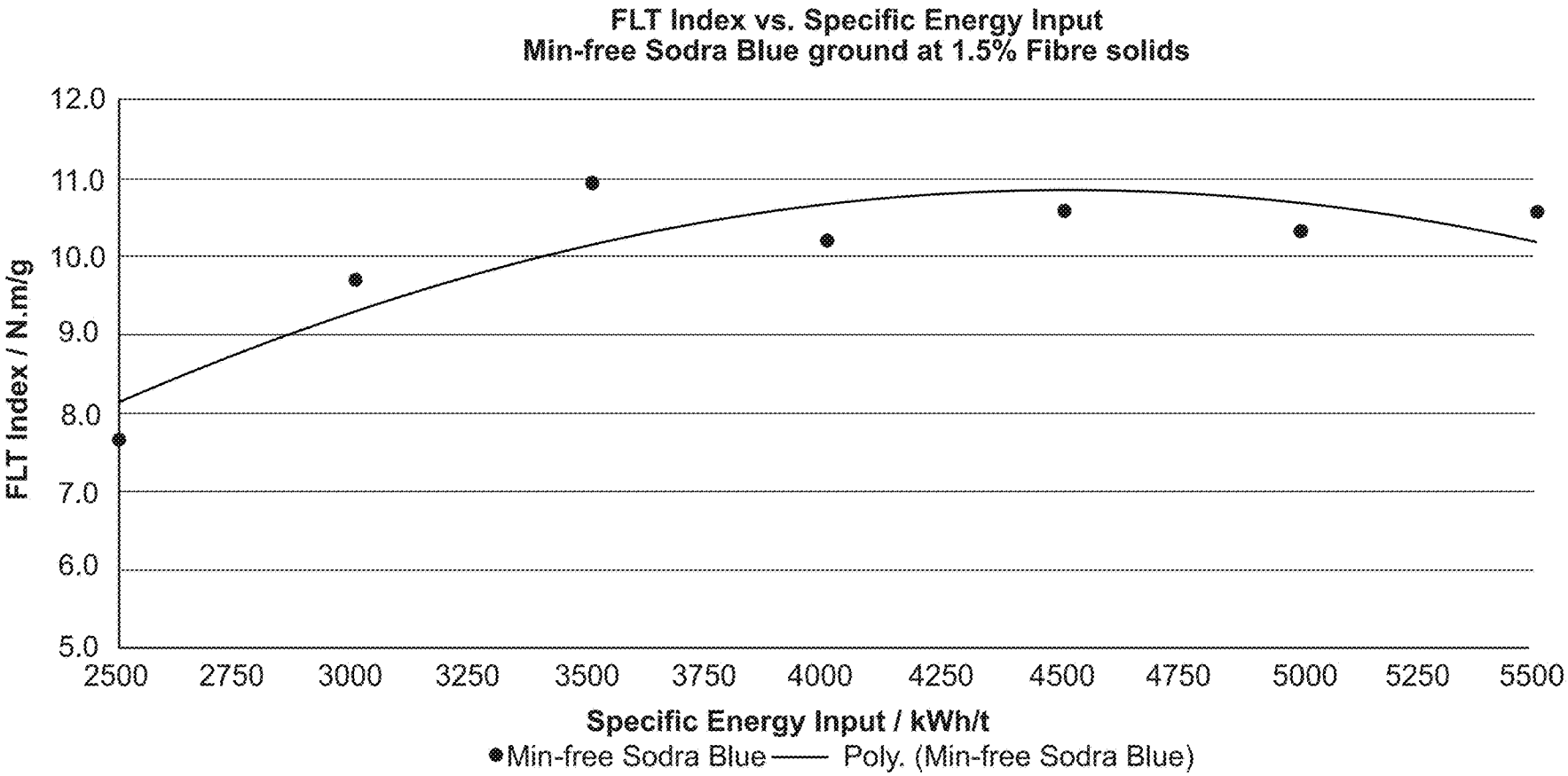
FIG. 1 is a plot of FLT Index vs. Specific Energy Input for mineral-free NBSK, ground at 1.5% fibre solids.

Botnia pulp blends can be dried into sheets, easily re-dispersed, and the tensile strength does not suffer

DETAILED DESCRIPTION OF THE INVENTION

The titles, headings and subheadings provided herein should not be interpreted as limiting the various aspects of the disclosure. Accordingly, the terms defined below are more fully defined by reference to the specification in its entirety. All references cited herein are incorporated by reference in their entirety.

The present invention in one aspect relates to the preparation of a sheet comprising microfibrillated cellulose and pulp. The present invention is based on the use of binder compositions comprising microfibrillated cellulose, which are added to pulp and formed into sheets having enhanced mechanical properties compared to pulp sheets produced without MFC and, further wherein, the enhanced mechanical properties are maintained, or are not substantially degraded, when the MFC-containing pulp sheets are dried and re-dispersed.

The foregoing has outlined rather broadly the features and technical advantages of the present disclosure in order that the detailed description of the invention that follows may be better understood. Additional features and advantages of the invention will be described herein, which form the subject of the claims of the invention. It should be appreciated by those skilled in the art that any conception and specific embodiment disclosed herein may be readily utilized as a basis for modifying or designing other means for carrying out the same purposes of the present disclosure. It should also be realized by those skilled in the art that such equivalent means do not depart from the spirit and scope of the invention as set forth in the appended claims. The novel features which are believed to be characteristic of the invention, both as to its organization and method of operation, together with further objects and advantages will be better understood from the following description when considered in connection with the accompanying Figures. It is to be expressly understood, however, that any description, Figure, Example, etc. is provided for the purpose of illustration and description only and is by no means intended to define the limits the invention.

Unless otherwise defined, scientific and technical terms used herein shall have the meanings that are commonly understood by those of ordinary skill in the art. Further, unless otherwise required by context, singular terms shall include pluralities and plural terms shall include the singular.

In this application, the use of "or" means "and/or" unless stated otherwise. In the context of a multiple dependent claim, the use of "or" refers back to more than one preceding independent or dependent claim in the alternative only.

The use of the word "a" or "an" when used in conjunction with the term "comprising" may mean "one," but it is also consistent with the meaning of "one or more," "at least one," and "one or more than one." The use of the term "or" is used to mean "and/or" unless explicitly indicated to refer to alternatives only if the alternatives are mutually exclusive, although the disclosure supports a definition that refers to only alternatives and "and/or." Throughout this application, the term "about" is used to indicate that a value includes the inherent variation of error for the quantifying device, the method being employed to determine the value, or the variation that exists among the study subjects. For example, but not by way of limitation, when the term "about" is utilized, the designated value may vary by plus or minus twelve percent, or eleven percent, or ten percent, or nine percent, or eight percent, or seven percent, or six percent, or five percent, or four percent, or three percent, or two percent, or one percent. The use of the term "at least one" will be understood to include one as well as any quantity more than one, including but not limited to, 1, 2, 3, 4, 5, 10, 15, 20, 30, 40, 50, 100, etc. The term "at least one" may extend up to 100 or 1000 or more depending on the term to which it is attached. In addition, the quantities of 100/1000 are not to be considered limiting as lower or higher limits may also produce satisfactory results. In addition, the use of the term "at least one of X, Y, and Z" will be understood to include X alone, Y alone, and Z alone, as well as any combination of X, Y, and Z.

The use of ordinal number terminology (i.e., "first", "second", "third", "fourth", etc.) is solely for the purpose of differentiating between two or more items and, unless otherwise stated, is not meant to imply any sequence or order or importance to one item over another or any order of addition.

As used herein, the terms "comprising" (and any form of comprising, such as "comprise", "comprises", and "comprised"), "having" (and any form of having, such as "have" and "has"), "including" (and any form of including, such as "includes" and "include"), or "containing" (and any form of containing, such as "contains" and "contain"), are inclusive or open-ended and do not exclude additional, unrecited elements or method steps. Additionally, a term that is used in conjunction with the term "comprising" is also understood to be able to be used in conjunction with the term "consisting of" or "consisting essentially of."

As used herein, the term "include" and its grammatical variants are intended to be non-limiting, such that recitation of items in a list is not to the exclusion of other like items that can be substituted or added to the listed items.

The fibrous substrate comprising cellulose (variously referred to herein as "fibrous substrate comprising cellulose," "cellulose fibres," "fibrous cellulose feedstock," "cellulose feedstock" and "cellulose-containing fibres (or fibrous," etc.) may be derived from virgin or recycled pulp or a papermill broke and/or industrial waste, or a paper streams rich in mineral fillers and cellulosic materials from a papermill.

As used herein, "FLT Index" is a tensile strength measurement performed in accordance with the procedures of Example 2.

As used herein, "mechanical properties" of the partially-dried MFC sheets and dried MFC-Pulp blend sheets include one or more of the following: Tensile Strength, Tensile Elongation, Tensile Index, Burst Strength, Tear Strength, Tear Index, Scott Bond, Breaking Energy and Breaking Elongation.

As used herein, the term "substantially" means that the subsequently described event or circumstance completely occurs or that the subsequently described event or circumstance occurs to a great extent or degree. For example, when associated with a particular event or circumstance, the term "substantially" means that the subsequently described event or circumstance occurs at least 80% of the time, or at least 85% of the time, or at least 90% of the time, or at least 95% of the time. Conversely, when used to signify that the mechanical properties, such as FLT tensile index and/or viscosity are "not substantially degraded" or similar language, the degradation of tensile index and/or viscosity are not diminished by more than 15%, or more than 10% or more than 5% from the properties of the control.

As used herein, the phrase "integer from X to Y" means any integer that includes the endpoints. For example, the phrase "integer from 1 to 5" means 1, 2, 3, 4, or 5.

Microfibrillated Cellulose

Microfibrillated cellulose (MFC), although well-known and described in the art, for purposes of the presently disclosed and/or claimed inventive concept(s), microfibrillated cellulose is defined as cellulose consisting of microfibrils in the form of either isolated cellulose microfibrils and/or microfibril bundles of cellulose, both of which are derived from a cellulose raw material. Thus, microfibrillated cellulose is to be understood to comprise partly or totally fibrillated cellulose or lignocellulose fibers, which may be achieved by a variety of processes known in the art.

As used herein, "microfibrillated cellulose" can be used interchangeably with "microfibrillar cellulose," "nanofibrillated cellulose," "nanofibril cellulose," "nanofibers of cellulose," "nanoscale fibrillated cellulose," "microfibrils of cellulose," and/or simply as "MFC." Additionally, as used herein, the terms listed above that are interchangeable with "microfibrillated cellulose" may refer to cellulose that has been completely microfibrillated or cellulose that has been substantially microfibrillated but still contains an amount of non-microfibrillated cellulose at levels that do not interfere with the benefits of the microfibrillated cellulose as described and/or claimed herein By "microfibrillating" is meant a process in which microfibrils of cellulose are liberated or partially liberated as individual species or as small aggregates as compared to the fibres of the pre-microfibrillated pulp. Typical cellulose fibres (i.e., pre-microfibrillated pulp) suitable for use in papermaking include larger aggregates of hundreds or thousands of individual cellulose fibrils Microfibrillated cellulose comprises cellulose, which is a naturally occurring polymer comprising repeated glucose units. The term "microfibrillated cellulose", also denoted MFC, as used in this specification, includes microfibrillated/microfibrillar cellulose and nano-fibrillated/nanofibrillar cellulose (NFC), which materials are also called nanocellulose.

Microfibrillated cellulose is prepared by stripping away the outer layers of cellulose fibers that may have been exposed through mechanical shearing, with or without prior enzymatic or chemical treatment. There are numerous methods of preparing microfibrillated cellulose that are known in the art.

In a non-limiting example, the term microfibrillated cellulose is used to describe fibrillated cellulose comprising nanoscale cellulose particle fibers or fibrils frequently having at least one dimension less than 100 nm. When liberated from cellulose fibres, fibrils typically have a diameter less than 100 nm. The actual diameter of cellulose fibrils depends on the source and the method of measuring such fibrils as well as the manufacturing methods that are employed.

The particle size distribution and/or aspect ratio (length/width) of the cellulose microfibrils attached to the fibrillated cellulose fiber or as a liberated microfibril depends on the source and the manufacturing methods employed in the microfibrillation process.

In a non-limiting example, the aspect ratio of microfibrils is typically high and the length of individual microfibrils may be more than one micrometer and the diameter may be within a range of about 5 to 60 nm with a number-average diameter typically less than 20 nm. The diameter of microfibril bundles may be larger than 1 micron.

In a non-limiting example, the smallest fibril is conventionally referred to as an elementary fibril, which generally has a diameter of approximately 2-4 nm. It is also common for elementary fibrils to aggregate, which may also be considered as microfibrils.

In a non-limiting example, the microfibrillated cellulose may at least partially comprise nanocellulose. The nanocellulose may comprise mainly nano-sized fibrils having a diameter that is less than 100 nm and a length that may be in the micron-range or lower. The smallest microfibrils are similar to the so-called elementary fibrils, the diameter of which is typically 2 to 4 nm. Of course, the dimensions and structures of microfibrils and microfibril bundles depend on the raw materials used in addition to the methods of producing the microfibrillated cellulose. Nonetheless, it is expected that a person of ordinary skill in the art would understand the meaning of "microfibrillated cellulose" in the context of the presently disclosed and/or claimed inventive concept(s).

Depending on the source of the cellulose fibers and the manufacturing process employed to microfibrillate the cellulose fibres, the length of the fibrils can vary, frequently from about 1 to greater than 10 micrometers.

A coarse MFC grade might contain a substantial fraction of fibrillated fibers, i.e. protruding fibrils from the tracheid (cellulose fiber), and with a certain amount of fibrils liberated from the tracheid (cellulose fiber).

In an embodiment, the microfibrillated cellulose may also be prepared from recycled pulp or a papermill broke and/or industrial waste, or a paper streams rich in mineral fillers and cellulosic materials from a papermill.

The fibrous substrate comprising cellulose may be added to a grinding vessel in a dry state. For example, a dry paper broke may be added directly to the grinder vessel. The aqueous environment in the grinder vessel will then facilitate the formation of a pulp.

Co-Grinding Process of Microfibrillated Cellulose and Inorganic Particulate Material In an embodiment, the present invention is related to modifications, for example, improvements, to the methods and compositions described in WO-A-2010/131016, the entire contents of which are hereby incorporated by reference.

WO-A-2010/131016 discloses a process for preparing microfibrillated cellulose comprising microfibrillating, e.g., by grinding a fibrous material comprising cellulose, optionally in the presence of grinding medium and/or inorganic particulate material. When used as a filler in paper, for example, as a replacement or partial replacement for a conventional mineral filler, the microfibrillated cellulose obtained by said process, optionally in combination with inorganic particulate material, was unexpectedly found to improve the burst strength properties of the paper. That is, relative to a paper filled with exclusively mineral filler, paper filled with the microfibrillated cellulose was found to have improved burst strength. In other words, the microfibrillated cellulose filler was found to have paper burst strength enhancing attributes. In one particularly advantageous embodiment of that invention, the fibrous material comprising cellulose was ground in the presence of a grinding medium, optionally in combination with inorganic particulate material, to obtain microfibrillated cellulose having a fibre steepness of from 20 to about 50.

In a further embodiment of the foregoing aspects and embodiments of the present disclosure, the methods of manufacturing a partially-dried sheet comprising, consisting essentially of, or consisting of, microfibrillated cellulose suitable for use as a binder, or a dried sheet comprising, consisting essentially of, or consisting of, a blend of microfibrillated cellulose and a pulp suitable for use as a pulp source, wherein said sheet may be redispersed with a high shear disperser, mixer or refiner operated at energy inputs of about 10 kWh/t to about 2,000 kWh/t, wherein the sheet upon re-dispersion in an aqueous medium maintains, or is not substantially degraded in, tensile index, compared to the dried sheet prior to drying and re-dispersion, and wherein the microfibrillated cellulose has a fibre steepness of from about 20 to about 50, may be obtained by a method comprising making a co-grinding composite of microfibrillated cellulose and inorganic particulate material.

Co-Processing of a Fibrous Substrate Comprising Cellulose and at Least One Inorganic Particulate Material As used herein, the terms "co-grinding (or "co-ground") composite or composition comprising microfibrillated cellulose and inorganic particulate material" refers to a composite or composition obtained by a "co-grinding microfibrillation process," wherein a fibrous substrate comprising cellulose is microfibrillated in an aqueous environment in a grinding apparatus in the presence of the at least one inorganic particulate material, and optionally a grinding medium other than the at least one inorganic particulate material (or stated differently by "co-processing" a fibrous substrate comprising cellulose in the presence of the at least one inorganic particulate material in a wet grinding apparatus and optionally in the presence of a grinding medium other than the at least one inorganic particulate material, which is removed after grinding, to produce microfibrillated cellulose). See the description below of an exemplary microfibrillation process and wet-grinding process.

After co-processing to form a co-processed microfibrillated cellulose and inorganic particulate material composite, additional inorganic particulate material may be added (e.g., by blending or mixing) to reduce the microfibrillated cellulose content of the co-processed microfibrillated cellulose and inorganic particulate material composite.

In an embodiment, the MFC may be manufactured using a tower mill or a screened grinding mill such as a stirred media detritor.

A stirred media mill consists of a rotating impeller that transfers kinetic energy to small grinding media beads, which grind down the charge via a combination of shear, compressive, and impact forces. A variety of grinding apparatus may be used to produce MFC by the disclosed methods herein, including, for example, a tower mill, a screened grinding mill, or a stirred media detritor.

The Microfibrillating Process

In accordance with a further aspect and embodiments of the present disclosure, there is provided a method of microfibrillating a fibrous substrate comprising cellulose in the presence of at least one inorganic particulate material. According to particular embodiments of the present methods, the microfibrillating step is conducted in the presence of one or more inorganic particulate material which acts as a microfibrillating agent. In accordance with another embodiment, the microfibrillating step is conducted in the presence of an inorganic particulate material and a grinding medium other than the at least one inorganic particulate material, which is removed after grinding.

The microfibrillated cellulose utilized in the present invention is, however, not limited to a single manufacturing method. Such microfibrillation processes are presented for illustrative purposes.

By "microfibrillating" is meant a process in which microfibrils of cellulose are liberated or partially liberated as individual species or as smaller aggregates as compared to the fibres of the pre-microfibrillated cellulose-containing pulp. Typical cellulose fibres (i.e., pre-microfibrillated cellulose-containing pulp) suitable for use in papermaking include larger aggregates of hundreds or thousands of individual cellulose microfibrils. By microfibrillating the cellulose, particular characteristics and properties, including but not limited to the characteristic and properties described herein, are imparted to the microfibrillated cellulose and the compositions including microfibrillated cellulose and at least one inorganic particulate material.

The step of microfibrillating may be carried out in any suitable apparatus. In one embodiment, the microfibrillating step is conducted in a grinding vessel under wet-grinding conditions. In another embodiment, the microfibrillating step is carried out in a homogenizer.

Wet-Grinding Microfibrillation Process

The grinding may be an attrition grinding process in the presence of a grinding medium, or may be an autogenous grinding process, i.e., one performed in the absence of a grinding medium. By grinding medium is meant a medium other than at one or more inorganic particulate material which is co-ground with a fibrous substrate comprising cellulose.

The grinding medium, when present, may be of a natural or a synthetic material. The grinding medium may, for example, comprise balls, beads or pellets of any hard mineral, ceramic or metallic material. Such materials may include, for example, alumina, zirconia, zirconium silicate, aluminum silicate or the mullite-rich material which is produced by calcining kaolinitic clay at a temperature in the range of from about 1300° C. to about 1800° C. For example, in some embodiments a Carbolite® grinding medium is used. Alternatively, particles of natural sand of a suitable particle size may be used.

Generally, the type of and particle size of grinding medium to be selected for use in the invention may be dependent on the properties, such as, e.g., the particle size of, and the chemical composition of, the feed suspension of material to be ground. Preferably, the particulate grinding medium comprises particles having an average diameter in the range of from about 0.1 mm to about 6.0 mm and, more preferably, in the range of from about 0.2 mm to about 4.0 mm. The grinding medium (or media) may be present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

The grinding may be carried out in one or more stages. For example, a coarse inorganic particulate material may be ground in the grinder vessel to a predetermined particle size distribution, after which the fibrous material comprising cellulose is added and the grinding continued until the desired level of microfibrillation has been obtained. The coarse inorganic particulate material used in accordance with an first aspect of this invention initially may have a particle size distribution in which less than about 20% by weight of the particles have an essential spherical diameter (e.s.d) of less than 2 μm, for example, less than about 15% by weight, or less than about 10% by weight of the particles have an e.s.d. of less than 2 μm. In another embodiment, the coarse inorganic particulate material used in accordance with the first aspect of this invention initially may have a particle size distribution, as measured using a Malvern Mastersizer S machine, in which less than about 20% by volume of the particles have an e.s.d of less than 2 μm, for example, less than about 15% by volume, or less than about 10% by volume of the particles have an e.s.d. of less than 2 μm.

The coarse inorganic particulate material may be wet or dry ground in the absence or presence of a grinding medium. In the case of a wet grinding stage, the coarse inorganic particulate material is preferably ground in an aqueous suspension in the presence of a grinding medium. In such a suspension, the coarse inorganic particulate material may preferably be present in an amount of from about 5% to about 85% by weight of the suspension; more preferably in an amount of from about 20% to about 80% by weight of the suspension. Most preferably, the coarse inorganic particulate material may be present in an amount of about 30% to about 75% by weight of the suspension. As described above, the coarse inorganic particulate material may be ground to a particle size distribution such that at least about 10% by weight of the particles have an e.s.d of less than 2 μm, for example, at least about 20% by weight, or at least about 30% by weight, or at least about 40% by weight, or at least about 50% by weight, or at least about 60% by weight, or at least about 70% by weight, or at least about 80% by weight, or at least about 90% by weight, or at least about 95% by weight, or about 100% by weight of the particles, have an e.s.d of less than 2 μm, after which the cellulose pulp is added and the two components are co-ground to microfibrillate the fibres of the cellulose pulp.

In another embodiment, the coarse inorganic particulate material is ground to a particle size distribution, as measured using a Malvern Mastersizer S machine such that at least about 10% by volume of the particles have an e.s.d of less than 2 μm, for example, at least about 20% by volume, or at least about 30% by volume or at least about 40% by volume, or at least about 50% by volume, or at least about 60% by volume, or at least about 70% by volume, or at least about 80% by volume, or at least about 90% by volume, or at least about 95% by volume, or about 100% by volume of the particles, have an e.s.d of less than 2 μm, after which the cellulose pulp is added and the two components are co-ground to microfibrillate the fibres of the cellulose pulp.

In one embodiment, the mean particle size ($d_{50}$) of the inorganic particulate material is reduced during the co-grinding process. For example, the $d_{50}$ of the inorganic particulate material may be reduced by at least about 10% (as measured by a Malvern Mastersizer S machine), for example, the $d_{50}$ of the inorganic particulate material may be reduced by at least about 20%, or reduced by at least about 30%, or reduced by at least about 50%, or reduced by at least about 60%, or reduced by at least about 70%, or reduced by at least about 80%, or reduced by at least about 90%. For example, an inorganic particulate material having a $d_{50}$ of 2.5 μm prior to co-grinding and a $d_{50}$ of 1.5 μm post co-grinding will have been subject to a 40% reduction in particle size. In certain embodiments, the mean particle size of the inorganic particulate material is not significantly reduced during the co-grinding process. By 'not significantly reduced' is meant that the $d_{50}$ of the inorganic particulate material is reduced by less than about 10%, for example, the $d_{50}$ of the inorganic particulate material is reduced by less than about 5%.

The fibrous substrate comprising cellulose may be microfibrillated in the presence of at least one inorganic particulate material to obtain microfibrillated cellulose having a $d_{50}$ ranging from about 5 μm to about 500 μm, as measured by laser light scattering. The fibrous substrate comprising cellulose may be microfibrillated in the presence of an inorganic particulate material to obtain microfibrillated cellulose having a $d_{50}$ of equal to or less than about 400 μm, for example equal to or less than about 300 μm, or equal to or less than about 200 μm, or equal to or less than about 150 μm, or equal to or less than about 125 μm, or equal to or less than about 100 μm, or equal to or less than about 90 μm, or equal to or less than about 80 μm, or equal to or less than about 70 μm, or equal to or less than about 60 μm, or equal to or less than about 50 μm, or equal to or less than about 40 μm, or equal to or less than about 30 μm, or equal to or less than about 20 μm, or equal to or less than about 10 μm.

The fibrous substrate comprising cellulose may be microfibrillated in the presence of an inorganic particulate material to obtain microfibrillated cellulose having a modal fibre particle size ranging from about 0.1-500 μm and a modal inorganic particulate material particle size ranging from 0.25-20 μm. The fibrous substrate comprising cellulose may be microfibrillated in the presence of an inorganic particulate material to obtain microfibrillated cellulose having a modal fibre particle size of at least about 0.5 μm, for example at least about 10 μm, or at least about 50 μm, or at least about 100 μm, or at least about 150 μm, or at least about 200 μm, or at least about 300 μm, or at least about 400 μm.

The fibrous substrate comprising cellulose may be microfibrillated in the presence of an inorganic particulate material to obtain microfibrillated cellulose having a fibre steepness equal to or greater than about 10, as measured by Malvern. Fibre steepness (i.e., the steepness of the particle size distribution of the fibres) is determined by the following formula: Steepness=$100\times(d_{30}/d_{70})$.

The microfibrillated cellulose may have a fibre steepness equal to or less than about 100. The microfibrillated cellulose may have a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

The grinding is suitably performed in a grinding vessel, such as a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In one embodiment, the grinding vessel is a tower mill. The tower mill may comprise a quiescent zone above one or more grinding zones. A quiescent zone is a region located towards the top of the interior of tower mill in which minimal or no grinding takes place and comprises microfibrillated cellulose and inorganic particulate material. The quiescent zone is a region in which particles of the grinding medium sediment down into the one or more grinding zones of the tower mill.

The tower mill may comprise a classifier above one or more grinding zones. In an embodiment, the classifier is top mounted and located adjacent to a quiescent zone. The classifier may be a hydrocyclone.

The tower mill may comprise a screen above one or more grinding zones. In an embodiment, a screen is located adjacent to a quiescent zone and/or a classifier. The screen may be sized to separate grinding media from the product aqueous suspension comprising microfibrillated cellulose and inorganic particulate material and to enhance grinding media sedimentation.

In an embodiment, the grinding is performed under plug flow conditions. Under plug flow conditions the flow through the tower is such that there is limited mixing of the grinding materials through the tower. This means that at different points along the length of the tower mill the viscosity of the aqueous environment will vary as the fineness of the microfibrillated cellulose increases. Thus, in effect, the grinding region in the tower mill can be considered to comprise one or more grinding zones which have a characteristic viscosity. A skilled person in the art will understand that there is no sharp boundary between adjacent grinding zones with respect to viscosity.

In an embodiment, water is added at the top of the mill proximate to the quiescent zone or the classifier or the screen above one or more grinding zones to reduce the viscosity of the aqueous suspension comprising microfibrillated cellulose and inorganic particulate material at those zones in the mill. By diluting the product microfibrillated cellulose and inorganic particulate material composite at this point in the mill it has been found that the prevention of grinding media carry over to the quiescent zone and/or the classifier and/or the screen is improved. Further, the limited mixing through the tower allows for processing at higher solids lower down the tower and dilute at the top with limited backflow of the dilution water back down the tower into the one or more grinding zones. Any suitable amount of water which is effective to dilute the viscosity of the product aqueous suspension comprising microfibrillated cellulose and inorganic particulate material may be added. The water may be added continuously during the grinding process, or at regular intervals, or at irregular intervals.

In another embodiment, water may be added to one or more grinding zones via one or more water injection points positioned along the length of the tower mill, or each water injection point being located at a position which corresponds to the one or more grinding zones. Advantageously, the ability to add water at various points along the tower allows for further adjustment of the grinding conditions at any or all positions along the mill.

The tower mill may comprise a vertical impeller shaft equipped with a series of impeller rotor disks throughout its length. The action of the impeller rotor disks creates a series of discrete grinding zones throughout the mill.

In another embodiment, the grinding is performed in a screened grinder, preferably a stirred media detritor. The screened grinder may comprise one or more screen(s) having a nominal aperture size of at least about 250 μm, for example, the one or more screens may have a nominal aperture size of at least about 300 μm, or at least about 350 μm, or at least about 400 μm, or at least about 450 μm, or at least about 500 μm, or at least about 550 μm, or at least about 600 μm, or at least about 650 μm, or at least about 700 μm, or at least about 750 μm, or at least about 800 μm, or at least about 850 μm, or at or least about 900 μm, or at least about 1000 μm.

The screen sizes noted immediately above are applicable to the tower mill embodiments described above.

As noted above, the grinding may be performed in the presence of a grinding medium. In an embodiment, the grinding medium is a coarse media comprising particles having an average diameter in the range of from about 1 mm to about 6 mm, for example about 2 mm, or about 3 mm, or about 4 mm, or about 5 mm.

In another embodiment, the grinding media has a specific gravity of at least about 2.5, for example, at least about 3, or at least about 3.5, or at least about 4.0, or at least about 4.5, or least about 5.0, or at least about 5.5, or at least about 6.0.

In another embodiment, the grinding media comprises particles having an average diameter in the range of from about 1 mm to about 6 mm and has a specific gravity of at least about 2.5.

As described above, the grinding medium (or media) may present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

In one embodiment, the grinding medium is present in amount of about 50% by volume of the charge.

By 'charge' is meant the composition which is the feed fed to the grinder vessel. The charge includes of water, grinding media, fibrous substrate comprising cellulose and inorganic particulate material, and any other optional additives as described herein. The use of a relatively coarse and/or dense media has the advantage of improved (i.e., faster) sediment rates and reduced media carry over through the quiescent zone and/or classifier and/or screen(s).

A further advantage in using relatively coarse grinding media is that the mean particle size ($d_{50}$) of the inorganic particulate material may not be significantly reduced during the grinding process such that the energy imparted to the grinding system is primarily expended in microfibrillating the fibrous substrate comprising cellulose.

A further advantage in using relatively coarse screens is that a relatively coarse or dense grinding media can be used in the microfibrillating step. In addition, the use of relatively coarse screens (i.e., having a nominal aperture of least about 250 um) allows a relatively high solids product to be processed and removed from the grinder, which allows a relatively high solids feed (comprising fibrous substrate comprising cellulose and inorganic particulate material) to be processed in an economically viable process. As discussed below, it has been found that a feed having a high initial solids content is desirable in terms of energy sufficiency. Further, it has also been found that product produced (at a given energy) at lower solids has a coarser particle size distribution.

Thus, in accordance with one embodiment, the fibrous substrate comprising cellulose and inorganic particulate material are present in the aqueous environment at an initial solids content of at least about 4 wt. %, of which at least about 2% by weight is fibrous substrate comprising cellulose. The initial solids content may be at least about 10 wt. %, or at least about 20 wt. %, or at least about 30 wt. %, or at least about at least 40 wt. %. At least about 5% by weight of the initial solids content may be fibrous substrate comprising cellulose, for example, at least about 10%, or at least about 15%, or at least about 20% by weight of the initial solids content may be fibrous substrate comprising cellulose.

In another embodiment, the grinding is performed in a cascade of grinding vessels, one or more of which may comprise one or more grinding zones. For example, the fibrous substrate comprising cellulose and the inorganic particulate material may be ground in a cascade of two or more grinding vessels, for example, a cascade of three or more grinding vessels, or a cascade of four or more grinding vessels, or a cascade of five or more grinding vessels, or a cascade of six or more grinding vessels, or a cascade of seven or more grinding vessels, or a cascade of eight or more grinding vessels, or a cascade of nine or more grinding vessels in series, or a cascade comprising up to ten grinding vessels. The cascade of grinding vessels may be operatively linked in series or parallel or a combination of series and parallel. The output from and/or the input to one or more of the grinding vessels in the cascade may be subjected to one or more screening steps and/or one or more classification steps.

The total energy expended in a microfibrillation process may be apportioned equally across each of the grinding vessels in the cascade. Alternatively, the energy input may vary between some or all of the grinding vessels in the cascade.

A person skilled in the art will understand that the energy expended per vessel may vary between vessels in the cascade depending on the amount of fibrous substrate being microfibrillated in each vessel, and optionally the speed of grind in each vessel, the duration of grind in each vessel, the type of grinding media in each vessel and the type and amount of inorganic particulate material. The grinding conditions may be varied in each vessel in the cascade in order to control the particle size distribution of both the microfibrillated cellulose and the inorganic particulate material. For example, the grinding media size may be varied between successive vessels in the cascade in order to reduce grinding of the inorganic particulate material and to target grinding of the fibrous substrate comprising cellulose.

In an embodiment the grinding is performed in a closed circuit. In another embodiment, the grinding is performed in an open circuit. The grinding may be performed in batch mode. The grinding may be performed in a re-circulating batch mode. In another embodiment, the grinding may be performed in a continuous mode, as described elsewhere in this specification.

As described above, the grinding circuit may include a pre-grinding step in which coarse inorganic particulate ground in a grinder vessel to a predetermined particle size distribution, after which fibrous material comprising cellulose is combined with the pre-ground inorganic particulate material and the grinding continued in the same or different grinding vessel until the desired level of microfibrillation has been obtained.

As the suspension of material to be ground may be of a relatively high viscosity, a suitable dispersing agent may preferably be added to the suspension prior to grinding. The dispersing agent may be, for example, a water soluble condensed phosphate, polysilicic acid or a salt thereof, or a polyelectrolyte, for example a water soluble salt of a poly (acrylic acid) or of a poly(methacrylic acid) having a number average molecular weight not greater than 80,000. The amount of the dispersing agent used would generally be in the range of from 0.1 to 2.0% by weight, based on the weight of the dry inorganic particulate solid material. The suspension may suitably be ground at a temperature in the range of from 4° C. to 100° C.

Other additives which may be included during the microfibrillation step include: carboxymethyl cellulose, amphoteric carboxymethyl cellulose, oxidising agents, 2,2,6,6-Tetramethylpiperidine-1-oxyl (TEMPO), TEMPO derivatives, and wood degrading enzymes.

The pH of the suspension of material to be ground may be about 7 or greater than about 7 (i.e., basic), for example, the pH of the suspension may be about 8, or about 9, or about 10, or about 11. The pH of the suspension of material to be ground may be less than about 7 (i.e., acidic), for example, the pH of the suspension may be about 6, or about 5, or about 4, or about 3. The pH of the suspension of material to be ground may be adjusted by addition of an appropriate amount of acid or base. Suitable bases included alkali metal hydroxides, such as, for example NaOH. Other suitable bases are sodium carbonate and ammonia. Suitable acids included inorganic acids, such as hydrochloric and sulphuric acid, or organic acids. An exemplary acid is orthophosphoric acid.

The amount of inorganic particulate material and cellulose pulp in the mixture to be co-ground may vary in a ratio of from about 99.5:0.5 to about 0.5:99.5, based on the dry weight of inorganic particulate material and the amount of dry fibre in the pulp, for example, a ratio of from about 99.5:0.5 to about 50:50 based on the dry weight of inorganic particulate material and the amount of dry fibre in the pulp. For example, the ratio of the amount of inorganic particulate material and dry fibre may be from about 99.5:0.5 to about 70:30. In an embodiment, the ratio of inorganic particulate material to dry fibre is about 80:20, or for example, about 85:15, or about 90:10, or about 91:9, or about 92:8, or about 93:7, or about 94:6, or about 95:5, or about 96:4, or about 97:3, or about 98:2, or about 99:1. In a preferred embodiment, the weight ratio of inorganic particulate material to dry fibre is about 95:5. In another preferred embodiment, the weight ratio of inorganic particulate material to dry fibre is about 90:10. In another preferred embodiment, the weight ratio of inorganic particulate material to dry fibre is about 85:15. In another preferred embodiment, the weight ratio of inorganic particulate material to dry fibre is about 80:20.

The total energy input in a typical grinding process to obtain the desired aqueous suspension composition may typically be between about 100 and 1500 $kWht^{-1}$ based on the total dry weight of the inorganic particulate filler. The total energy input may be less than about 1000 $kWht^{-1}$, for example, less than about 800 $kWht^{-1}$, less than about 600 $kWht^{-1}$, less than about 500 $kWht^{-1}$, less than about $kWht^{-1}$, less than about 300 $kWht^{-1}$, or less than about 200 $kWht^{-1}$. As such, the present inventors have surprisingly found that a cellulose pulp can be microfibrillated at relatively low energy input when it is co-ground in the presence of an inorganic particulate material. As will be apparent, the total energy input per tonne of dry fibre in the fibrous substrate comprising cellulose will be less than about 10,000 $kWht^{-1}$, for example, less than about 9000 $kWht^{-1}$, or less than about 8000 $kWht^{-1}$, or less than about 7000 $kWht^{-1}$, or less than about 6000 $kWht^{-1}$, or less than about 5000 $kWht^{-1}$, for example less than about 4000 $kWht^{-1}$, less than about 3000 $kWht^{-1}$, less than about 2000 $kWht^{-1}$, less than about 1500 $kWht^{-1}$, less than about 1200 $kWht^{-1}$, less than about 1000 $kWht^{-1}$, or less than about 800 $kWht^{-1}$. The total energy input varies depending on the amount of dry fibre in the fibrous substrate being microfibrillated, and optionally the speed of grind and the duration of grind.

In another embodiment, the grinding media comprises particles having an average diameter of about 3 mm and specific gravity of about 2.7.

In another embodiment, the MFC is manufactured in accordance with the method described in WO-A-2010/131016, which comprises a step of microfibrillating a fibrous substrate comprising cellulose by grinding in the presence of a particulate grinding medium which is to be removed after the completion of grinding. By "microfibrillating" is meant a process in which microfibrils of cellulose are liberated or partially liberated as individual species or as small aggregates as compared to the fibres of the pre-microfibrillated pulp. Typical cellulose fibres (i.e., pre-microfibrillated pulp) suitable for use in papermaking include larger aggregates of hundreds or thousands of individual cellulose fibrils. By microfibrillating the cellulose, particular characteristics and properties, including the characteristics and properties described herein, are imparted to the MFC and the compositions comprising the MFC.

The fibrous substrate comprising cellulose (variously referred to herein as "fibrous substrate comprising cellulose," "cellulose fibres," "fibrous cellulose feedstock," "cellulose feedstock" and "cellulose-containing fibres (or fibrous," etc.) may be derived from recycled pulp or a papermill broke and/or industrial waste, or a paper streams rich in mineral fillers and cellulosic materials from a papermill.

The cellulose pulp may be beaten (for example in a Valley beater) and/or otherwise refined (for example, processing in a conical or plate refiner) to any predetermined freeness, reported in the art as Canadian standard freeness (CSF) in $cm^3$. CSF means a value for the freeness or drainage rate of pulp measured by the rate that a suspension of pulp may be drained, and this test is carried out according to the T 227 cm-09 TAPPI standard. For example, the cellulose pulp may have a Canadian standard freeness of about 10 $cm^3$ or greater prior to being microfibrillated. The cellulose pulp may have a CSF of about 700 $cm^3$ or less, for example, equal to or less than about 650 $cm^3$, or equal to or less than about 600 $cm^3$, or equal to or less than about 550 $cm^3$, or equal to or less than about 500 $cm^3$, or equal to or less than about 450 $cm^3$, or equal to or less than about 400 $cm^3$, or equal to or less than about 350 $cm^3$, or equal to or less than about 300 $cm^3$, or equal to or less than about 250 $cm^3$, or equal to or less than about 200 $cm^3$, or equal to or less than about 150 $cm^3$, or equal to or less than about 100 $cm^3$, or equal to or less than about 50 $cm^3$. The cellulose pulp may have a CSF of about 20 to about 700. The cellulose pulp may then be dewatered by methods well known in the art, for example, the pulp may be filtered through a screen in order to obtain a wet sheet comprising at least about 10% solids, for example at least about 15% solids, or at least about 20% solids, or at least about 30% solids, or at least about 40% solids or at least 50% solids. The pulp may be utilized in an unrefined state, that is to say, without being beaten or dewatered, or otherwise refined.

In another embodiment, the microfibrillated cellulose is prepared in accordance with a method comprising a step of microfibrillating a fibrous substrate comprising cellulose in an aqueous environment by grinding in the presence of a grinding medium which is to be removed after the completion of grinding, wherein the grinding is performed in a tower mill or a screened grinder, and wherein the grinding is carried out in the absence of grindable inorganic particulate material.

A grindable inorganic particulate material is a material which would be ground in the presence of the grinding medium.

The particulate grinding medium may be of a natural or a synthetic material. The grinding medium may, for example, comprise balls, beads or pellets of any hard mineral, ceramic or metallic material. Such materials may include, for example, alumina, zirconia, zirconium silicate, aluminum silicate or the mullite-rich material which is produced by calcining kaolinitic clay at a temperature in the range of from about 1300° C. to about 1800° C. For example, in some embodiments a Carbolite® grinding media is preferred. Alternatively, particles of natural sand of a suitable particle size may be used.

Generally, the type of and particle size of grinding medium to be selected for use in the invention may be dependent on the properties, such as, e.g., the particle size of, and the chemical composition of, the feed suspension of material to be ground. Preferably, the particulate grinding medium comprises particles having an average diameter in the range of from about 0.5 mm to about 6 mm. In one embodiment, the particles have an average diameter of at least about 3 mm.

The grinding medium may comprise particles having a specific gravity of at least about 2.5. The grinding medium may comprise particles have a specific gravity of at least about 3, or least about 4, or least about 5, or at least about 6.

The grinding medium (or media) may be present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

The fibrous substrate comprising cellulose may be microfibrillated to obtain microfibrillated cellulose having a $d_{50}$ ranging from about 5 to μm about 500 μm, as measured by laser light scattering. The fibrous substrate comprising cellulose may be microfibrillated to obtain microfibrillated cellulose having a $d_{50}$ of equal to or less than about 400 μm, for example equal to or less than about 300 μm, or equal to or less than about 200 μm, or equal to or less than about 150 μm, or equal to or less than about 125 μm, or equal to or less than about 100 μm, or equal to or less than about 90 μm, or equal to or less than about 80 μm, or equal to or less than about 70 μm, or equal to or less than about 60 μm, or equal to or less than about 50 μm, or equal to or less than about 40 μm, or equal to or less than about 30 μm, or equal to or less than about 20 μm, or equal to or less than about 10 μm.

The fibrous substrate comprising cellulose may be microfibrillated to obtain microfibrillated cellulose having a modal fibre particle size ranging from about 0.1-500 μm. The fibrous substrate comprising cellulose may be microfibrillated in the presence to obtain microfibrillated cellulose having a modal fibre particle size of at least about 0.5 μm, for example at least about 10 μm, or at least about 50 μm, or at least about 100 μm, or at least about 150 μm, or at least about 200 μm, or at least about 300 μm, or at least about 400 μm.

The fibrous substrate comprising cellulose may be microfibrillated to obtain microfibrillated cellulose having a fibre steepness equal to or greater than about 10, as measured by Malvern. Fibre steepness (i.e., the steepness of the particle size distribution of the fibres) is determined by the following formula:

$$\text{Steepness}=100\times(d_{30}/d_{70})$$

The microfibrillated cellulose may have a fibre steepness equal to or less than about 100. The microfibrillated cellulose may have a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40. In an embodiment, a preferred steepness range is about 20 to about 50.

Calculation of fibre steepness of MFC fibres and inorganic particulate material is well known in the art. For example, a sample of co-ground slurry sufficient to give 5 g dry material is weighed into a beaker, diluted to 60 g with deionised water, and mixed with 5 cm3 of a solution of 1.0 wt. % sodium carbonate and 0.5 wt % sodium hexametaphosphate. Further deionised water is added with stirring to a final slurry weight of 80 g. The slurry is then added in 1 $cm^3$ aliquots to water in the sample preparation unit attached to the Mastersizer S (or Mastersizer Insitec or other comparable apparatus) until the optimum level of obscuration is displayed (normally 10-15%). The light scattering analysis procedure is then carried out. The instrument range selected was 300RF: 0.05-900, and the beam length set to 2.4 mm. For co-ground samples containing calcium carbonate and fibre the refractive index for calcium carbonate (1.596) is used. For co-ground samples of kaolin and fibre the RI for kaolin (1.5295) is used. The particle size distribution is calculated from Mie theory and gives the output as a differential volume based distribution. The presence of two distinct peaks is interpreted as arising from the mineral (finer peak) and fibre (coarser peak).

The finer mineral peak is fitted to the measured data points and subtracted mathematically from the distribution to leave the fibre peak, which is converted to a cumulative distribution. Similarly, the fibre peak is subtracted mathematically from the original distribution to leave the mineral peak, which is also converted to a cumulative distribution. Both these cumulative curves may then be used to calculate the mean particle size (d5 o) and the steepness of the distribution ($d30/d_{70}\times100$). The differential curve may be used to find the modal particle size for both the mineral and fibre fractions In one embodiment, the grinding vessel is a tower mill. The tower mill may comprise a quiescent zone above one or more grinding zones. A quiescent zone is a region located towards the top of the interior of a tower mill in which minimal or no grinding takes place and comprises microfibrillated cellulose and inorganic particulate material. The quiescent zone is a region in which particles of the grinding medium sediment down into the one or more grinding zones of the tower mill.

The tower mill may comprise a classifier above one or more grinding zones. In an embodiment, the classifier is top mounted and located adjacent to a quiescent zone. The classifier may be a hydrocyclone.

The tower mill may comprise a screen above one or more grind zones. In an embodiment, a screen is located adjacent to a quiescent zone and/or a classifier. The screen may be sized to separate grinding media from the product aqueous suspension comprising microfibrillated cellulose and to enhance grinding media sedimentation.

In an embodiment, the grinding is performed under plug flow conditions. Under plug flow conditions the flow through the tower is such that there is limited mixing of the grinding materials through the tower. This means that at different points along the length of the tower mill the viscosity of the aqueous environment will vary as the fineness of the microfibrillated cellulose increases. Thus, in effect, the grinding region in the tower mill can be considered to comprise one or more grinding zones which have a characteristic viscosity. A skilled person in the art will understand that there is no sharp boundary between adjacent grinding zones with respect to viscosity.

In an embodiment, water is added at the top of the mill proximate to the quiescent zone or the classifier or the screen above one or more grinding zones to reduce the viscosity of the aqueous suspension comprising microfibrillated cellulose at those zones in the mill. By diluting the product microfibrillated cellulose at this point in the mill it has been found that the prevention of grinding media carry over to the quiescent zone and/or the classifier and/or the screen is improved. Further, the limited mixing through the tower allows for processing at higher solids lower down the tower and dilute at the top with limited backflow of the dilution water back down the tower into the one or more grinding zones. Any suitable amount of water which is effective to dilute the viscosity of the product aqueous suspension comprising microfibrillated cellulose may be added. The water may be added continuously during the grinding process, or at regular intervals, or at irregular intervals.

In another embodiment, water may be added to one or more grinding zones via one or more water injection points positioned along the length of the tower mill, the or each water injection point being located at a position which corresponds to the one or more grinding zones. Advantageously, the ability to add water at various points along the tower allows for further adjustment of the grinding conditions at any or all positions along the mill.

The tower mill may comprise a vertical impeller shaft equipped with a series of impeller rotor disks throughout its length. The action of the impeller rotor disks creates a series of discrete grinding zones throughout the mill.

In another embodiment, the grinding is performed in a screened grinder, preferably a stirred media detritor. The screened grinder may comprise one or more screen(s) having a nominal aperture size of at least about 250 μm, for example, the one or more screens may have a nominal aperture size of at least about 300 μm, or at least about 350 μm, or at least about 400 μm, or at least about 450 μm, or at least about 500 μm, or at least about 550 μm, or at least about 600 μm, or at least about 650 μm, or at least about 700 μm, or at least about 750 μm, or at least about 800 μm, or at least about 850 μm, or at or least about 900 μm, or at least about 1000 μm, or at least about 1,250 μm, or at least about 1,500 μm.

The screen sizes noted immediately above are applicable to the tower mill embodiments described above.

As noted above, the grinding is performed in the presence of a grinding medium. In an embodiment, the grinding medium is a coarse media comprising particles having an average diameter in the range of from about 1 mm to about 6 mm, for example about 2 mm, or about 3 mm, or about 4 mm, or about 5 mm.

In another embodiment, the grinding media has a specific gravity of at least about 2.5, for example, at least about 3, or at least about 3.5, or at least about 4.0, or at least about 4.5, or least about 5.0, or at least about 5.5, or at least about 6.0.

As described above, the grinding medium (or media) may be in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

In one embodiment, the grinding medium is present in amount of about 50% by volume of the charge.

By 'charge' is meant the composition which is the feed fed to the grinder vessel. The charge includes water, grinding media, the fibrous substrate comprising cellulose and any other optional additives (other than as described herein).

The use of a relatively coarse and/or dense media has the advantage of improved (i.e., faster) sediment rates and reduced media carry over through the quiescent zone and/or classifier and/or screen(s).

A further advantage in using relatively coarse screens is that a relatively coarse or dense grinding media can be used in the microfibrillating step. In addition, the use of relatively coarse screens (i.e., having a nominal aperture of least about 250 urn) allows a relatively high solids product to be processed and removed from the grinder, which allows a relatively high solids feed (comprising fibrous substrate comprising cellulose and inorganic particulate material) to be processed in an economically viable process. As discussed below, it has been found that a feed having a high initial solids content is desirable in terms of energy sufficiency. Further, it has also been found that product produced (at a given energy) at lower solids has a coarser particle size distribution.

In accordance with one embodiment, the fibrous substrate comprising cellulose is present in the aqueous environment at an initial solids content of at least about 1 wt. %. The fibrous substrate comprising cellulose may be present in the aqueous environment at an initial solids content of at least about 2 wt. %, for example at least about 3 wt. %, or at least about at least 4 wt. %. Typically the initial solids content will be no more than about 10 wt. %.

In another embodiment, the grinding is performed in a cascade of grinding vessels, one or more of which may comprise one or more grinding zones. For example, the fibrous substrate comprising cellulose may be ground in a cascade of two or more grinding vessels, for example, a cascade of three or more grinding vessels, or a cascade of four or more grinding vessels, or a cascade of five or more grinding vessels, or a cascade of six or more grinding vessels, or a cascade of seven or more grinding vessels, or a cascade of eight or more grinding vessels, or a cascade of nine or more grinding vessels in series, or a cascade comprising up to ten grinding vessels. The cascade of grinding vessels may be operatively inked in series or parallel or a combination of series and parallel. The output from and/or the input to one or more of the grinding vessels in the cascade may be subjected to one or more screening steps and/or one or more classification steps.

The total energy expended in a microfibrillation process may be apportioned equally across each of the grinding vessels in the cascade. Alternatively, the energy input may vary between some or all of the grinding vessels in the cascade.

A person skilled in the art will understand that the energy expended per vessel may vary between vessels in the cascade depending on the amount of fibrous substrate being microfibrillated in each vessel, and optionally the speed of grind in each vessel, the duration of grind in each vessel and the type of grinding media in each vessel. The grinding conditions may be varied in each vessel in the cascade in order to control the particle size distribution of the microfibrillated cellulose.

In an embodiment the grinding is performed in a closed circuit. In another embodiment, the grinding is performed in an open circuit.

As the suspension of material to be ground may be of a relatively high viscosity, a suitable dispersing agent may preferably be added to the suspension prior to grinding. The dispersing agent may be, for example, a water soluble condensed phosphate, polysilicic acid or a salt thereof, or a polyelectrolyte, for example a water soluble salt of a poly (acrylic acid) or of a poly(methacrylic acid) having a number average molecular weight not greater than 80,000. The amount of the dispersing agent used would generally be in the range of from 0.1 to 2.0% by weight, based on the weight of the dry inorganic particulate solid material. The suspension may suitably be ground at a temperature in the range of from 4° C. to 100° C.

Other additives which may be included during the microfibrillation step include: carboxymethylcellulose, amphoteric carboxymethylcellulose, oxidising agents, 2,2,6,6-Tetramethylpiperidine-1-oxyl (TEMPO), TEMPO derivatives, and wood degrading enzymes.

The pH of the suspension of material to be ground may be about 7 or greater than about 7 (i.e., basic), for example, the pH of the suspension may be about 8, or about 9, or about 10, or about 11. The pH of the suspension of material to be ground may be less than about 7 (i.e., acidic), for example, the pH of the suspension may be about 6, or about 5, or about 4, or about 3. The pH of the suspension of material to be ground may be adjusted by addition of an appropriate amount of acid or base. Suitable bases included alkali metal hydroxides, such as, for example NaOH. Other suitable bases are sodium carbonate and ammonia. Suitable acids included inorganic acids, such as hydrochloric and sulphuric acid, or organic acids. An exemplary acid is orthophosphoric acid.

The total energy input in a typical grinding process to obtain the desired aqueous suspension composition may typically be between about 100 and 1500 $kWht^{1}$ based on the total dry weight of the inorganic particulate filler. The total energy input may be less than about 1000 $kWht^{-1}$, for example, less than about 800 $kWht^{-1}$, less than about 600 $kWht^{-1}$, less than about 500 $kWht^{-1}$, less than about 400 $kWht^{-1}$, less than about 300 $kWht^{-1}$, or less than about 200 $kWht^{-1}$. As such, the present inventors have surprisingly found that a cellulose pulp can be microfibrillated at relatively low energy input when it is co-ground in the presence of an inorganic particulate material. As will be apparent, the total energy input per tonne of dry fibre in the fibrous substrate comprising cellulose will be less than about 10,000 $kWht^{-1}$, for example, less than about 9000 $kWht^{-1}$, or less than about 8000 $kWht^{-1}$, or less than about 7000 $kWht^{-1}$, or less than about 6000 $kWht^{-1}$, or less than about 5000 $kWht^{-1}$ for example less than about 4000 $kWht^{-1}$, less than about 3000 $kWht^{-1}$, less than about 2,000 $kWht^{-1}$, less than about 1500 $kWht^{-1}$, less than about 1200 $kWht^{-1}$, less than about 1000 $kWht^{-1}$, or less than about 800 $kWht^{-1}$. The total energy input varies depending on the amount of dry fibre in the fibrous substrate being microfibrillated, and optionally the speed of grind and the duration of grind.

The preparation method for MFC in sheets is set forth in the description of the Examples that follow, which is incorporated into the description of the general inventive processes and articles manufactured in accordance with such processes.

Various aspects of the invention are described in further detail in the following subsections. The use of subsections is not meant to limit the invention. Each subsection may apply to any aspect of the invention. In this application, the use of "or" means "and/or" unless stated otherwise.

MFC may be produced in a continuous or batch mode. MFC is an aqueous suspension mixture of microfibrillated cellulose and inorganic particulate material. In an embodiment, MFC is prepared by co-grinding a low solids aqueous suspension of cellulose wood pulp in the presence of inorganic particulate material particles in a wet vertically stirred media mill. The mineral particles act as grinding aids and facilitate the cost-effective fibrillation of pulp fibers to microfibrils in a process analogous to pulp refining.

The inorganic particulate material used is a standard paper filler, often calcium carbonate or kaolin. Most processes will use kaolin, ground calcium carbonate or precipitated calcium carbonate. The inorganic particulate material will be in aqueous slurry form.

The cellulose used is typically unrefined Kraft or sulphite pulp from a paper mill's pulp source (>99% cellulose) or recycled pulp from paper and board recycling activities. The pulp is received from the paper mill as an aqueous slurry usually at approximately 4-5 wt. % solids. The water used will be from the mill's process streams or in some cases council (city) water. The ceramic grinding media are typically 3 mm diameter beads made from calcined kaolin. In some cases when recycled pulp is used, the pulp will already contain some inorganic particulate material.

In an illustrative recipe: Kraft pulp at approximately 4% solids and hydrous kaolin at approximately 66% solids or calcium carbonate slurry at approximately 75% solids and water are added to the grinder continuously. The grinder is loaded with 3 mm diameter mullite grinding media such that approximately 50% of the total charge volume is occupied by the media (total charge volume=volume occupied by mullite+pulp+kaolin+water). The throughput is controlled such that the pulp and mineral mixture is co-ground for an optimised period. Typically, this optimum period corresponds to the development of maximum viscosity and tensile properties. Typically, between approximately 1500-5000 kWhr/dry tonne of MFC is applied. The temperature in the grinder reaches about 65 degrees centigrade during the grind. The MFC product is in aqueous slurry form.

In some cases, rather than running continuously, the same process is operated batchwise. In this case, the ingredients are added at the start of a batch, then the grinders are run for an allocated time such that 1500-5000 kWhr/dry tonne of MFC is applied and then at the end of the batch further water is added and the product is discharged before the process being repeated.

In some cases, where inorganic particulate material cannot be tolerated in an end use application, the above processes are conducted without any added inorganic particulate material.

The above MFC product which results from the grinding and screening process contains agglomerates which reduce performance and can cause blockages if subjected to very fine screening. These agglomerates may be reduced by the use of a homogeniser.

In some cases some of the water associated with the MFC product is removed to lower transportation costs. This is achieved by use of dewatering via a belt press and/or drying using a hot air dryer or by other means known in the art. When dewatered and dried products are prepared, a biocide is sometimes added to increase shelf life and protect the product from decomposition. The biocide is mixed into the MFC, for example, using a plough shear mixer. The dewatered and partially dried products are usually shipped in bulk bags.

The biocides used are DBNPA (2,2-dibromo-3-nitrilopropionamide), and CMIT/MIT (5-chloro-2-methyl2H-isothiazol3-one/2-methyl2H isothiazol-3-one (CMIT/MIT) or for the partially dried product and OIT (2-octyl-2H-isothiazol3-one).

The continuous production process is a pass-through process with cellulose, inorganic particulate material and water being sourced from the mill and returned to the mill after processing.

Parameters that may be used to control production are product $d_{50}$, as measured by laser light scattering and either viscosity or tensile properties, for example, the FLT tensile index described elsewhere in this specification.

Selection of Pulps with High FLT Tensile Index

Hemicellulose is an amorphous polysaccharide that forms a layer on microfibril surfaces, separating neighboring microfibrils. This is expected to provide a preferred plane of breakage along the microfibril direction. It has been found in the literature that this aids microfibrillation and results in the liberation of finer microfibrils. Hemicellulose content and cell morphology play an important role in the effectiveness of nanofibrillation of cellulose pulps. Chaker, A., 2013. The inventors have discovered that the hemicellulose content of numerous cellulose fibre species positively correlates with the tensile index of the microfibrillated cellulose produced from such fibrous substrates comprising cellulose.

Specifically, the zero-span tensile index of cellulose feed fibres has been found to correlate with the length-weighted mean fibre length of MFC (defined as the largest dimension of the MFC particle as measured by a Valmet FS5 Fibre Image Analyser) produced from such cellulose fibre feeds. Zero-span tensile index is a measurement of the resistance of individual fibres to breaking across the cross-sections of the fibres. This measurement can therefore be considered an indication of the frequency of flaws in the cellulose fibre structure. By using the mathematical product of the hemicellulose content and the fibre zero-span tensile index, a reasonably good prediction of the peak MFC tensile index can be made without requiring the actual production of the MFC from such fibrous substrates comprising cellulose. The mathematical relationship of hemicellulose content and zero-span tensile index of the fibrous substrate comprising cellulose can be used to identify preferred cellulose fibre sources and to select cellulose-containing fibres and pulps that are expected to produce MFC with desirable tensile strength properties.

High hemicellulose content cellulose fibres with few flaws in their fibril structures (inferred by the fibre zero-span tensile strength) have been found to lead to strong MFC fibrils. Moreover, these properties have been shown to yield optimum processing conditions during production. By identifying geometric properties of the MFC measured using a fibre image analyser, it was found that the MFC fibre length greatly improves the correlation with tensile index, when multiplied by the hemicellulose content. This relation can be rationalized to fit the Page Equation, which is a theoretical model for the prediction of paper tensile index. Page, D., 1969, "A theory for the tensile strength of paper," Tappi Journal, 52(4): 674-681.

The Page Equation is stated below as $$1/T=9/8Z+12A\rho/(\tau_B\ PL(\mathrm{RBA})) \qquad \text{Equation [1]:}$$

where T is the sheet tensile index (Nm/g), Z is the zero-span tensile index (Nm/g), A is the fibre cross-sectional area ($m^2$), P is the fibre cross-section perimeter (m), ρ is the fibre density (kg/m3), L is the fibre length (m), $\tau_B$ is the shear bond strength per unit area (Pa), and RBA is the relative bonded area.

Zero-span tensile index is a measure of individual fibre strength. RBA is a measure of the fraction of the fibre surface area that is used for inter-fibre bonding. The first term on the right-hand side of Equation [1] represents the weakness of the individual fibres, whereas the second term represents the weakness of the bonds between fibres. Usually, a sheet of paper fails due to bonds breaking rather than the fibres breaking, so the second term is limiting. Adding MFC to a fibre furnish greatly increases relative bonded area and so tensile index tends to improve considerably. Lindstrom T., Fellers, C., Ankerfors, M., Nordmark, G. G., 2016, "On the nature of joint strength of paper—effect of dry strength agents—Revisiting the Page equation, *Nordic Pulp & Paper Research Journal,* 31(3): 459-4680.

The Page Equation was applied and modified, with some of the parameters in the bonding term being substituted with hemicellulose content and MFC length. It was found that the addition of a constant $\sigma_0$ to represent the residual strength in the absence of hemicellulose was required for the model to fit the data. This constant will differ depending on grinding conditions, e.g. energy input, grinding solids, and energy intensity/impeller speed. In the examples shown the constant was 4.1 Nm/g.

Using MFC length as L in the Page Equation [1] and hemicellulose content as RBA in the Page Equation, it was possible to plot predicted tensile index versus measured tensile index of MFC prepared from a multiplicity of cellulose feedstocks. FIG. 11 shows good correlation of the predicted versus measured tensile indices for a wide variety of cellulose fibres. These were Nordic Pine, Black Spruce, Radiata Pine, Southern Pine, Enzyme-Treated Nordic Pine, Douglas Fir, Dissolving Pulp, Birch #1, Birch #2, Eucalyptus, Acacia, Mixed European Hardwood, Mixed Thai Hardwood, Tissue Dust, Cotton Linters, Jeans, Abaca, Sisal, Bagasse, Kenaf, Miscanthus, Sorghum, Giant Reed and Flax.

An empirical equation was devised to predict tensile index by combining hemicellulose contents and measured MFC fibre lengths. Thus, the Page Equation was modified by:

$$T=1.3(H\times L)+4.1$$

T=tensile index (Nm/g)

H=hemicellulose content (mass fraction)

L="length" of MFC particles at optimum energy input (mm)

Combining the effect of hemicellulose and MFC fibre length improved the fit greatly.

Furthermore, zero-span tensile index of the fibres, which is a measurement of the quality of the fibre cross-sectional area and inversely related to the number of flaws present, correlates with the length of MFC fibrils produced from a given cellulose feed stock.

Zero-span tensile index of the initial fibres was used as a proxy for the MFC length, since it appears that the frequency of flaws in the fibril structures that is represented by the zero-span tensile index, results in shorter fibre lengths when MFC is produced. This proxy results in a weaker fit, but still a substantial improvement over hemicellulose content alone in terms of predictive value with regard to the resultant tensile index of the MFC produced from a given cellulose feed stock.

The inventors herein have, thus, shown that measurements of the hemicellulose content and zero-span tensile index of pulp fibres can be used to accurately predict the resultant MFC tensile index produced in accordance with the processes described herein. Accordingly, the present disclosure provides a facile method to aid in the selection of cellulose fibre sources for use as a feedstock for the production of microfibrillated cellulose.

Using fibre zero-span strength as a proxy for MFC fibre length results in the following relation:

$$T=0.0021(H\times Z)+4.2$$

T=tensile index (Nm/g)

H=hemicellulose content (mass fraction)

Z=zero-span tensile index (Nm/g)

The foregoing allows a reasonable prediction of MFC tensile index to be made based on intrinsic fibre properties that does not require a sample of MFC to be actually produced first.

Using the hemicellulose content and the zero-span tensile index of the fibres, a parameter could be produced that correlates with the MFC tensile index, and therefore MFC quality can be predicted from measurements of the feed properties.

Most raw plant materials from which cellulose fibres are extracted also contain high concentrations of hemicellulose. Though pulping and bleaching removes much of the hemicellulose, there is still typically a residual fraction within the fibre cell wall, with the amount dependent on fibre species and pulping conditions.

Hemicellulose is a broad term for a wide variety of polysaccharides with differing monomer sugars, functional groups, and degrees of branching. For woods and many non-woods, there are two important families; xylans and glucomannans. Xylans are found in the vast majority of plants, and account for almost all the hemicellulose in hardwoods, whereas glucomannans are found in large quantities in softwoods (in comparable amounts to xylans). Ebringerová, A., 2006, "Structural Diversity and Application Potential of Hemicelluloses," Macromol. Symp. 232: 1-12.

Compared to cellulose, hemicellulose is always amorphous, whereas cellulose is partly crystalline, and hemicellulose molecules have relatively short chain lengths of 70-200 units compared to 300-1700 units typical for cellulose. Fengel, D., Wegener, G., 1983, "Wood—chemistry, ultrastructure, reactions, *De Gruyter*; Klemm, D., Heublein, B., Fink, H. P., Bohn, A., 2005, "Cellulose: Fascinating Biopolymer and Sustainable Raw Material" *Angew. Chem. Int. Ed.,* 44:3358-3393. Within a fibre cell wall, hemicellulose closely associates with the cellulose microfibril surface, forming a layer separating neighbouring microfibrils. NMR spectroscopy indicates that both xylan and glucomannan do this, and are comparable in function. Liitiä, T., Maunu, S. L., Hortling, B., Tamminen, T., Pekkala, O., Varhimo, A., 2003, "Cellulose crystallinity and ordering of hemicelluloses in pine and birch pulps as revealed by solid-state NMR spectroscopic methods," *Cellulose,* 10:307-316. Hemicellulose has a branched, amorphous structure, and readily swells in water, as shown by work investigating the change in zeta potential during this process Uetani, K., Yano, H., 2012, "Zeta Potential Time Dependence Reveals the Swelling Dynamics of Wood Cellulose Nanofibrils," *Langmuir,* 28: 818-827. This hydrophilicity also aids in the plasticity of the fibre to deformation, which would be expected to make disintegration into MFC easier. Bolam, F. M., 1965, "Stuff Preparation for Paper and Paperboard Making: Monographs on paperboard and papermaking," Pergamon.

NMR studies by several authors using fibres that have undergone different pulping conditions has shown that reducing the hemicellulose content appears to increase the fibril aggregate dimension size appreciably. Hult, E. L., Larsson, P. T., Iversen T., 2001, "Cellulose fibril aggregation—an inherent property of kraft pulps," *Polymer,* 42: 3309-3314; Virtanen, T., Maunu, S. L., Tamminen, T., Hortling, B., Liitiä, T., 2008, "Changes in fiber ultrastructure during various kraft pulping conditions evaluated by 13C CPMAS NMR spectroscopy," *Carbohydrate Polymers,* 73:156-163; and Duchesne, I., Hult, E. L., Molin, U., Daniel, G., Iversen, T., Lennholm, H., 2001, "The influence of hemicellulose on fibril aggregation of kraft pulp fibres as revealed by FE-SEM and CP/MAS 13C-NMR," *Cellulose,* 8:103-111. This supports the findings that hemicellulose inhibits the spontaneous coalescence of neighbouring microfibrils.

It is understood in the prior art that hemicellulose content impacts papermaking. If hemicellulose is removed prior to refining, tensile strength of the fibres may be reduced. Bolam, F. M., 1965. Adsorbing hemicellulose onto fibres prior to refining has been found to improve sheet tensile strength, primarily by reducing the 'kink' deformations induced in the fibres. Mäkelä, P., Bergnor, E., Wallbäcks, L., Öhman, F., 2010, "Sorption of birch xylan to softwood kraft pulps and its influence on the tensile properties of previously-dried papers under different papermaking conditions," *Innventia* Report No. 121 2nd Version.

We postulated that higher hemicellulose content would lead to high quality MFC. It has been shown in the literature that drying a pulp after removing hemicellulose by alkali treating results in irreversible microfibril aggregation, inhibiting fibrillation compared to an untreated pulp. Iwamoto, S., Abe, K., Yano, H., 2008, "The Effect of Hemicelluloses on Wood Pulp Nanofibrillation and Nanofiber Network Characteristics," *Biomacromolecules,* 9:1022-1026.

Numerous authors have found that hemicellulose content coincides with a high microfibril yield and better individualisation. This appears true whether comparing fibres from different plant species or from the same plant species but with different pulping conditions. Alila, et al., 2013; Desmaisons, J. et al., 2017; and Chaker, A. et al., 2013; Rahman, S., Petroudy, D., Ghasemian, A., Resalati, H., Syverud, K., Chinga-Carrasco, G., 2015, "The effect of xylan on the fibrillation efficiency of DED bleached soda bagasse pulp and on nanopaper characteristics," *Cellulose,* 22: 385-395; and Spence, K. L., Venditti, R. A., Habibi, Y., Rojas, O. J., Pawlak, J. J., 2010, "The effect of chemical composition on microfibrillar cellulose films from wood pulps: Mechanical processing and physical properties," *Bioresource Technology,* 101: 5961-5968.

Two important mechanisms are thought to explain this. First, is that the presence of surface hemicellulose itself improves inter-fibre bonding (or inter-fibril bonding in the case of MFC), since amorphous hemicellulose chains extend out from the microfibrils when immersed in water, and form bridges between neighbouring microfibrils when dried. Bolam, F. M., 1965. Disintegrating a high hemicellulose pulp into MFC liberates surface area coated in more hemicellulose, enhancing this strengthening effect compared to a low hemicellulose pulp. When hemicellulose is removed from nanocellulose with xylanase enzymes, this results in poorer tensile properties, even with similar nanocellulose geometry, clearly demonstrating this effect. Arola, S., et al., 2013.

Second, in addition to the foregoing effect, a high hemicellulose pulp produces finer microfibrils with better individualisation, as microscopy images in various studies have demonstrated. Alila et al. (2013); Iwamoto et al. (2008); and Chaker et al. (2013). Given similar microfibril lengths, this increases particle aspect ratio, improving tensile strength. Hemicellulose forms an amorphous layer between microfibrils that readily swells in water, and so this would be expected to provide a preferred plane of breakage parallel to the microfibril lengths, thereby facilitating the production of finer microfibrils. Additionally, xylan develops a surface charge due to carboxyl group dissociation under typical processing conditions, causing mutual microfibril repulsion, enhancing this effect to some degree. Due to its expected influence on MFC geometry and bonding, the hemicellulose content was investigated for all fibre species, as set forth herein.

Zero-Span Tensile Index

We have demonstrated in this specification that fibre lengths of MFC correlate with a high MFC tensile index. Thus, it is desirable to be able to predict the resultant MFC fibre length from intrinsic fibre properties. All other things being equal, long fibrils within the fibre structure will lead to long liberated fibrils. Also, fibrils with few defects reduce the degree of fibril length degradation during processing. Intrinsically long fibrils means fewer discontinuities at fibril endpoints. Undamaged fibrils means fewer microscopic weak points in the fibre. Both of these properties can be seen to influence the "quality" of the fibre cross-sectional area, i.e. having long, undamaged fibrils results in the cross-sectional area having few flaws.

We postulated that a measurement that could assess the specific strength of the fibre cross-sectional area could therefore be useful for indicating the frequency of fibril flaws and intrinsic fibril length; and is therefore expected to correlate with long fibril lengths of the MFC product. The zero-span tensile index of the fibre sheet prior to MFC production has been found to be such a measurement.

In the zero-span tensile test, the two clamps of the tester are essentially touching (within microns of each other), forcing the vast majority of the fibres between the clamps to be held by both clamps at once, since the separation distance between clamps is a small fraction of typical fibre lengths. When the sample is broken under tensile stress, these clamped fibres will fail, rather than the bonds between fibres as with conventional tensile testing. Since the zero-span tensile test is normalised by weight, the thickness of the fibre cell wall and fibre diameter are accounted for.

The use of zero-span tensile index as a measurement of fibre damage is supported in the prior art. Zeng, X., Retulainen, E., Heinemann, S., Fu, S., 2012, "Fibre deformations induced by different mechanical treatments and their effect on zero-span strength," *Nordic Pulp and Paper Research Journal,* 27(2): 335-342. Zero-span tensile index has been shown to be inversely proportional to the frequency of fibre kinks induced (i.e. sharp bends in the fibre) by homogenization, which decreased fibre length probably due to non-uniform load distributions across the cross-section. Joutsimo, O., Wathén, R., Tamminenm T., 2005, "Effects of fiber deformations on pulp sheet properties and fiber strength," *Paperi Ja Puu/Paper and Timber,* 87(6).

Further studies have shown that fibril and microfibril-scale damage is also important. Fibres treated with acid caused localised damage to microfibrils that substantially reduced zero-span tensile index. Further, zero-span strength decreased in damaged fibrils homogeneously throughout the fibre due to thermal ageing degradation. Nevell, T. P., Nugawela, D., 1987, "Effect of Treatment with Very Dilute Acids on the Wet Tensile Strength and Chemical Properties of Paper," *Carbohydrate Polymers,* 7:169-181; and Wathén, R., 2006, "Studies on fiber strength and its effect on paper properties," PhD Thesis, King's College London. ISSN 1457-6252.

In an embodiment, the MFC tensile index is calculated using the equation $T=B_2ZH+\sigma_0$, wherein Z represents the zero-span tensile index of the fibre in Nm/g, H represents the hemicellulose content as a mass fraction, B2 is a proportionality coefficient, and $\sigma_0$ a value of 4.1 Nm/g.

In another embodiment, the fibrous substrate comprising cellulose is selected from the group consisting of Nordic Pine, Black Spruce, Radiata Pine, Southern Pine, Enzyme-Treated Nordic Pine, Douglas Fir, Dissolving Pulp, Birch #1, Birch #2, Eucalyptus, Acacia, Mixed European Hardwood, Mixed Thai Hardwood, Tissue Dust, Cotton, Jeans, Abaca, Sisal, Bagasse, Kenaf, Miscanthus, Sorghum, Giant Reed and Flax.

In yet another embodiment, the product of hemicellulose mass fraction and fibre zero-span tensile index is about 15 to about 25 Nm/g, or is greater than 5 Nm/g, or is greater than 10 Nm/g, or is greater than 15 Nm/g, or is greater than 20 Nm/g, or is greater than 25 Nm/g, or is greater than 30 Nm/g, or is greater than 35 Nm/g, or is greater than 40 Nm/g, or is greater than 45 Nm/g, or is greater than 50 Nm/g.

In yet another embodiment, the product of hemicellulose mass fraction and fibre zero-span tensile index is about 20 Nm/g.

In another embodiment, the hemicellulose mass fraction of the fibrous substrate comprising cellulose is greater than 10%, or about 10% to about 25%, or about 10% to about 20% or greater than about 25%, or greater than about 30% or greater than about 35%, or greater than about 45% or greater than about 50%.

In another embodiment, the MFC fibre length are about 0.1 to 0.8 mm, or 0.1 to 0.25 mm, or 0.1 to 0.3 mm, or 0.1 to 0.4 mm, or 0.1 to 0.5 mm, or 0.1 to 0.6 mm, or 0.1 to 0.7 mm, or preferably, for example, 0.15 to 0.3 mm when produced in a stirred media mill at 300 kWh/t, 2.5% fibre solids and 47.5% MVC. In another embodiment, the MFC fibre length is greater than 0.25 mm.

Commercial Manufacturing Process

Pulp stocks with a solids content of from 0.5 wt. % to 30 wt. % are prepared by conventional pulping processes including any one or more of Mechanical pulping, Thermo-mechanical pulping, Chemi-thermomechanical pulping, Chemical pulping (Kraft, Soda or Sulfite), Bleaching, Recycled pulping (optionally combining cleaning and de-inking steps), steam exploded fibre pulping or biological (enzymatic) pulping. In an embodiment, the pulp stocks are prepared with water. In other embodiments the pulp stock may be prepare in a non-aqueous solvent to facilitate drying and dewatering, for example, by evaporation. Examples of orgaosolv pulping processes include the use of organic solvents such as methanol, ethanol, acetic acid to remove lignin. it is preferred that the pulping process be conducted in an aqueous environment to reduce environmental impact and to improve economics of the pulping process.

The partially-dried sheet or a dried sheet comprising microfibrillated cellulose suitable for use as a binder is manufactured by preparing a pulp slurry in a range of about 0.5 wt. % to about 30 wt. % total solids; preparing a slurry of microfibrillated cellulose; mixing the pulp slurry and the slurry of microfibrillated cellulose, wherein the content of microfibrillated cellulose in the pulp slurry may be about 0.5 wt. % to about 99.5 wt. % of the total dry mass; forming a sheet comprising microfibrillated cellulose and pulp; and dewatering and drying the sheet to a desired moisture content; wherein the moisture content of the partially-dried sheet is in the range of about 20% by weight to about 85% by weight moisture; or wherein the moisture content of the dried sheet is about 20% by weight or less; and wherein, when the partially-dried sheet or the dried sheet is re-dispersed in an aqueous medium with a disperser, mixer, or refiner operated at energy inputs of about 10 kWh/t to about 2,000 kWh/t, the partially-dried sheet or dried sheet upon re-dispersion in an aqueous medium maintains, or is not substantially degraded in, mechanical properties of the MFC compared to a sheet comprising a comparable amount of microfibrillated cellulose prior to drying and re-dispersion.

EXAMPLES

Example 1. Preparation of Microfibrillated Cellulose from NBSK Pulp

Microfibrillated cellulose was prepared from NBSK (sourced from Södra Blue).

Approximately 5 liters of NBSK slurry was prepared for the handsheet trial. The MFC produced from NBSK has a total solids content of 1.1 wt. % and a MFC content of 99.5 dry wt. %.

The samples were produced using a laboratory scale stirred media detritor ("SMD") grinder. The production process included grinding mineral-free NBSK pulp. The grinding parameters chosen were established through running a series of calibration grinds for the sample, with the main variable being the specific energy input (kWh/t). The fixed conditions for all NBSK samples were: 3 mm Zirconia media, 47.5% media volume concentration (MVC), 800 rpm target impeller speed, 1.5% target grind solids and 100% target grind dry wt. % MFC. The samples were screened using a 1700 μm laboratory vibratory screen to remove the grinding media.

A summary of the production conditions and laboratory testing results for the calibration grinds and final product is shown in Table 1 and FIG. 1.

TABLE 1

Summary of production conditions and testing results for the calibration grinds

| Sample and/ or Conditions | Specific energy input kWh/t | Total Solids % | POP % | Malvern Insitec D30 μm | D50 μm | D70 μm | D90 μm | STEEP-NESS | <25 μm % | 25-150 μm % | 150-300 μm % | >300 μm % | Vane Viscosity mPas | FLT index N · m/g |
|---|---|---|---|---|---|---|---|---|---|---|---|---|---|---|
| X27 24.6.19 (Control) | | | | | | | | | | | | | | 9.1 |
| Calibration curve | 2500 | 0.9 | 99.7 | 152 | 315 | 640 | 1216 | 24 | 4.3 | 25.4 | 18.8 | 51.5 | Too Dilute | 7.7 |
| Lab Grind- | 3000 | 1.0 | 99.2 | 136 | 277 | 519 | 1039 | 26 | 5.2 | 27.3 | 19.9 | 47.6 | 3960 | 9.7 |
| Min-free | 3500 | 0.8 | 98.4 | 127 | 249 | 445 | 853 | 28 | 5.5 | 29.0 | 21.7 | 43.8 | Too Dilute | 10.9 |
| Sodra Blue @ 1.5 | 4000 | 1.0 | 99.0 | 103 | 203 | 360 | 710 | 29 | 7.0 | 33.3 | 23.1 | 36.5 | 3600 | 10.2 |
| Fibre Solids | 4500 | 1.1 | 99.1 | 96 | 187 | 330 | 625 | 29 | 7.7 | 35.1 | 23.8 | 33.5 | 3580 | 10.6 |
| | 5000 | 1.2 | 99.8 | 100 | 198 | 360 | 718 | 28 | 7.5 | 33.7 | 22.6 | 36.2 | 3560 | 10.3 |
| | 5500 | 1.0 | 99.1 | 73 | 139 | 239 | 450 | 31 | 10.3 | 42.4 | 25.5 | 21.9 | Too Dilute | 10.6 |
| Final Sample: FLD0272 | 4250 | 1.1 | 99.5 | 107 | 215 | 395 | 798 | 27 | 6.8 | 32.3 | 21.7 | 39.2 | 3520 | 10.7 |

The FLT test was performed at 20 dry wt. % MFC; in this instance the samples were diluted using additional host mineral (IC60) to 20 dry wt. % MFC so that it could be compared to experimental control samples produced at 20 dry wt. % MFC. The FLT index is a tensile test developed to assess the quality of microfibrillated cellulose and re-dispersed microfibrillated cellulose. The POP of the test material is adjusted to 20% by adding whichever inorganic particulate was used in the production of the microfibrillated cellulose/inorganic material composite (in the case of inorganic particulate free microfibrillated cellulose then 60 wt. %<2 um GCC calcium carbonate is used). A 220 gsm sheet is formed from this material using a bespoke Buchner filtration apparatus. The resultant sheet is conditioned and its tensile strength measured using an industry standard tensile tester.

Example 2. FLT Test

The FLT test is a quick measurement for making sheets from a pure MFC sample on a custom-built filtration apparatus, which is utilized to measure the strength of a MFC sheet.

Figure 2:
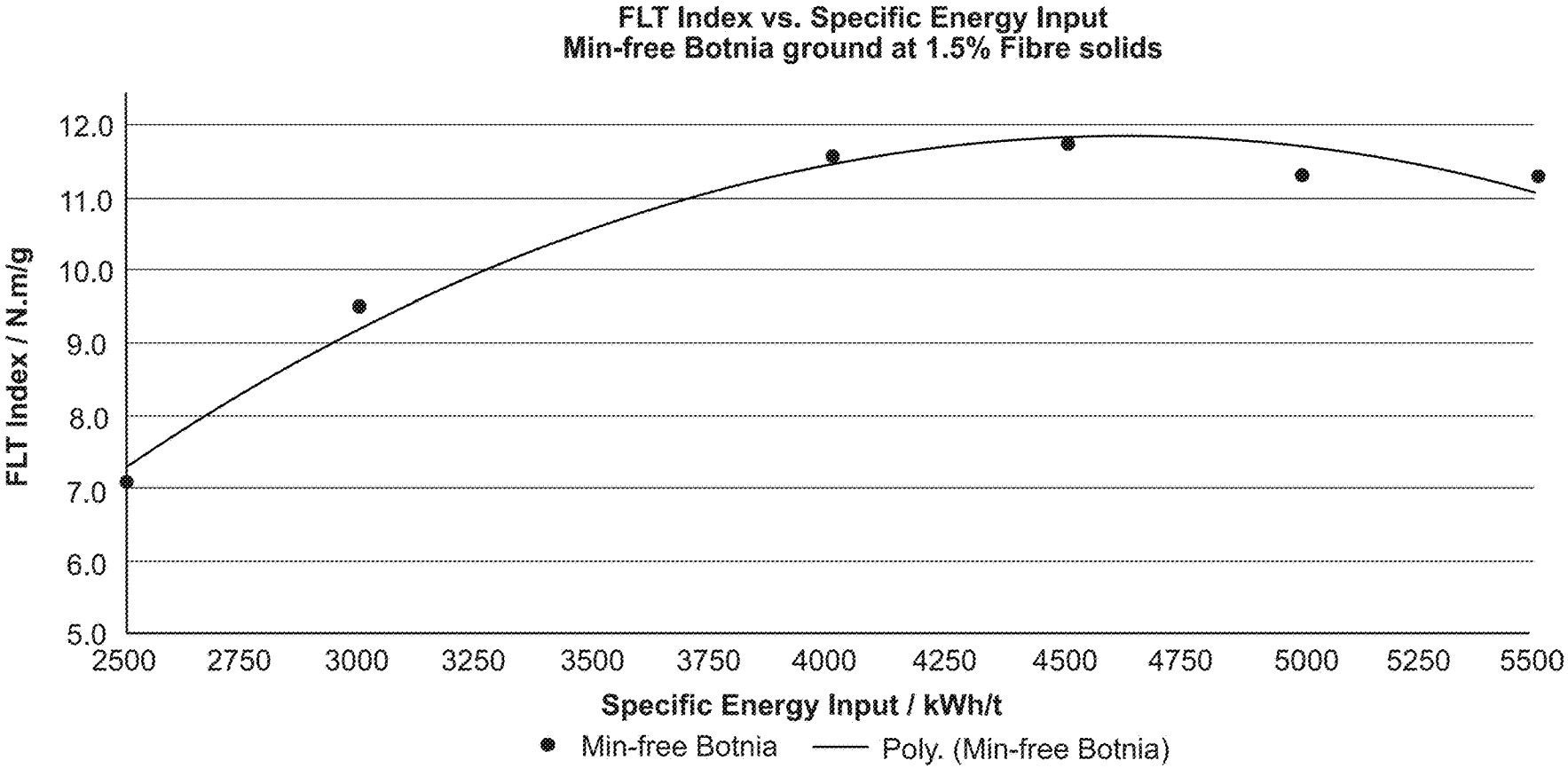
FIG. 2 provides a plot of the FLT Index vs. Specific Energy Input for mineral-free Botnia RMA90 pulp, ground at 1.5% fibre solid for comparison purposes to NBSK pulp.

Table 2 below shows the calibration data from mineral-free NSBK ground at 2% fibre solids. FIG. 2 shows the comparison of these calibrations. Similar tensile strength procedures are known in the art, such as TAPPI T-404 cm-92, which is incorporated herein by reference in its entirety. The FLT test performed in the present Examples followed the procedure noted below.

Performance of FLT Tensile Strength Measurement.

Apparatus utilized was a Tensile test filtration apparatus, 18.5 cm diameter medium-fast speed filter papers (Whatman No. 40 or equivalent).

The % solids and % POP of sample were recorded as determined in the separate Examples described below.

Record % solids and % POP of sample (see separate procedures described below).

If % POP is greater than 20%, add mineral of the same type as in the FiberLean product to bring it to 20% (see separate procedure for FiberLean handsheets). If % POP is between 18% and 20% a correction factor will need to be applied to the result.

Approximately 4.4 g dry weight of sample (44 g for a 10% solids sample) was taken and diluted with water to 400 mL to obtain a total solids of approximately 1.1% (0.22% fibre solids). This will make a 220 gsm sheet on the 15.9 cm diameter exposed screen of the apparatus. The sample was stirred well to ensure good dispersion.

Then, 1 ml of the 0.2 wt % polyDADMAC solution was added to the diluted sample and the sample was stirred well. The top section the filtration unit was removed and a filter paper was placed on top of the screen.

Thereafter, the filter paper was wetted with a wash bottle, and any bubbles that formed were pushed out to the rim of the paper. The vacuum was then switched on to adhere the filter to the screen, ensuring that it sat flush with no creases. The top section of the apparatus was clamped in place and the vacuum was switched off and the drain valve was opened to release vacuum and drain water. The sample was poured into the top section over the end of a spatula or similar instrument to ensure an even distribution. Pouring the sample directly onto filter paper was avoided. The sample was allowed to settle for a few seconds, then the vacuum was switched on and the sample was filtered. This took approximately 2 minutes. Once the water cleared, the vacuum supply was switched off after approximately 1 minute and the drain valve was opened to release the vacuum and to remove water from unit. Thereafter, the top section of unit was removed and the filter paper and filtered sample together were carefully removed. The sample and filter were carefully placed on a Rapid Köthen carrier board. The sheet cover of the Rapid Köthen was placed over the sample and dried in the Rapid Köthen drier for approximately 7 minutes. The dry sample was separated from the filter and cover and conditioned at 25° C. and 50% RH for a minimum of 20 minutes Next, the sheet was weighed to determine its grams per square meter ('gsm"). The sample was cut into 15 mm wide strips using a cutter. A minimum of 5 strips were required.

Next, the force in Newtons required to break each strip with the tensile tester was measured.

Calculations of FLT were made in the following manner.

Area of sheet in $m2(A)=0.0001\times\pi\times$(diameter in $cm$)2/4(0.0199 for 15.9 cm diameter sheet).

Sheet gsm=Mass of sheet in grams/A.

Mass of slurry required=$100\times220\times A/TS$($TS$=% total solids).

$FLT$(Tensile Index)$cm\ kg$-1($T$)=$1000\times Fm/(W\times gsm)$.

Where Fm=Max tensile force (N).

W=Strip width (15 mm as standard).

gsm=gsm of sample

The average tensile index and standard deviation of the 5 measurements in each case were recorded.

As noted above, if the % POP is less than 20%, then the tensile index is corrected according to:

$T$corrected=$T/[1-7.6*(0.2-\%\ POP)]$.

Calibration and procedures follow those laid down in Paper testing—T220 sp-96.

TABLE 2

Summary of production conditions and testing results for the calibration grinds for NBSK, ground at 2% fibre solids.

| Sample and/or Conditions | Specific energy input kWh/t | Total Solids % | POP % | Malvern Insitec D30 μm | D50 μm | D70 μm | D90 μm | STEEPNESS | <25 μm % | 25-150 μm % | 150-300 μm % | >300 μm % | Vane Viscosity mPas | FLT index N. m/g |
|---|---|---|---|---|---|---|---|---|---|---|---|---|---|---|
| X274 1.7.19 (Control) | | | | | | | | | | | | | | 9.2 |
| Calibration curve | 2500 | 0.7 | 99.4 | 116 | 242 | 531 | 1151 | 22 | 5.6 | 31.3 | 18.9 | 44.3 | Too Dilute | 6.0 |
| Lab Grind-Min-free | 3000 | 0.8 | 99.8 | 117 | 241 | 516 | 1139 | 23 | 5.7 | 31.0 | 19.3 | 44.0 | Too Dilute | 6.6 |
| Sodra Blue @ 2% Fibre Solids | 3500 | 1.2 | 99.5 | 126 | 260 | 507 | 1044 | 25 | 5.7 | 28.8 | 19.8 | 45.8 | 3240 | 8.4 |
| | 4000 | 0.8 | 99.8 | 123 | 251 | 526 | 1143 | 23 | 5.6 | 29.7 | 19.7 | 45.0 | Too Dilute | 6.8 |

TABLE 2-continued

Summary of production conditions and testing results for the calibration grinds for NBSK, ground at 2% fibre solids.

| Sample and/or Conditions | Specific energy input kWh/t | Total Solids % | POP % | Malvern Insitec D30 µm | D50 µm | D70 µm | D90 µm | STEEPNESS | <25 µm % | 25-150 µm % | 150-300 µm % | >300 µm % | Vane Viscosity mPas | FLT index N. m/g |
|---|---|---|---|---|---|---|---|---|---|---|---|---|---|---|
| | 4500 | 1.0 | 99.3 | 120 | 251 | 517 | 1124 | 23 | 6.1 | 29.5 | 19.4 | 44.9 | 2980 | 6.4 |
| | 5000 | 1.3 | 99.4 | 108 | 221 | 424 | 844 | 26 | 7.0 | 31.7 | 20.6 | 40.7 | 3120 | 8.6 |
| | 5500 | 1.6 | 99.3 | 74 | 149 | 272 | 551 | 27 | 10.3 | 39.9 | 23.0 | 26.8 | 2520 | 10.5 |

FLT test is performed at 20 dry wt. % MFC; in this instance the samples were diluted using additional host mineral (IC60) to 20 dry wt. % MFC so that it could be compared to experimental control samples produced at 20 dry wt. % MFC.

Example 3. Preparation of Microfibrillated Cellulose from Botnia Pulp for Comparative Purposes A trial batch of MFC produced from mineral-free Botnia was manufactured under the same conditions used for the MFC produced from NBSK for comparison purposes.

Table 3 below presents a summary of the production conditions and testing results for the MFC produced from Botnia pulp.

TABLE 3

Summary of production conditions and testing results for the calibration grinds

| Sample and/or Conditions | Specific energy input kWh/t | Total Solids % | POP % | Malvern Insitec D30 µm | D50 µm | D70 µm | D90 µm | STEEPNESS | <25 µm % | 25-150 µm % | 150-300 µm % | >300 µm % | Vane Viscosity mPas | FLT index N. m/g |
|---|---|---|---|---|---|---|---|---|---|---|---|---|---|---|
| X274 3.7.19 (Control) | | | | | | | | | | | | | | 9.0 |
| Calibration curve | 2500 | 1.0 | 98.7 | 136 | 286 | 580 | 1132 | 23 | 4.6 | 27.9 | 18.9 | 48.6 | Too Dilute | 7.1 |
| Lab Grind-Min-free Botnia @ 1.5% Fibre Solids | 3000 | 1.0 | 99.2 | 133 | 275 | 526 | 1065 | 25 | 5.1 | 28.0 | 19.5 | 47.4 | Too Dilute | 9.5 |
| | 3500 | 1.0 | 99.1 | 104 | 206 | 370 | 728 | 28 | 6.8 | 33.3 | 22.6 | 37.3 | Too Dilute | |
| | 4000 | 1.0 | 98.9 | 101 | 201 | 363 | 714 | 28 | 7.1 | 33.8 | 22.5 | 36.6 | Too Dilute | 11.6 |
| | 4500 | 1.2 | 99.7 | 85 | 167 | 298 | 579 | 29 | 8.6 | 37.9 | 23.8 | 29.7 | 3260 | 11.8 |
| | 5000 | 1.1 | 99.9 | 81 | 158 | 279 | 543 | 29 | 9.1 | 39.2 | 24.2 | 27.6 | 3160 | 11.3 |
| | 5500 | 1.1 | 99.2 | 72 | 138 | 241 | 463 | 30 | 10.3 | 42.4 | 24.9 | 22.4 | 3120 | 11.3 |

FIG. 2 provides a plot of the FLT Index vs. Specific Energy Input for mineral-free Botnia RMA90 pulp, ground at 1.5% fibre solid for comparison purposes to NBSK pulp.

Figure 3:
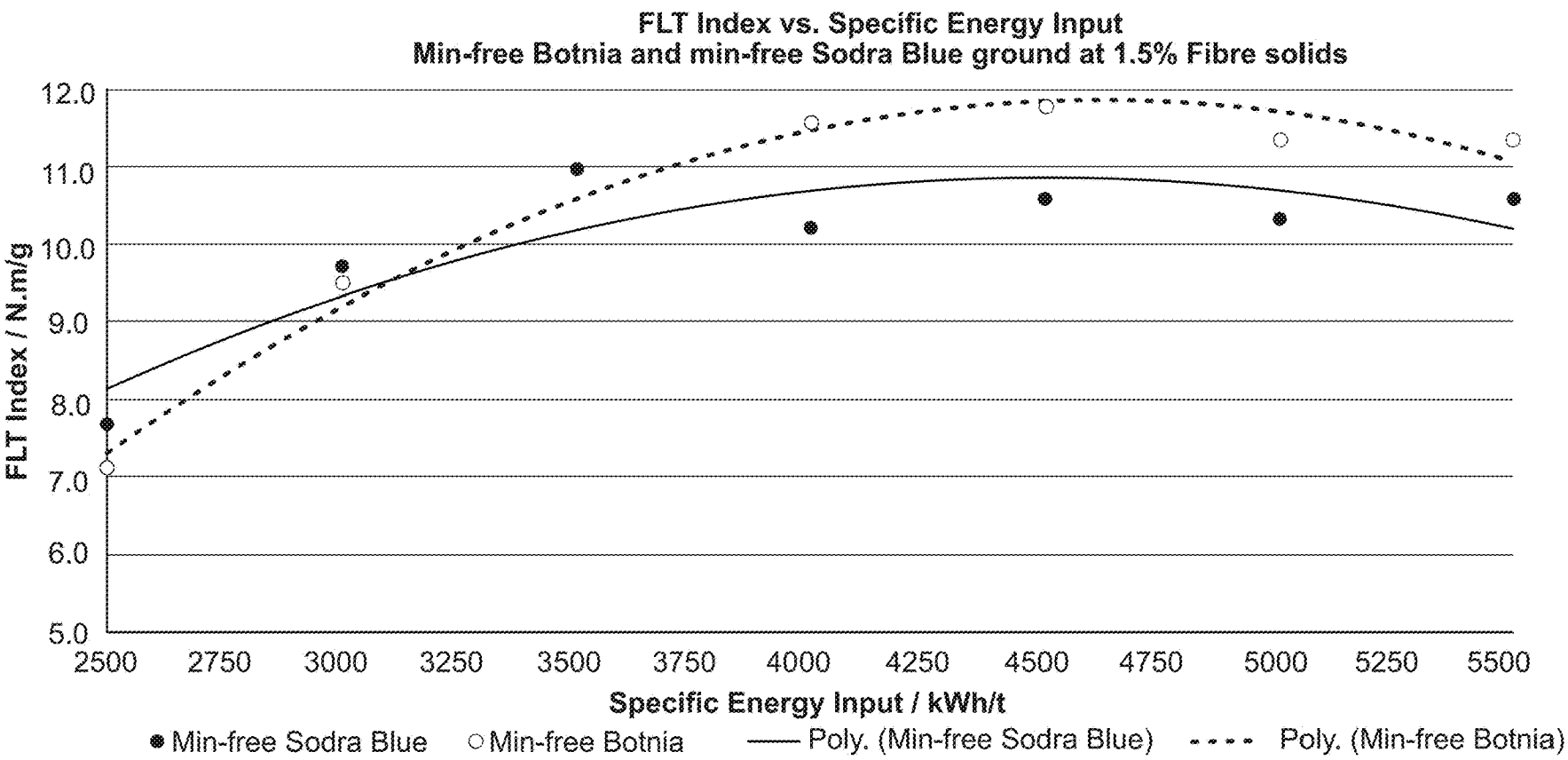
FIG. 3 shows an energy sweep comparison between Södra Blue and Botnia RMA90 ground at 1.5% fibre solids.

FIG. 3 shows the energy sweep comparison between Sodra Blue and Botnia RMA90 ground at 1.5% fibre solids.

Table 4 below shows the calibration data from mineral-Botnia ground at 2% fibre solids.

TABLE 4

Summary of production conditions and testing results for the calibration grinds for Botnia RMA90, ground at 2% fibre solids

| Sample and/or Conditions | Specific energy input kWh/t | Total Solids % | POP % | Malvern Insitec D30 µm | D50 µm | D70 µm | D90 µm | STEEPNESS | <25 µm % | 25-150 µm % | 150-300 µm % | >300 µm % | Vane Viscosity mPas | FLT index N. m/g |
|---|---|---|---|---|---|---|---|---|---|---|---|---|---|---|
| X278 10.7.19 (Control) | | | | | | | | | | | | | | 9.3 |
| Calibration curve | 2500 | 1.1 | 99.5 | 126 | 267 | 547 | 1127 | 23 | 5.2 | 29.1 | 18.9 | 46.8 | 3680 | 8.0 |
| Lab Grind - Min-free | 3000 | 1.3 | 99.7 | 122 | 258 | 514 | 1053 | 24 | 5.7 | 29.5 | 19.2 | 45.7 | 3560 | 9.5 |

TABLE 4-continued

Summary of production conditions and testing results for the calibration grinds for Botnia RMA90, ground at 2% fibre solids

| Sample and/or Conditions | Specific energy input kWh/t | Total Solids % | POP % | Malvern Insitec D30 µm | D50 µm | D70 µm | D90 µm | STEEPNESS | <25 µm % | 25-150 µm % | 150-300 µm % | >300 µm % | Vane Viscosity mPas | FLT index N. m/g |
|---|---|---|---|---|---|---|---|---|---|---|---|---|---|---|
| Botnia @2% Fibre Solids | 3500 | 1.3 | 99.5 | 112 | 230 | 438 | 909 | 26 | 6.4 | 31.2 | 20.6 | 41.9 | 3880 | 10.6 |
| | 4000 | 1.5 | 99.6 | 102 | 210 | 399 | 832 | 26 | 7.2 | 33.0 | 20.9 | 39.0 | 3480 | 10.2 |
| | 4500 | 1.4 | 99.0 | 87 | 177 | 332 | 691 | 26 | 8.6 | 36.3 | 21.8 | 33.3 | 3300 | 10.6 |
| | 5000 | 1.4 | 99.0 | 68 | 134 | 240 | 487 | 28 | 11.0 | 42.8 | 23.5 | 22.7 | 2920 | 11.4 |
| | 5500 | 1.3 | 98.7 | 62 | 119 | 207 | 407 | 30 | 12.2 | 46.0 | 24.0 | 17.8 | 2520 | 10.5 |

Figure 4:
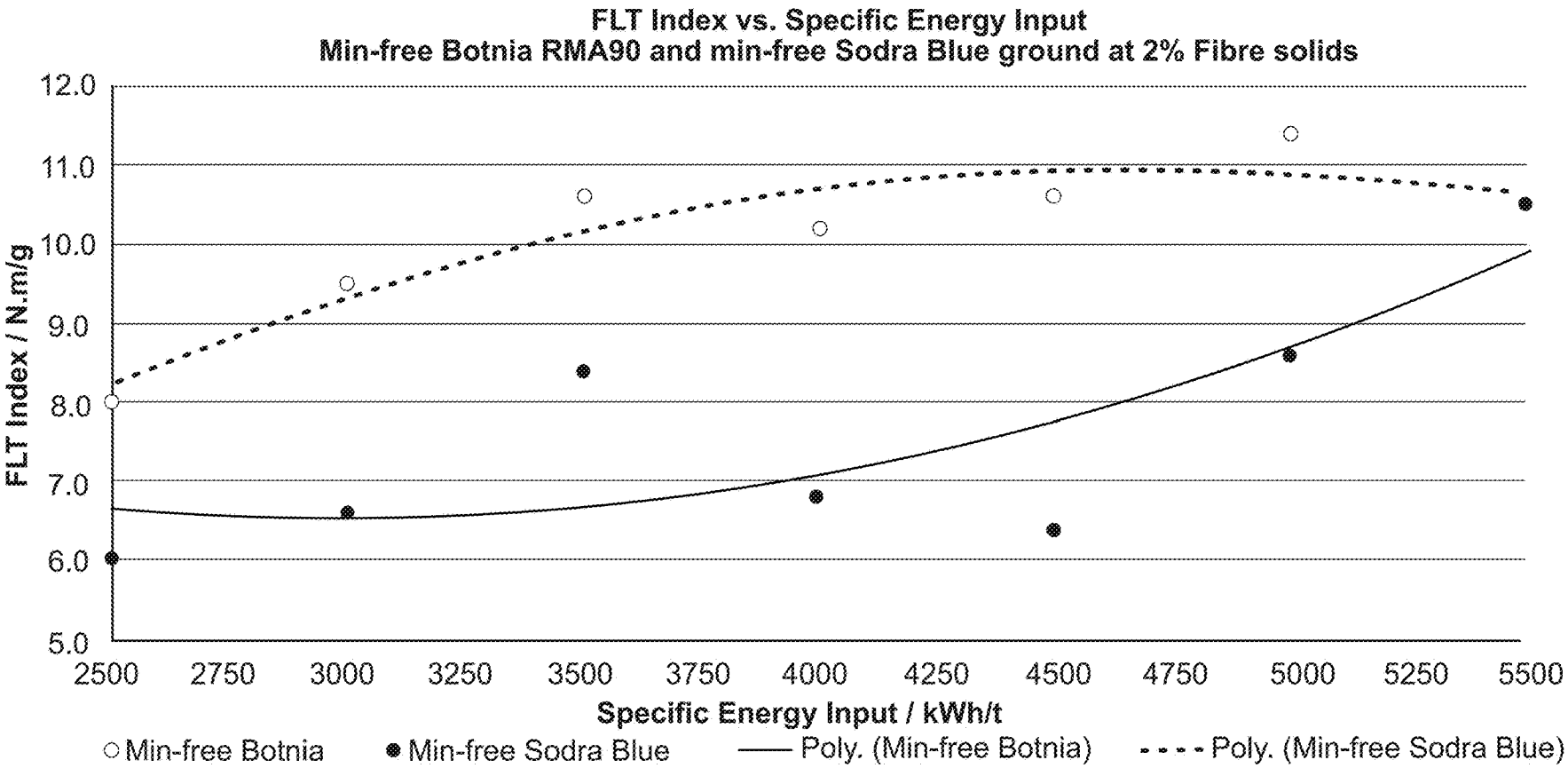
FIG. 4 is a plot of FLT Index vs. Specific Energy Input for mineral-free Södra Blue and Botnia RMA90 pulp, ground at 2% fibre solids.

FIG. 4 is a plot of FLT Index vs. Specific Energy Input for mineral-free Sodra Blue and Botnia RMA90 pulp, ground at 2% fibre solids.

Figure 5:
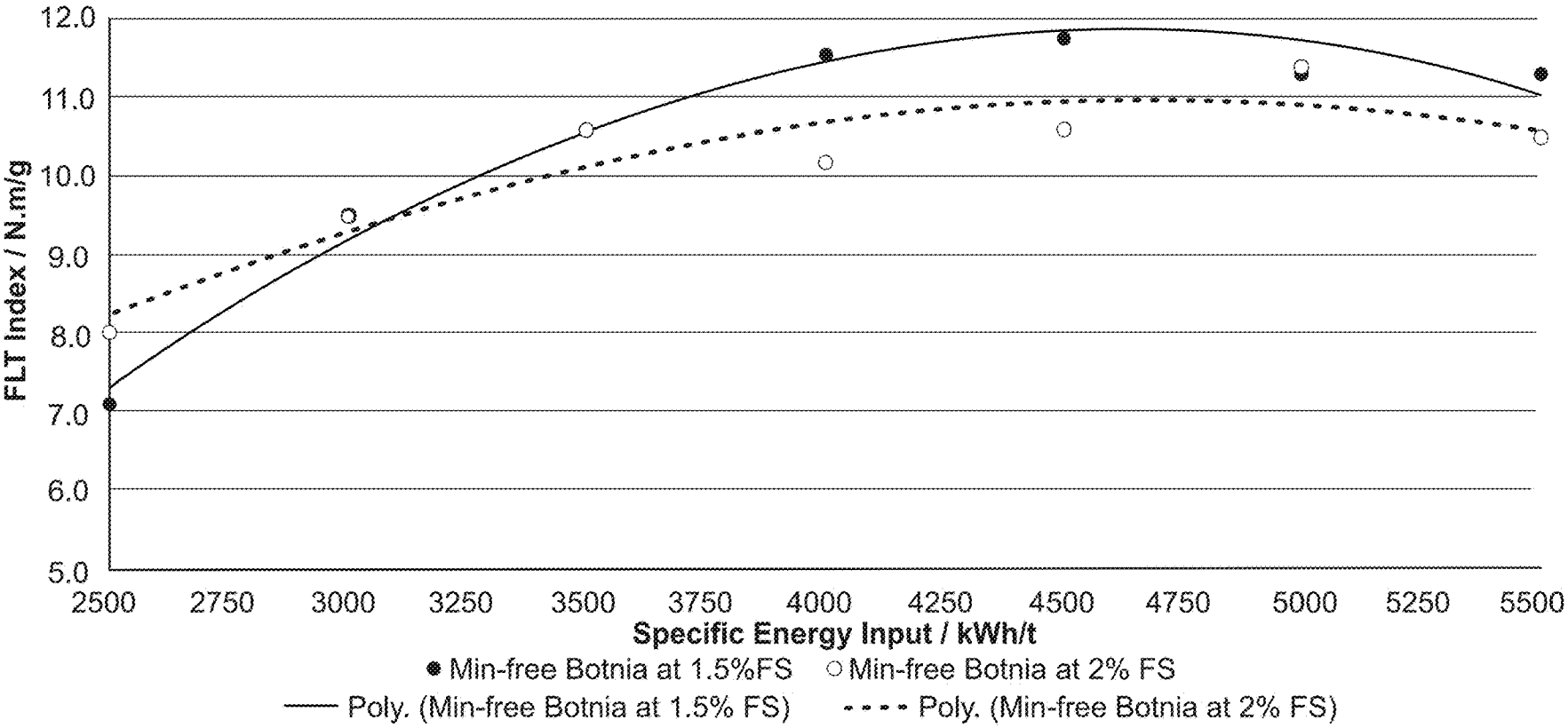
FIG. 5 shows the comparison between Botnia ground pulp at 1.5% and 2% fibre solids.

FIG. 5 shows the comparison between Botnia ground pulp at 1.5% and 2% fibre solids.

Figure 6:
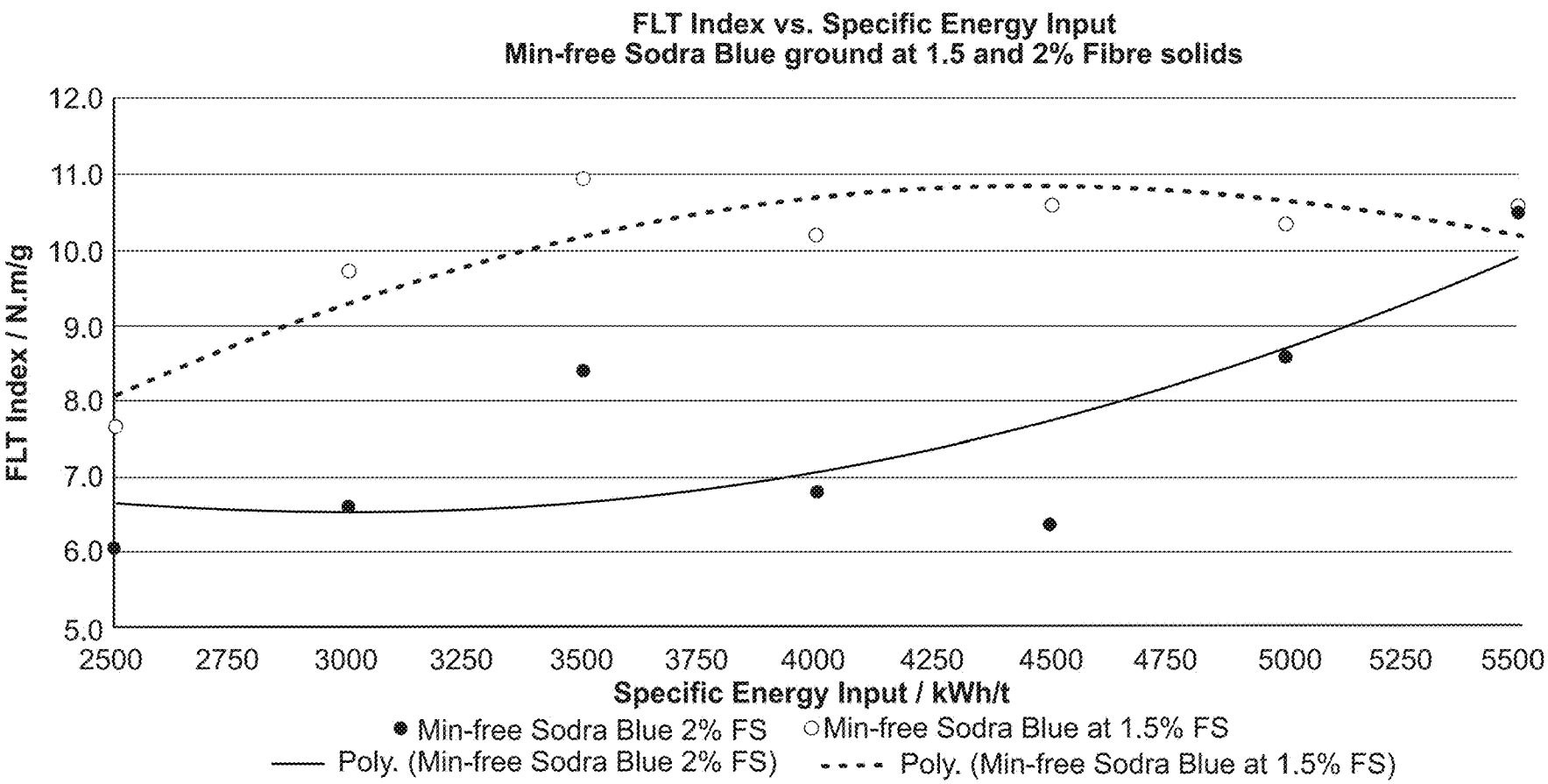
FIG. 6 shows the comparison between Sodra Blue pulp at 1.5% and 2% fibre solids.
Figure 7A:
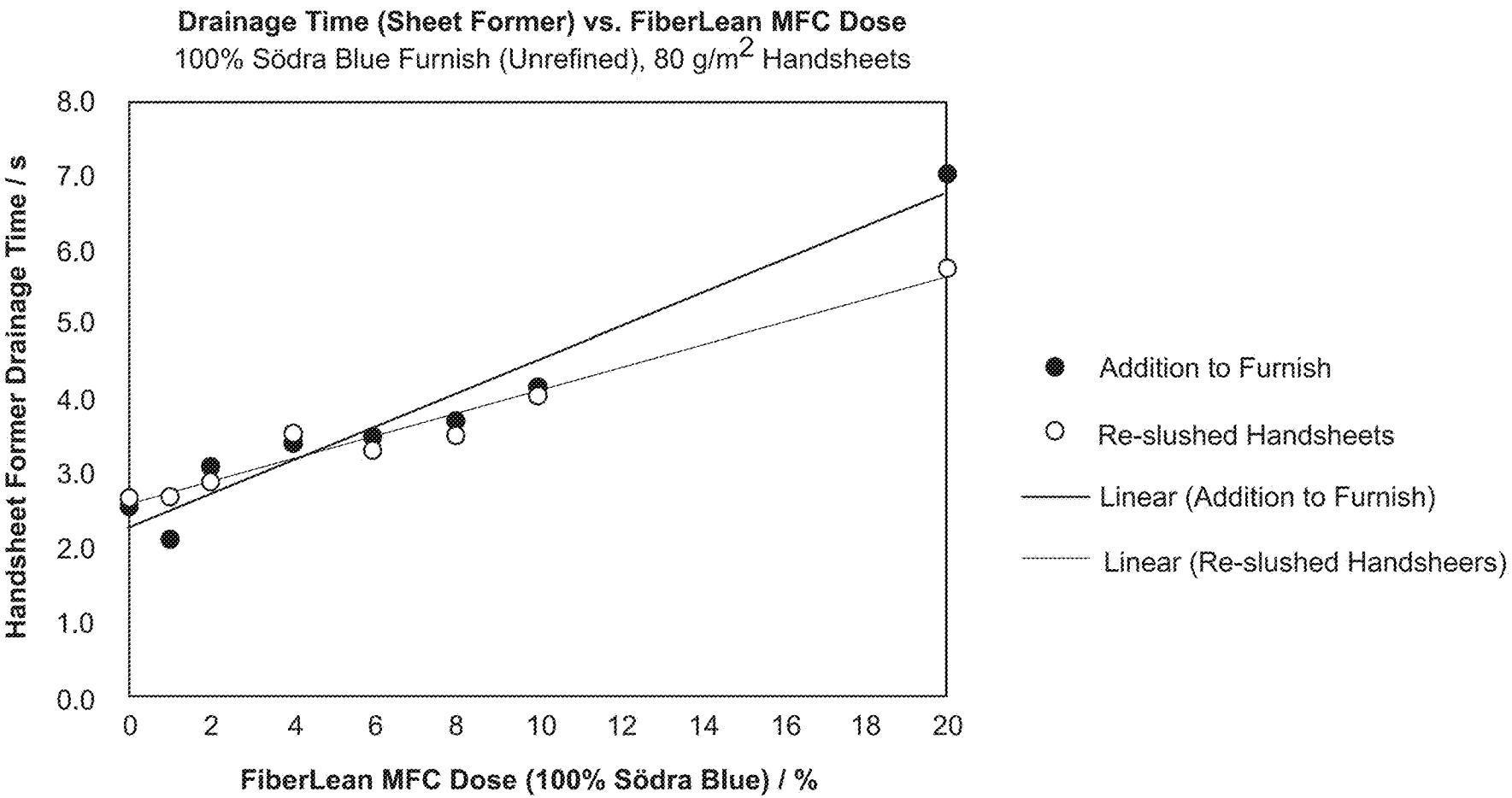
FIGS. 7A-D depict plots of the drainability properties and ash contents achieved for each trial point in Example 6. Schopper Riegler values were calculated conversions from CSF measurements.
Figure 7B:
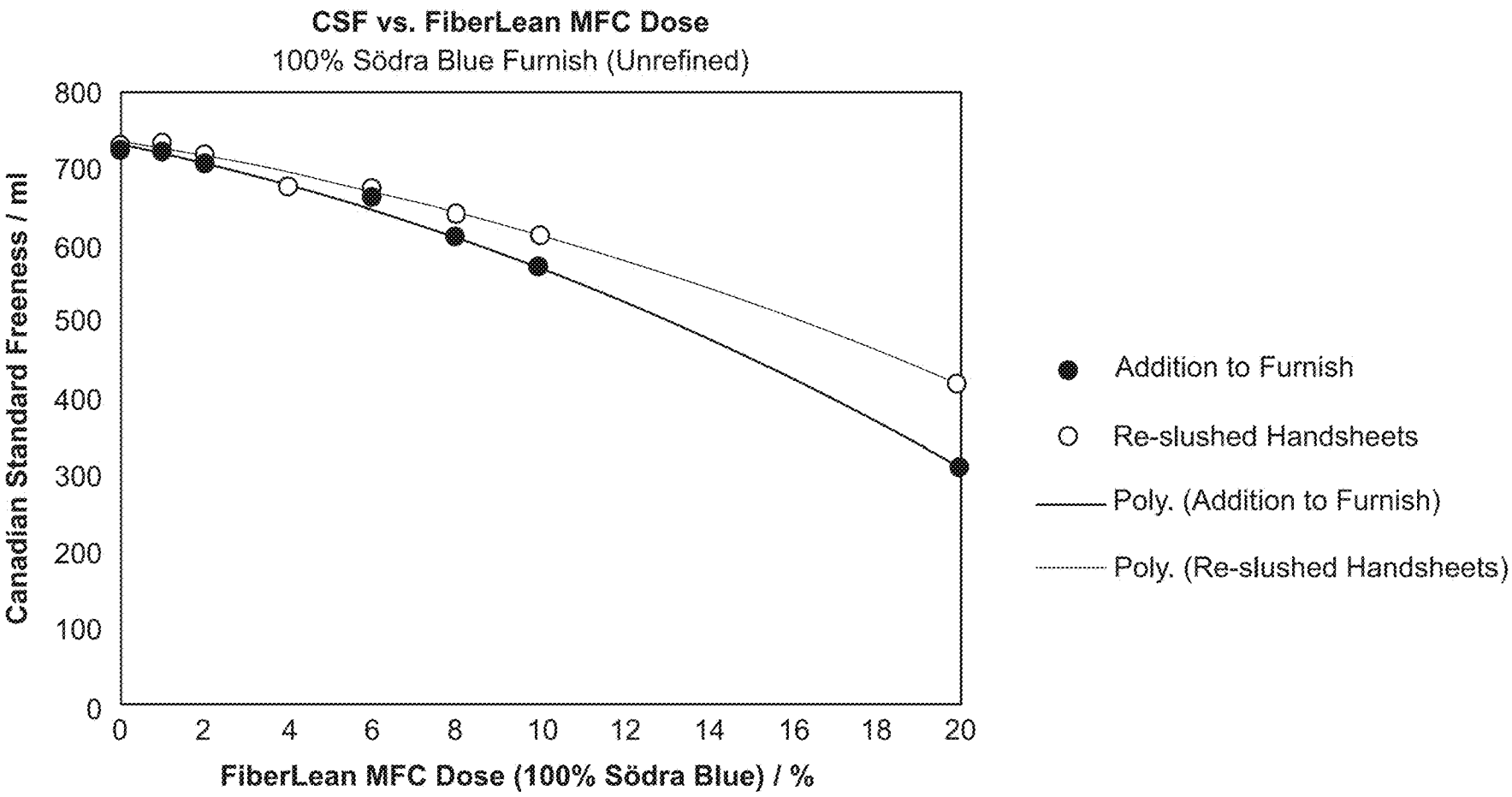
Figure 7C:
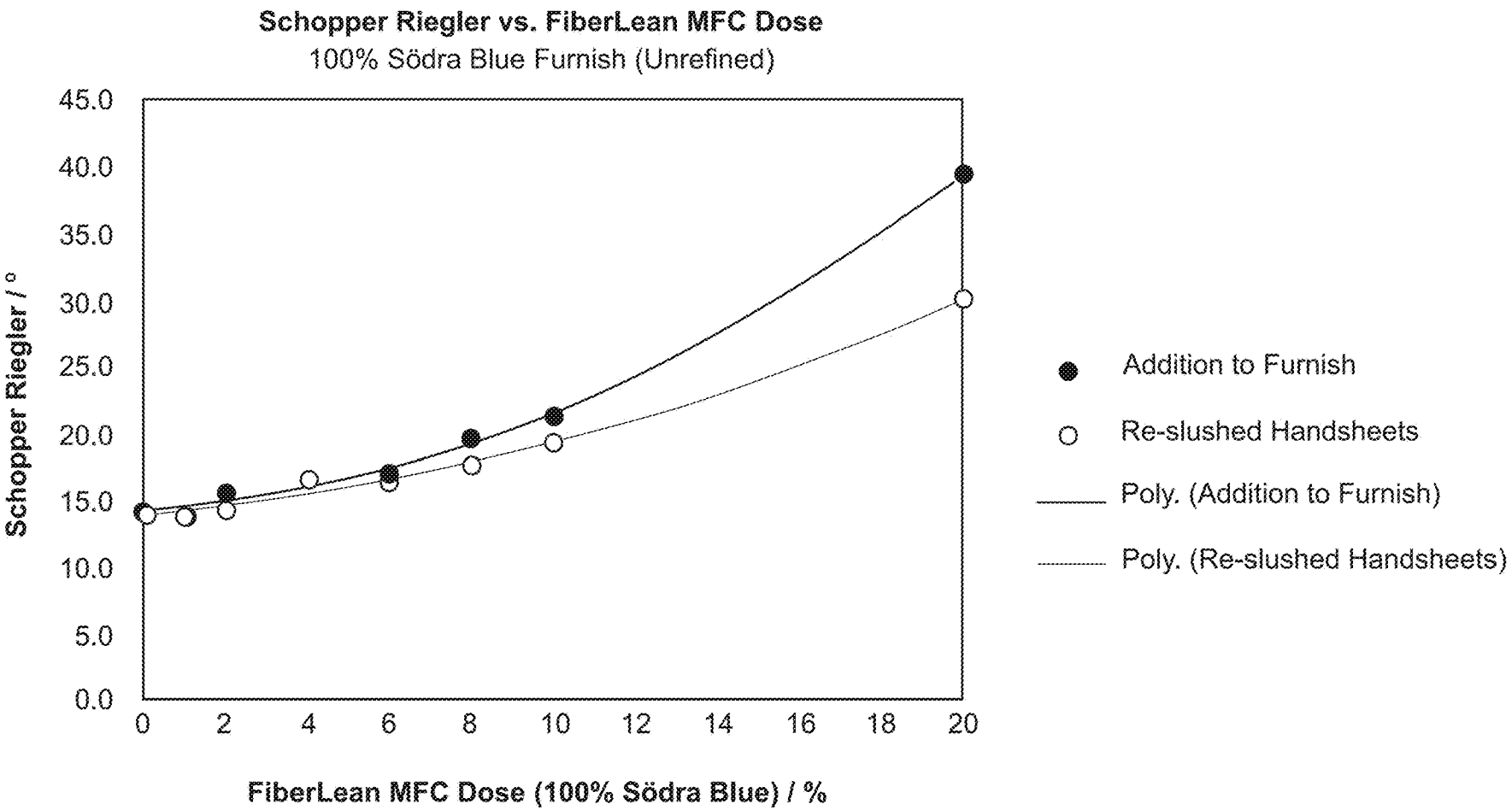
Figure 7D:
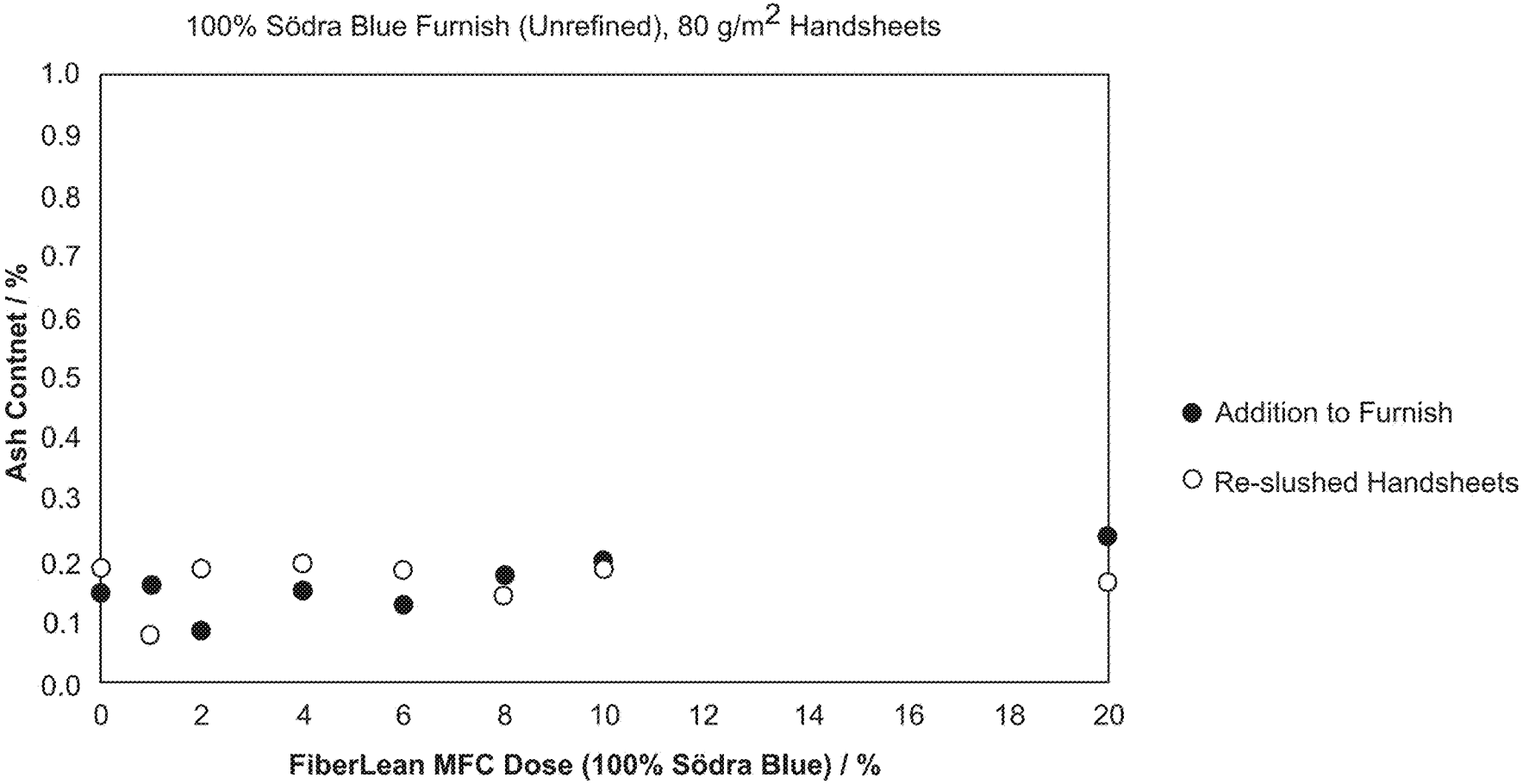
Figure 8A:
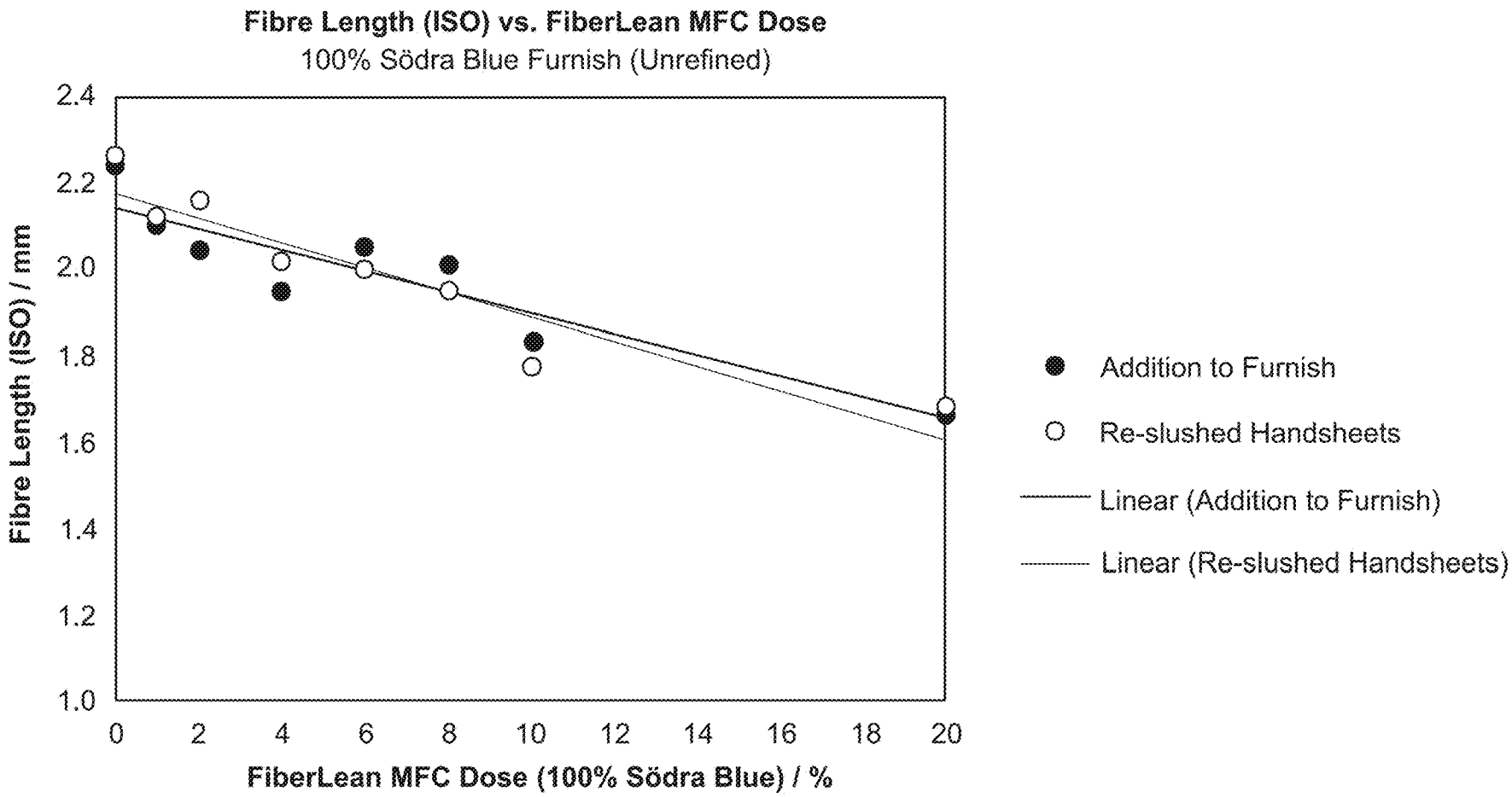
FIGS. 8A-D depict main fibre analyser properties for each trial point obtained on a Valmet FS5 fibre analyser in Example 6.
Figure 8B:
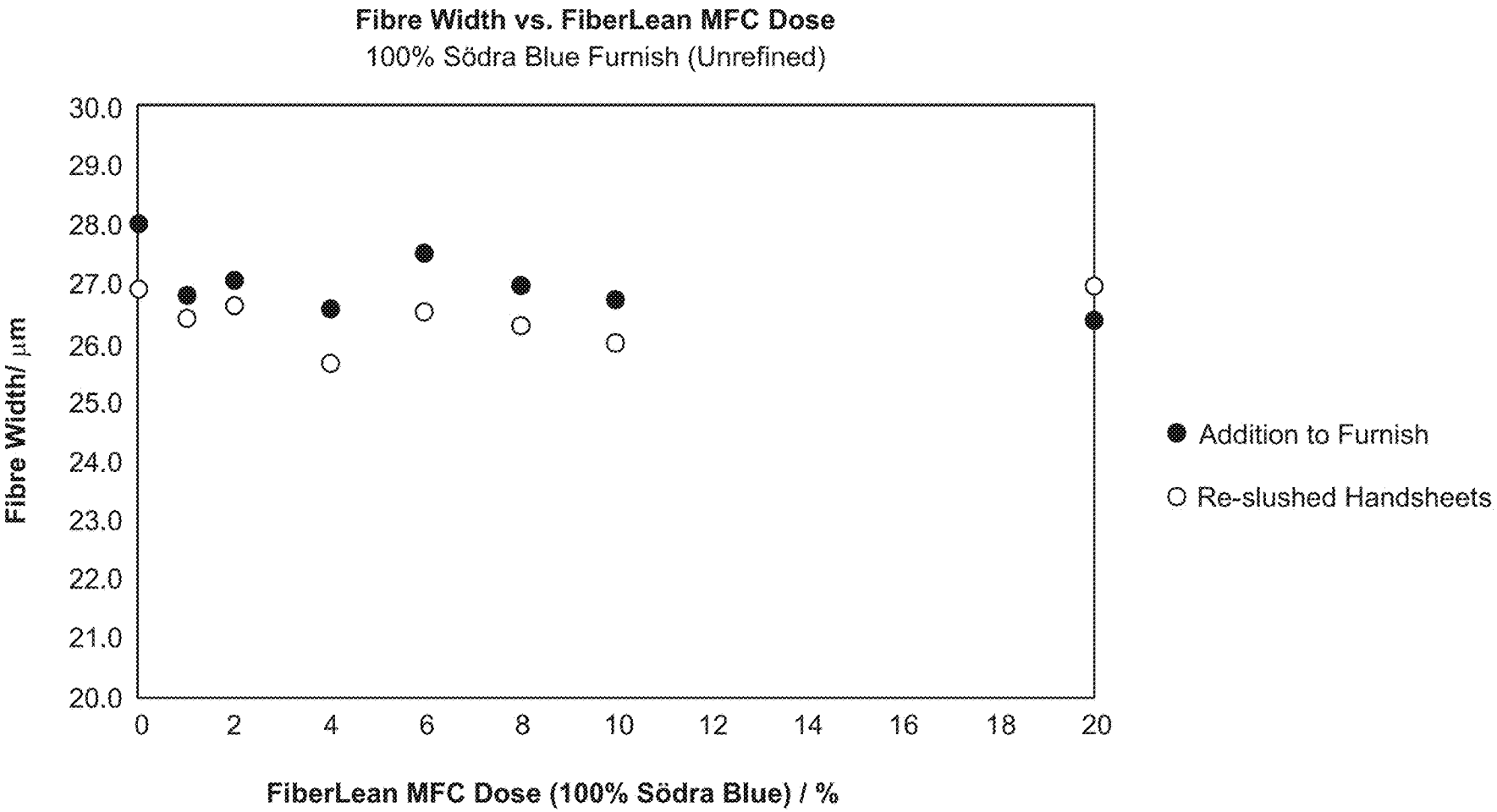
Figure 8C:
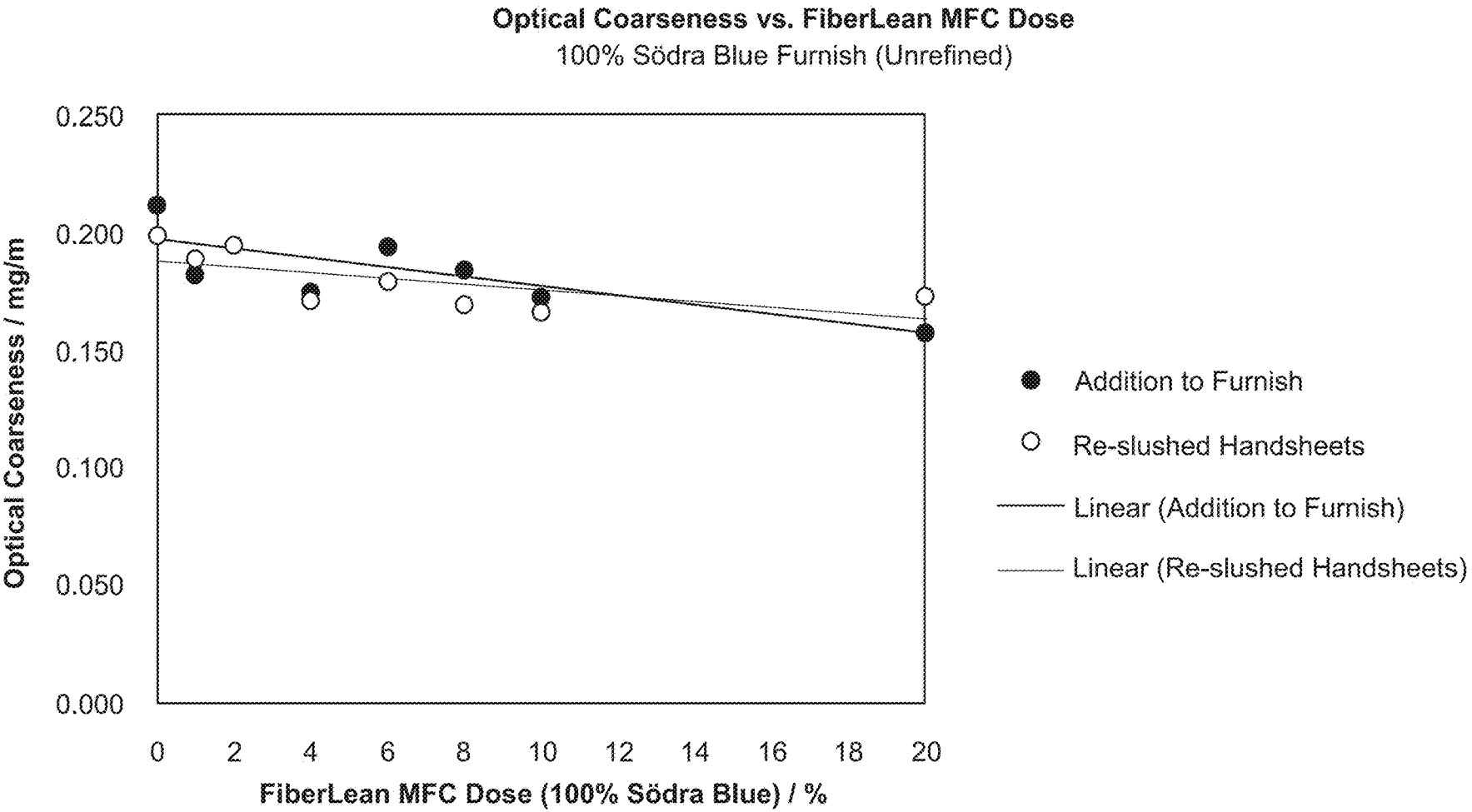
Figure 8D:
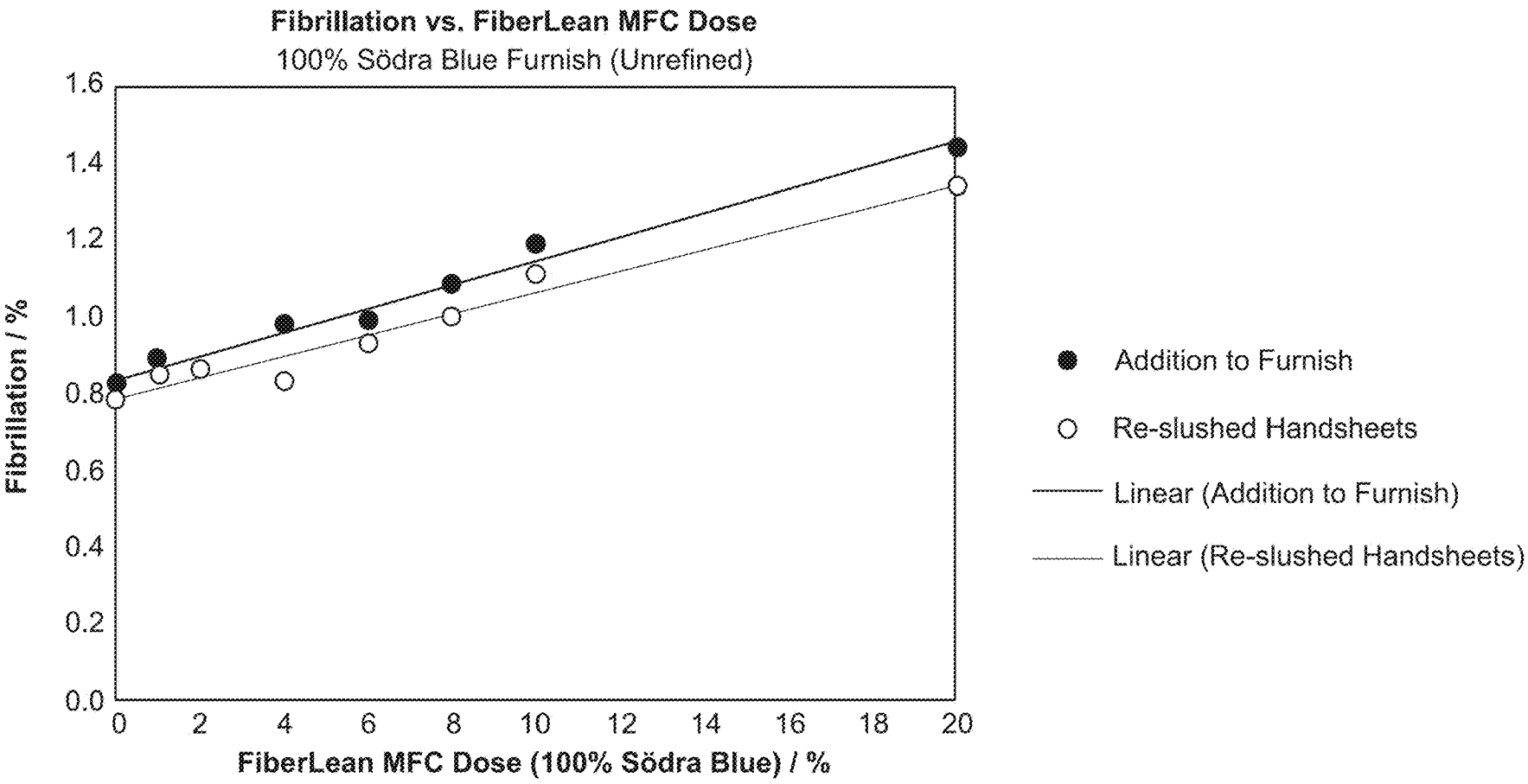
Figure 9:
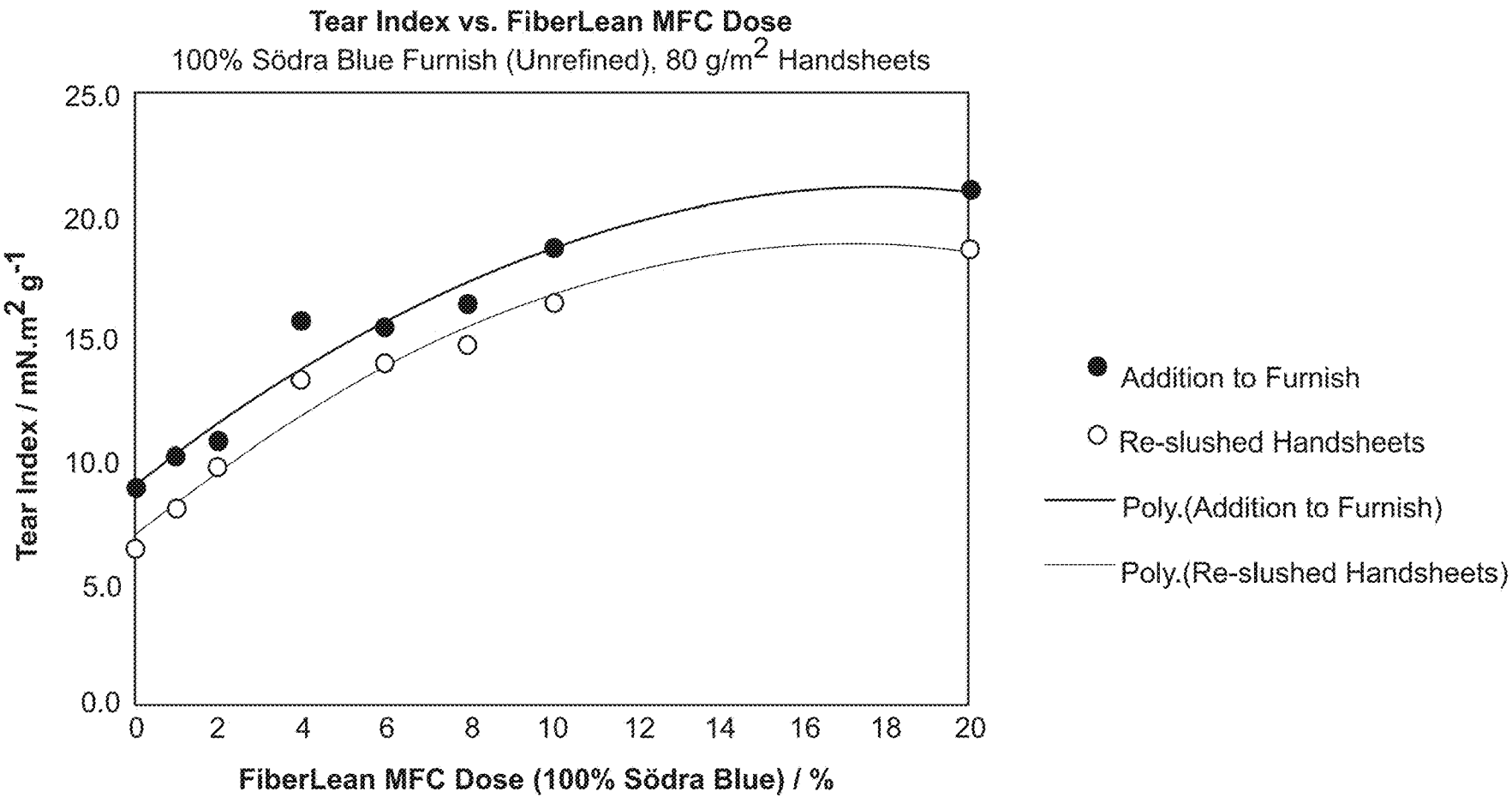
FIG. 9 is a plot of Tear Index versus MFC dosage in handsheets where the MFC is added to the NBSK furnish (unrefined) before preparing handsheets at 80 g/m$^2$ and where the MFC-pulp composition is re-slushed and re-manufactured into handsheets at 80 g/m$^2$ versus MFC dosages of 0, 2, 4, 6, 8, 10, 12, 14, 16, 18, and 20 wt. %.
Figure 10A:
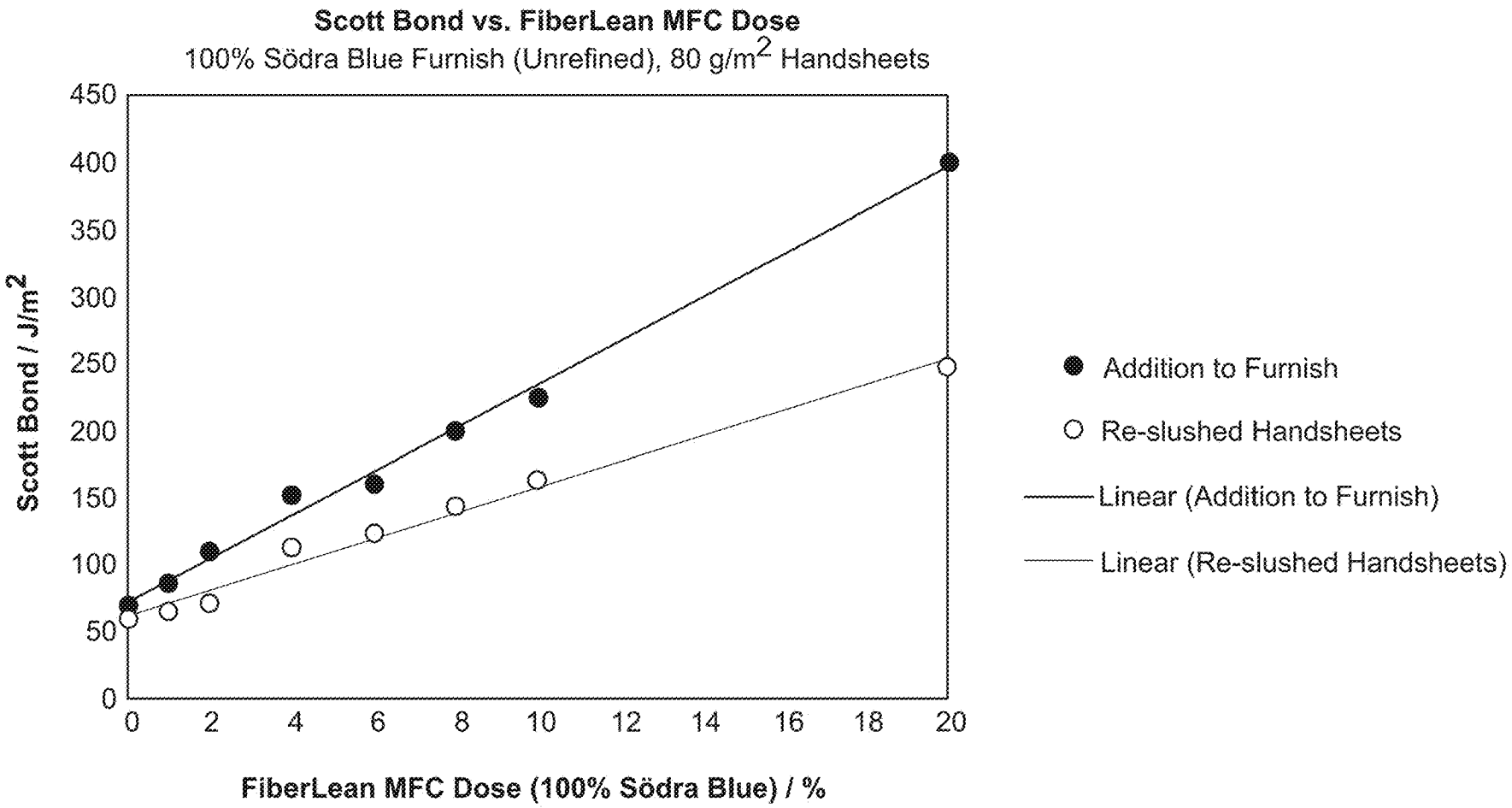
FIGS. 10A-D depict plots of paper properties of handsheets where the MFC is added to the NSBK furnish (unrefined) before preparing handsheets at 80 g/m$^2$ and where the MFC-pulp composition is re-slushed and re-manufactured into handsheets at 80 g/m$^2$ versus MFC dosages of 0, 2, 4, 6, 8, 10, 12, 14, 16, 18, and 20 wt. %.
Figure 10B:
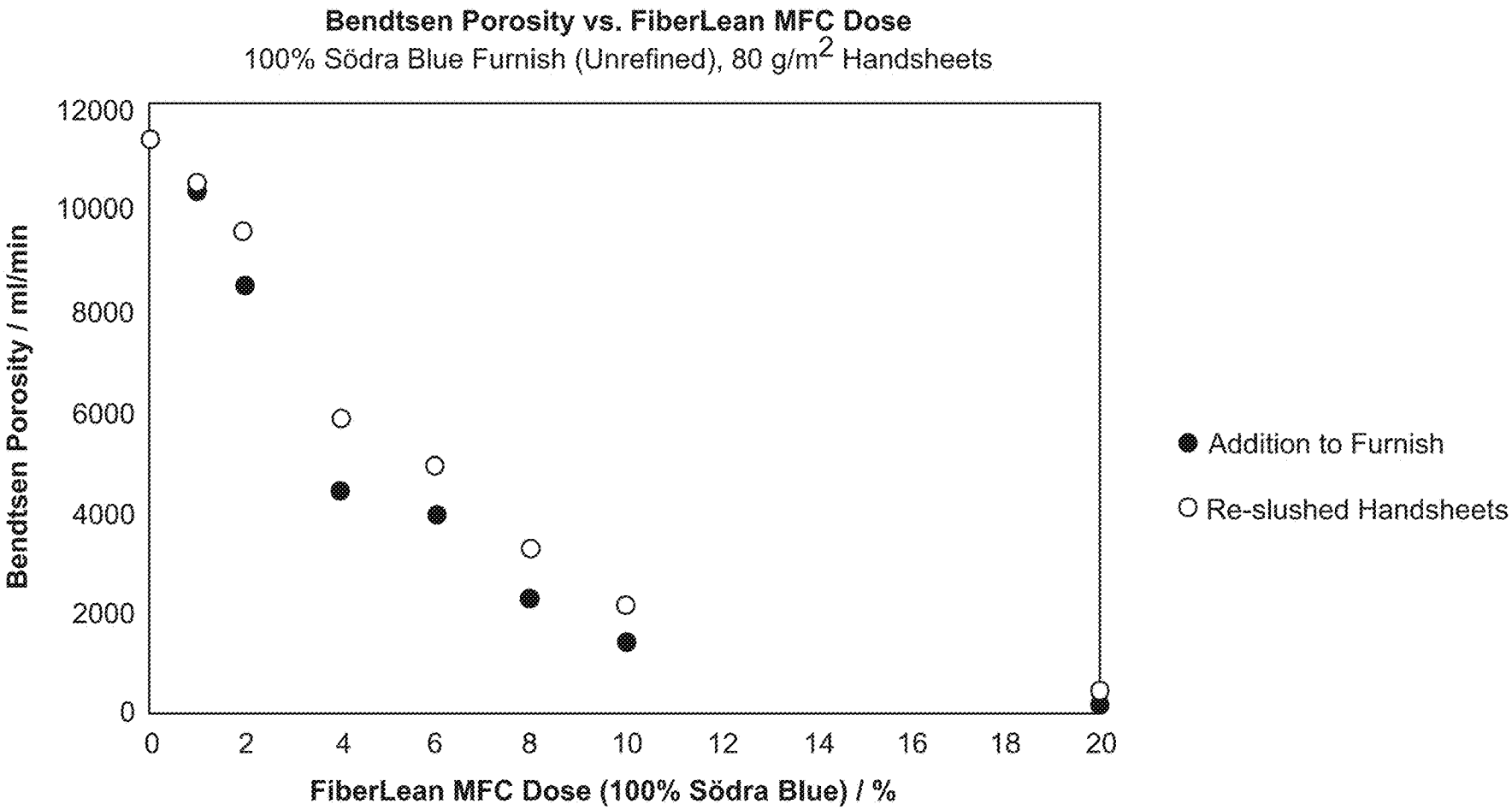
Figure 10C:
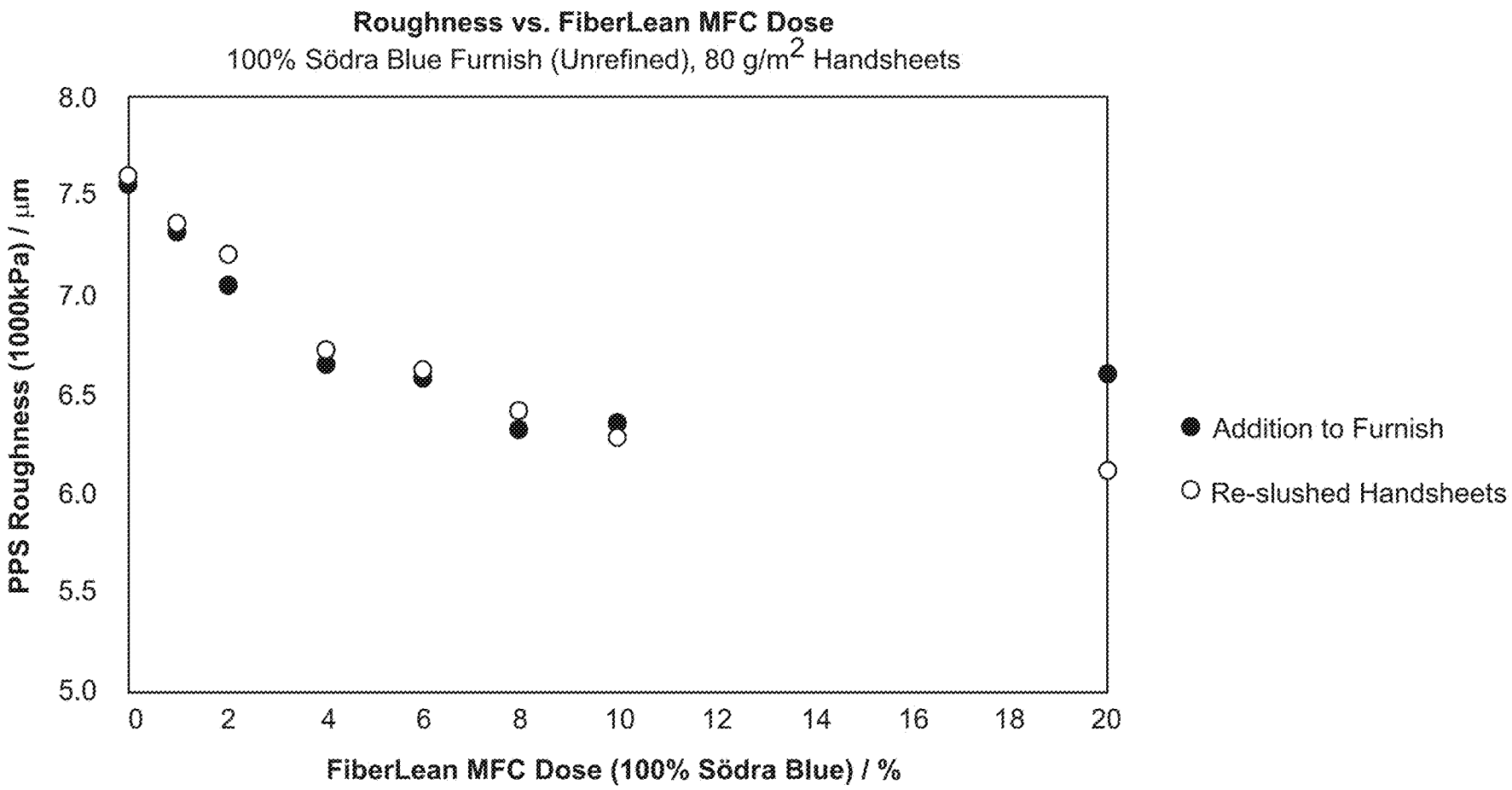
Figure 10D:
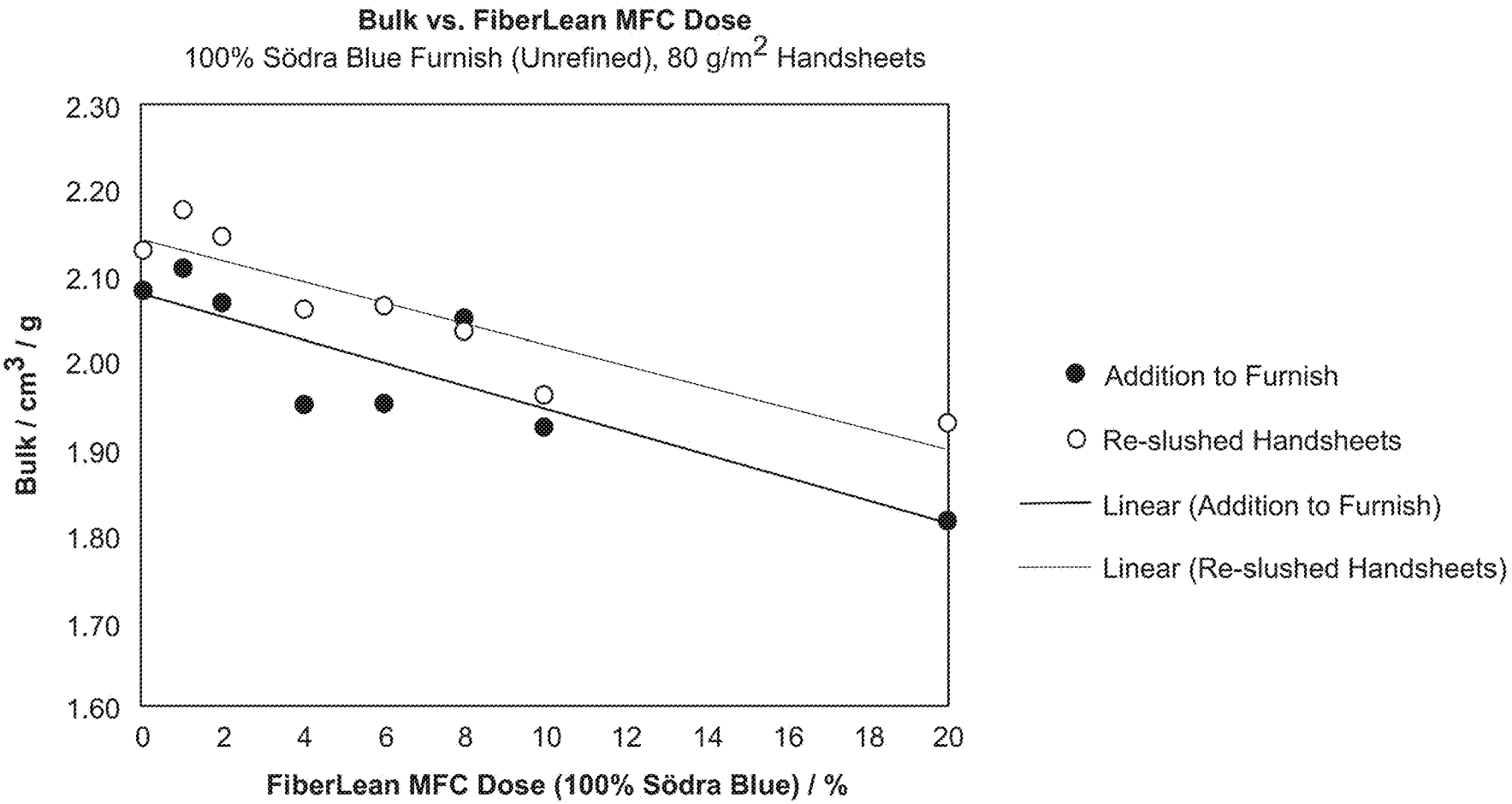
Figure 11A:
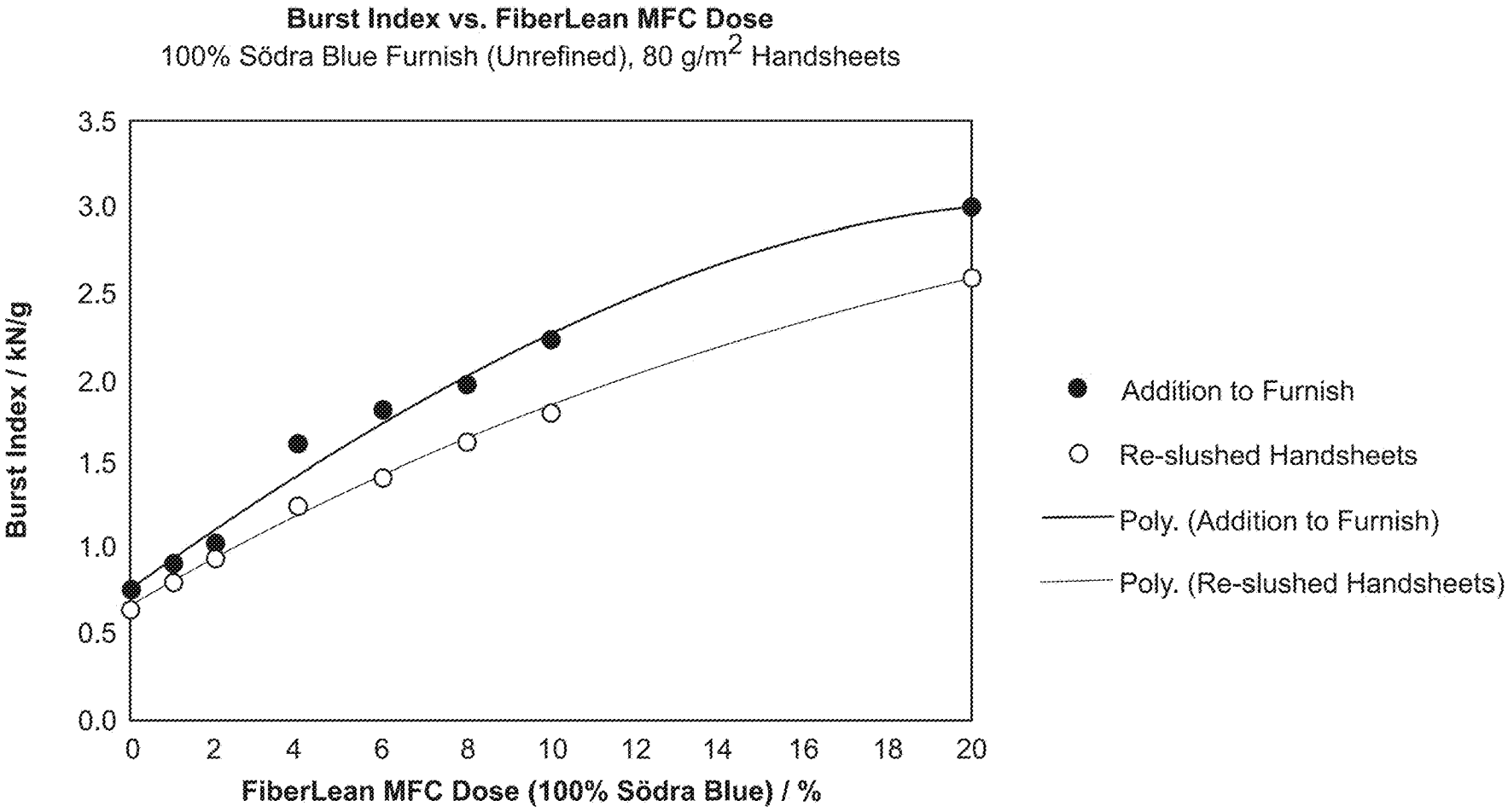
FIGS. 11A-D depicts plots of additional paper properties of handsheets where the MFC is added to the NBSK furnish (unrefined) before preparing handsheets at 80 g/m$^2$ and where the MFC-pulp composition is re-slushed and re-manufactured into handsheets at 80 g/m$^2$ versus MFC dosages of 0, 2, 4, 6, 8, 10, 12, 14, 16, 18, and 20 wt. %.
Figure 11B:
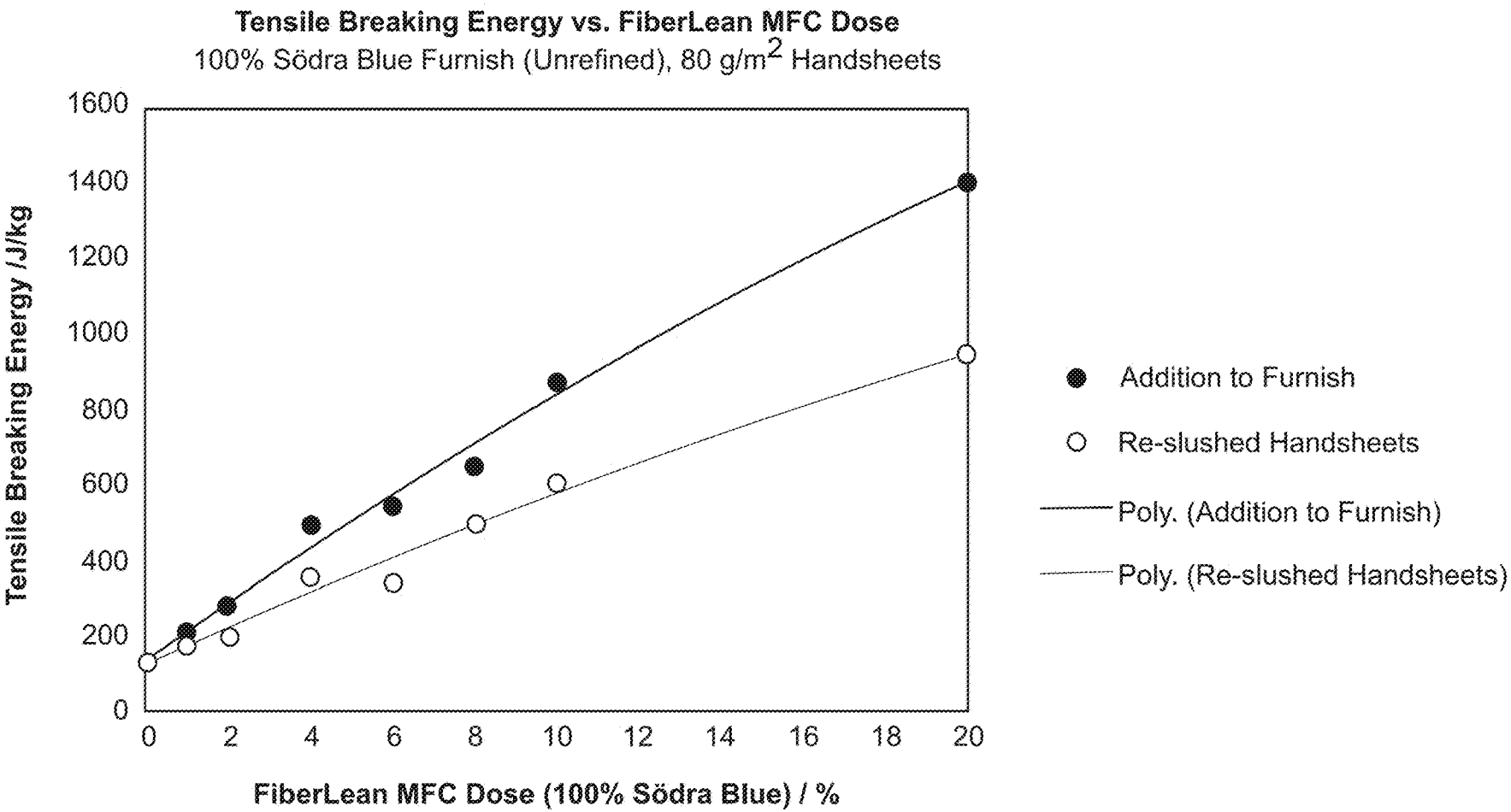
Figure 11C:
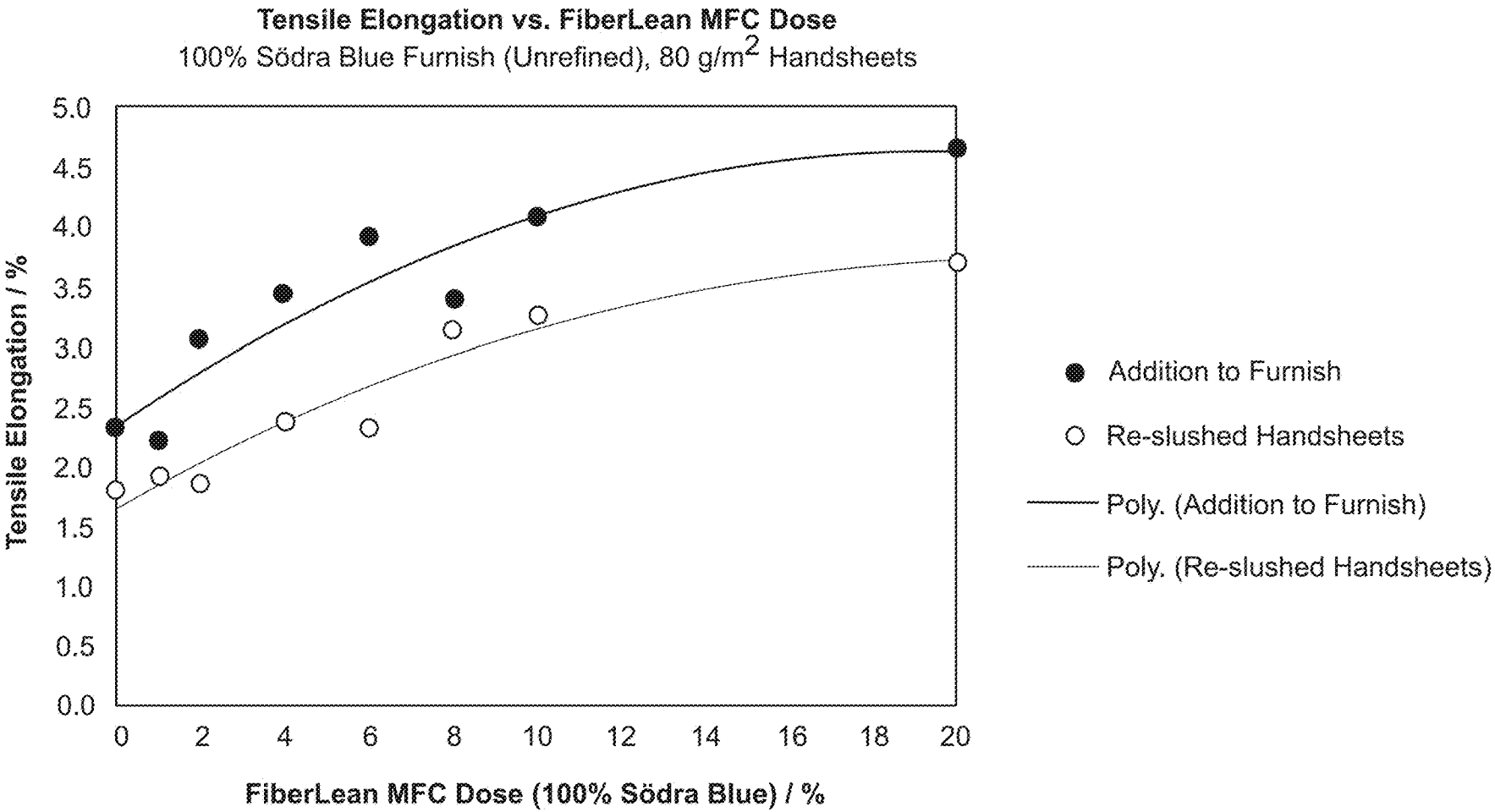
Figure 11D:
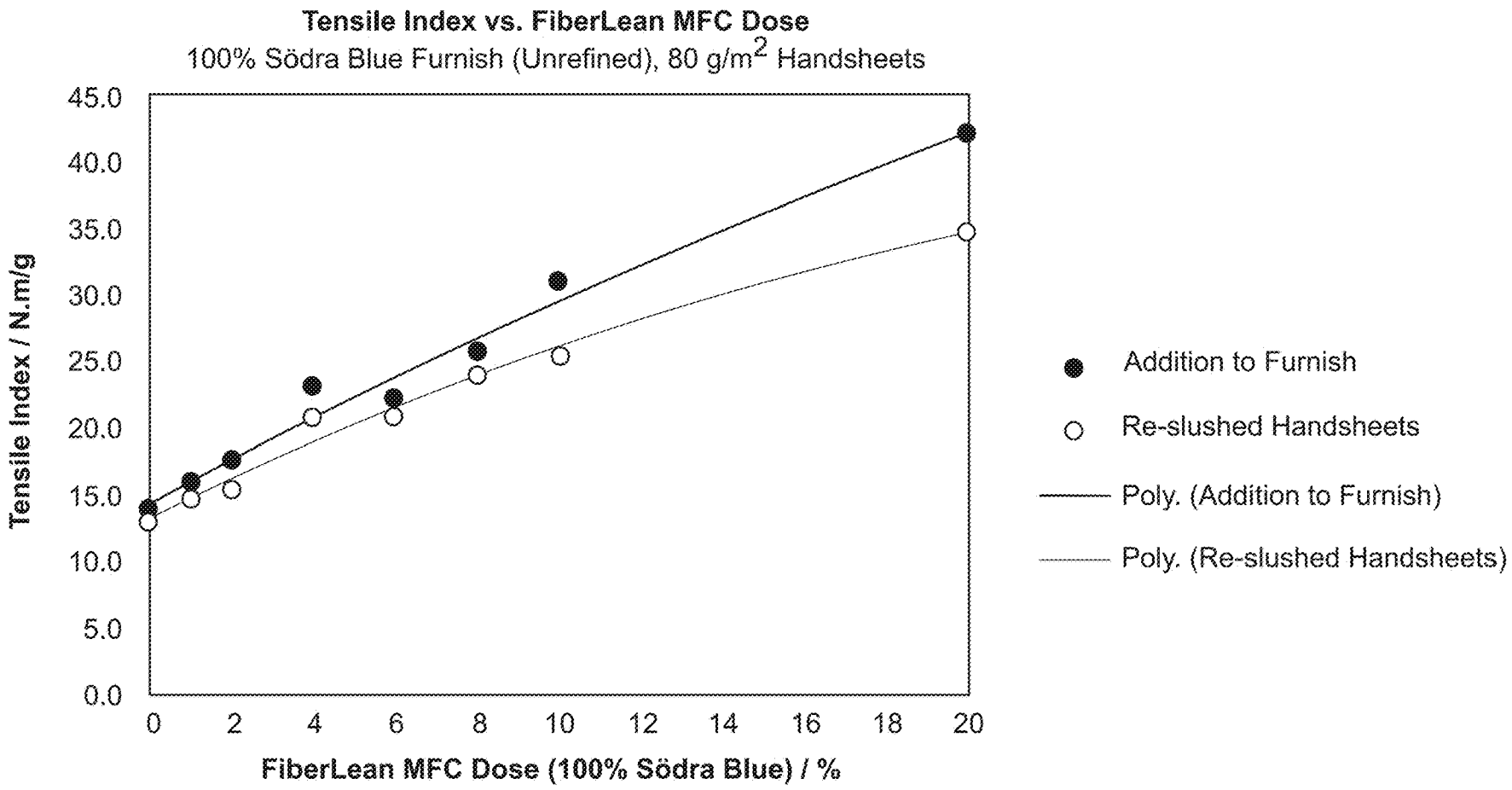
Figure 12A:
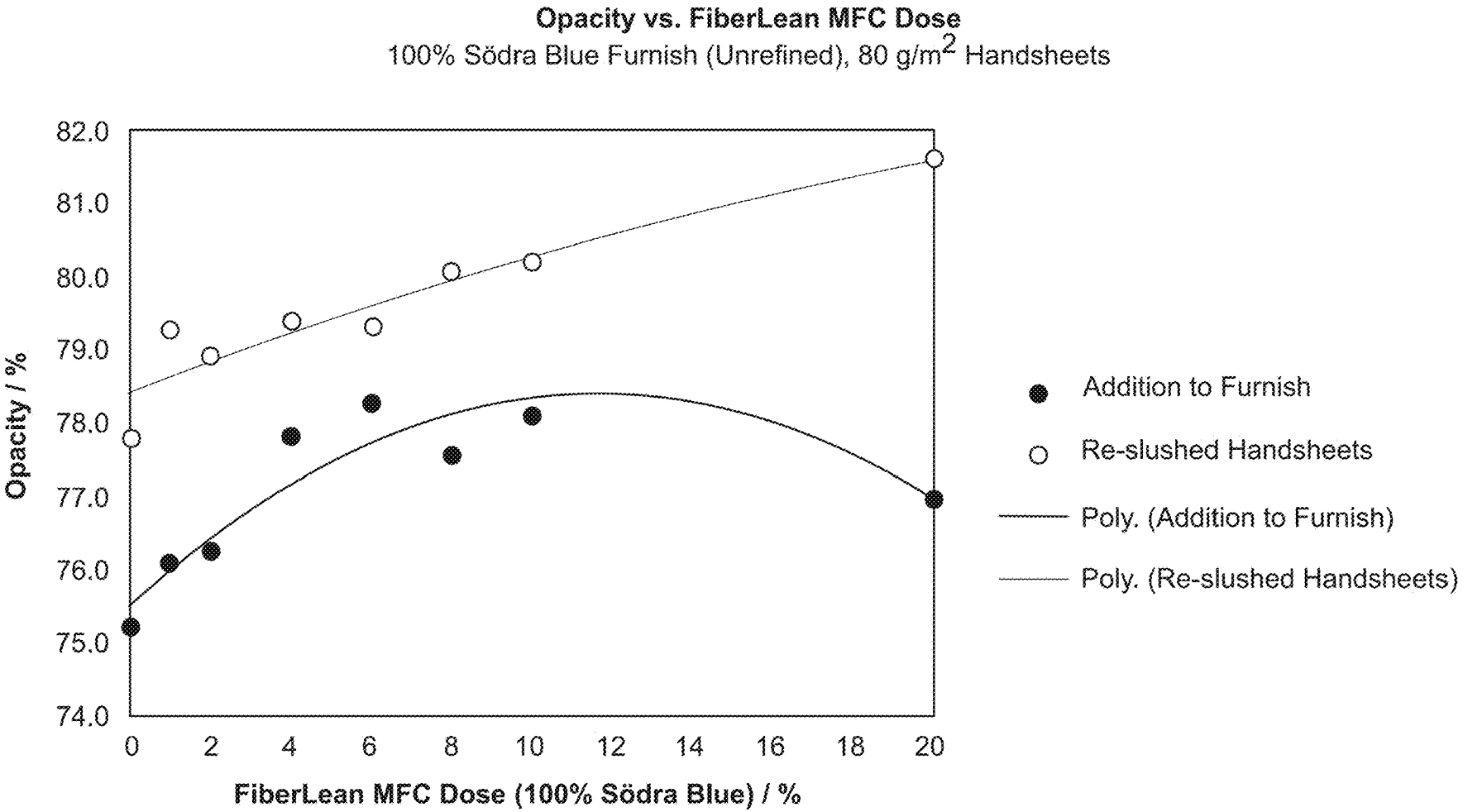
FIGS. 12A-D depict plots additional paper properties of handsheets where the MFC is added to the NSBK furnish (unrefined) before preparing handsheets at 80 g/m$^2$ and where the MFC-pulp composition is re-slushed and re-manufactured into handsheets at 80 g/m$^2$ versus MFC dosages of 0, 2, 4, 6, 8, 10, 12, 14, 16, 18, and 20 wt. %.
Figure 12B:
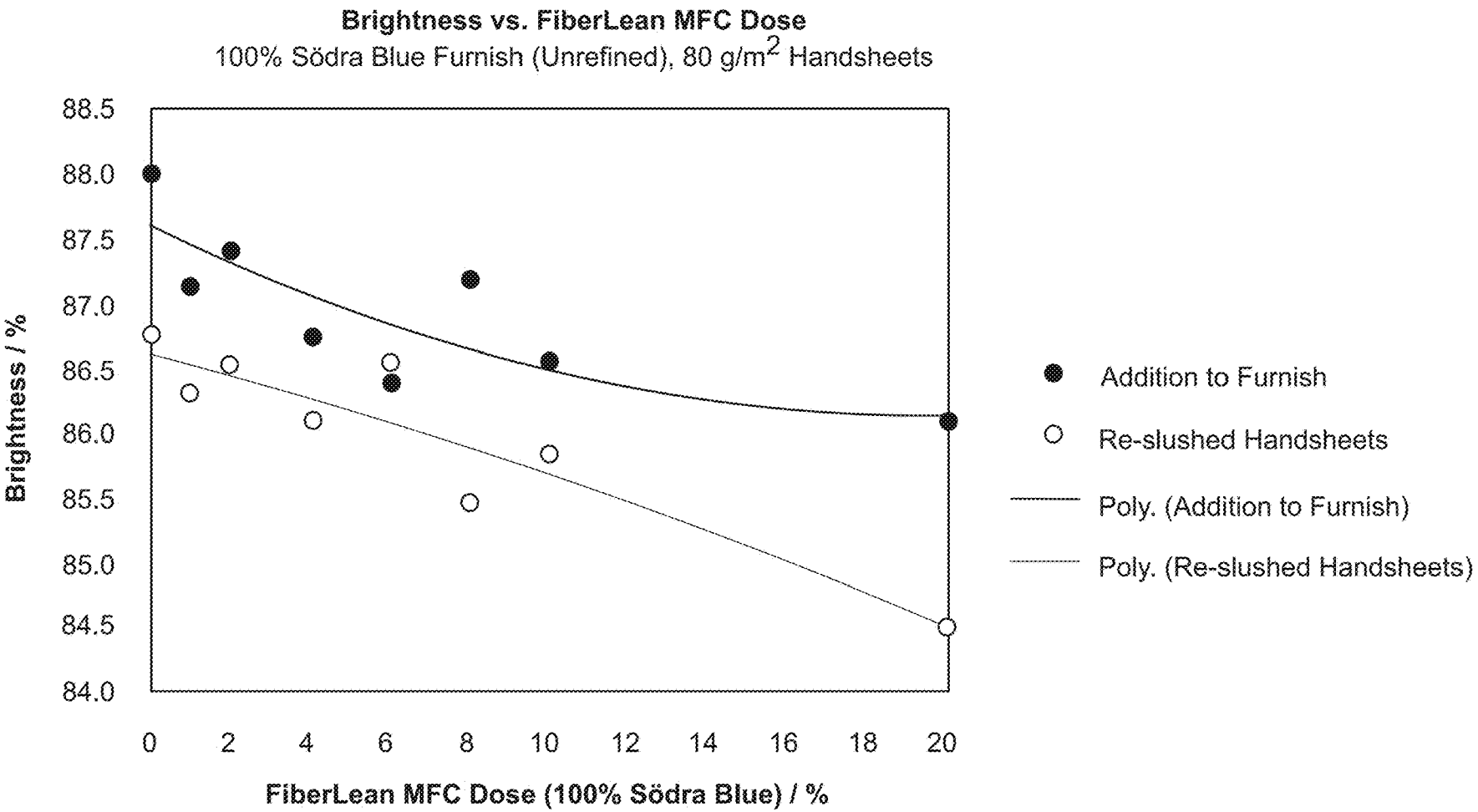
Figure 12C:
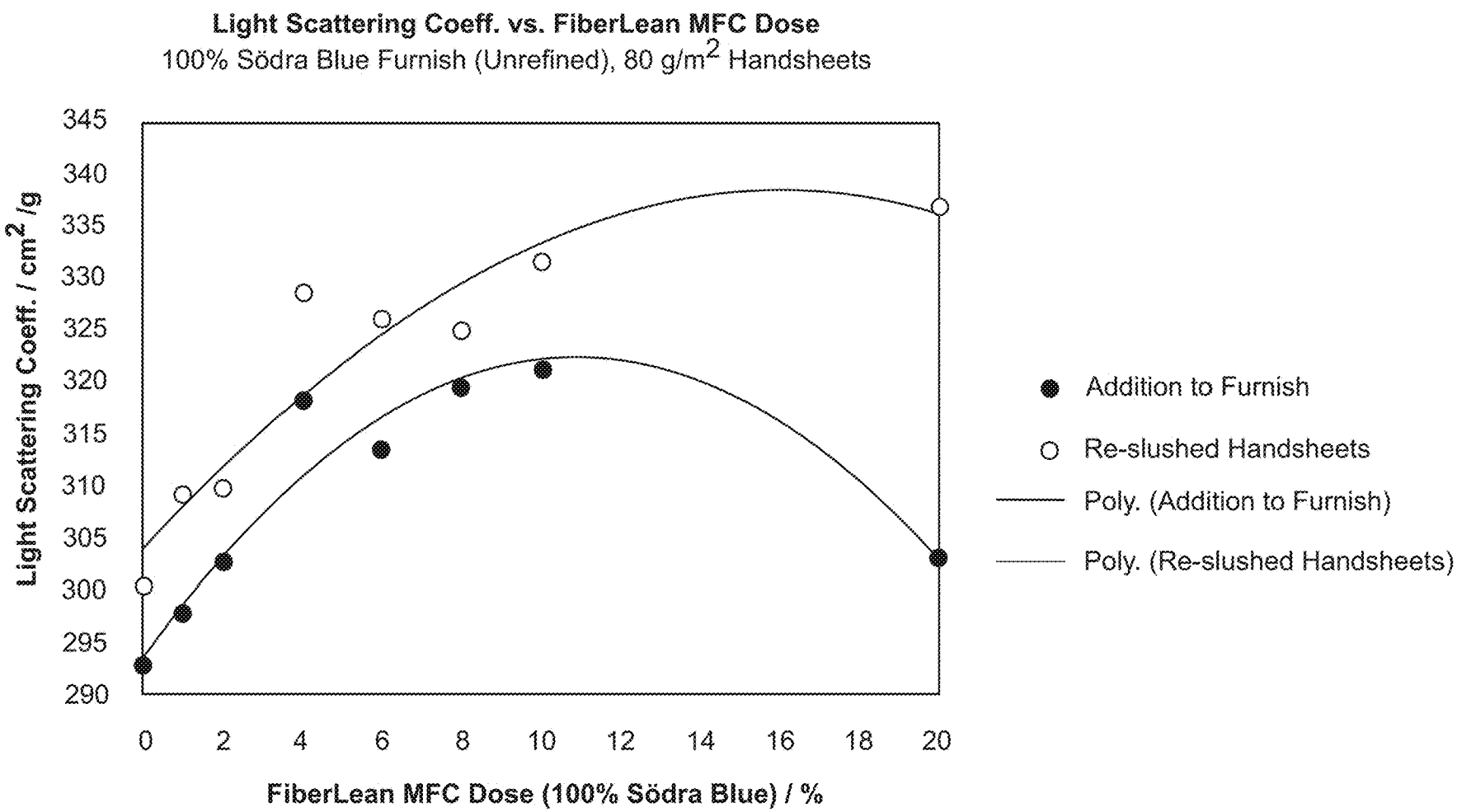
Figure 12D:
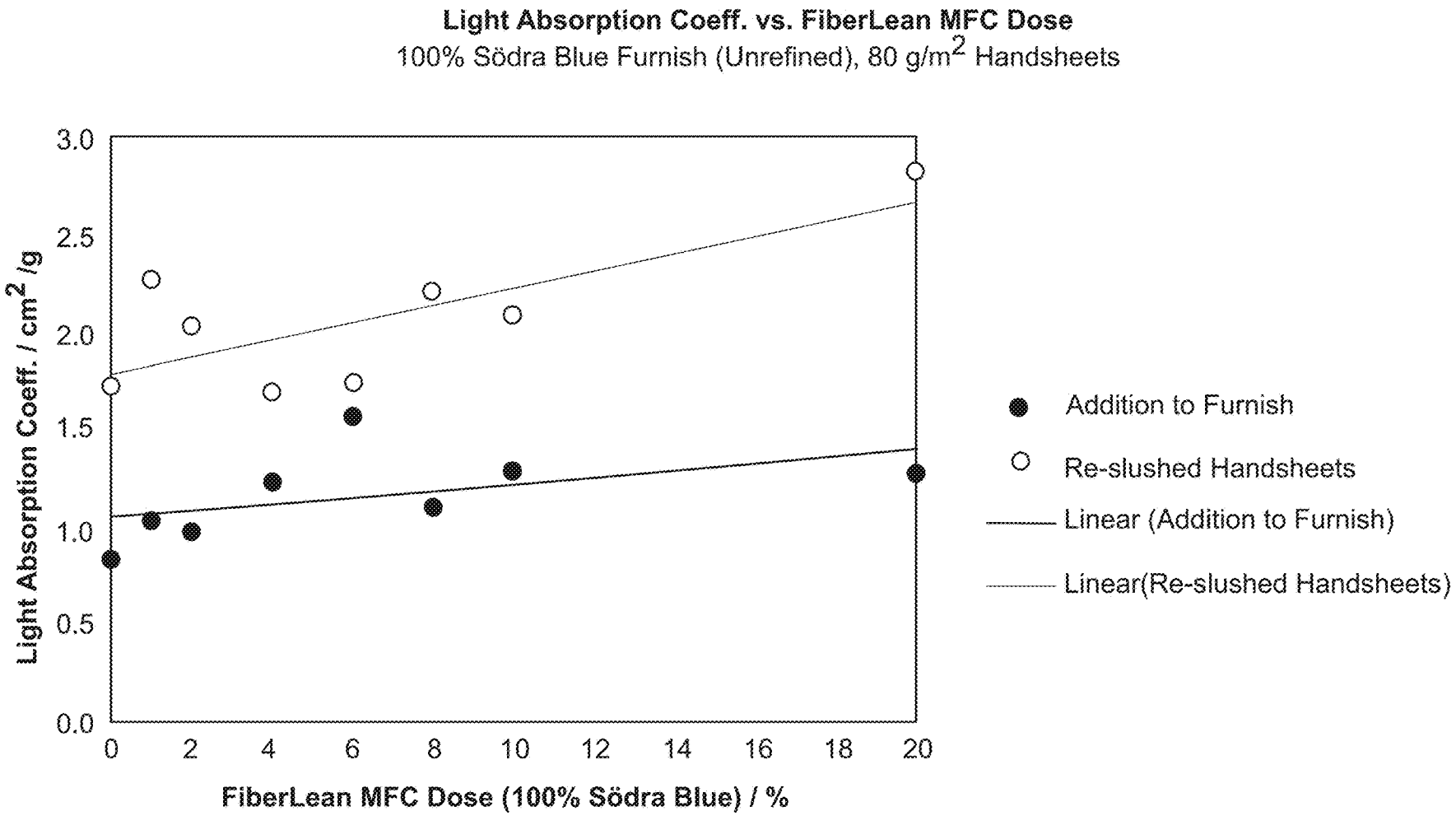

FIG. 6 shows the comparison between Sodra Blue pulp ground pulp at 1.5% and 2% fibre solids.

The furnish used for the Examples was 100% unrefined NBSK. Dry boards were received from the source and prepared into dilute pulp stock which was then blended with 100% percentage of pulp ("POP") microfibrillated cellulose prepared as described above. The experimental design is set forth in Table 5.

Table 5: Summary of the experimental design for the handsheet study:

100% unrefined Södra Blue furnish, 100% percentage of pulp ("POP") NBSK (Södra Blue) MFC, 8 trial points, 32 sheets at 80 g/m$^2$ per trial point formed through white water re-circulation on a Rapid Köthen sheet former (256 sheets total).

TABLE 5

Summary of the experimental design for the handsheet study

| Grade | Trial Point | FiberLean | Basic Weight g/m$^2$ | MFC Dose % | Target Filler Level % |
|---|---|---|---|---|---|
| 100% Södra Blue Pulp Sheets 80 g/m$^2$ | TP1 | No MFC | 80 | 0 | 0.0 |
| | TP2 | 100% POP | 80 | 1 | 0.0 |
| | TP3 | NSBK | 80 | 2 | 0.0 |
| | TP4 | (Södra | 80 | 4 | 0.0 |
| | TP5 | Blue) | 80 | 6 | 0.0 |
| | TP6 | FiberLean | 80 | 8 | 0.0 |
| | TP7 | | 80 | 10 | 0.0 |
| | TP8 | | 80 | 20 | 0.0 |

To ensure good retention, a cationic polyacrylamide retention aid (Percol 292NS, BASF) was added at a dosage of 0.03% based upon total sheet weight. This was added to the thinstock of each sheet directly before adding to the hand sheet former, and the white water obtained from each sheet for a given trial point was re-circulated and used to produce the subsequent sheets for that trial point. Based on previous experience it was assumed that the system reached a retention equilibrium by the latest sheet 7 for each trial point.

NBSK Pulp Preparation 400 g dry of sheeted pulp was added to 10 litres of filtered tap water (5 µm and 0.5 µm particle filters in series) and soaked overnight in a 25 litre bucket (~4% consistency).

An additional 12 litres of water was added (22 litres total volume, ~1.8% consistency), and then the pulp/water mixture was added to a laboratory valley beater.

The suspension was circulated for 15 minutes without the refining weight added, resulting in a pulp thickstock. Since the weight was not added, no refining took place. This step was only conducted to slush the pulp.

The thickstock was then discharged from the valley beater and stored in 25 litre barrels for subsequent use.

6 litres of thickstock was decanted into a second barrel and diluted up to 10 litres with filtered tap water (~1.1% consistency) and then mixed on a disintegrator for 10 minutes.

This was then diluted with an additional 10 litres of water to approximately ~0.54% consistency.

The actual consistency was measured, and the mixture was then diluted with filtered tap water as required to achieve 0.500% consistency thinstock (between 0.495%-0.505% was accepted).

The foregoing steps were repeated to create enough thinstock for the entirety of the study. The thinstock from each separate preparation were all mixed together to ensure homogeneity of the entire stock prior to starting handsheet forming.

Consistency Measurements

Representatively, 500 ml was sampled from the stock.

Ensuring the consistency former was clean and vacuum off, the chamber was clamped in place.

The 500 ml of pulp stock was poured through the consistency former over a distributor bar.

The vacuum was applied, until all of the water had passed through.

The drain water was relieved and passed back through (repeating steps 1 to 4) until the water was completely clear.

The chamber was unclamped and the mesh with the pad formed on it removed.

Two new blotting sheets were pressed against the consistency pad to remove as much water as possible.

The pulp pad was transferred to the L&W Rapid Drier and allow it to fully dry.

The pad was quickly removed from the Rapid Drier and weighed on an Analytical Balance (4 decimal places accuracy).

Immediately, the weight of the pad was recorded and it was possible to calculate The consistency using the equation below:

Consistency Calculation Example $$\text{Consistency (\%)} = \frac{\text{Weight of dry pad (g)}}{\text{Volume used (ml)}} \times 100$$

Example: 500 ml of stock was used and the pad weighs 1.7802 g. What is the consistency?

$$\text{Consistency (\%)} = \frac{1.7802}{500} \times 100$$

$$\text{Consistency} = 0.356\%$$

The procedure utilized for addition of the cationic polyacrylamide retention aid was as follows.

Preparation of Microfibrillated Cellulose Slurry

A slurry if microfibrillated cellulose was produced according to the procedure in Example 1.

Example 4: Preparation of Handsheets Produced from NBSK Pulp and MFC Produced from NBSK Pulp The sample for the handsheet study was received in a 2 litre bottle and measured for solids and POP.

The total solids content is the percentage mass of the material (mineral and fibre) remaining after it has been dried to zero moisture.

Example 5. Method for Total Solids

Estimate mass needed of sample so at least 1 g dry weight will be left at the end of the drying. Spread a portion of the slurry with a palette knife thinly and evenly onto the aluminum dish to provide a large surface area and thus expedite the drying process. Weigh the dish and the NSBK MFC slurry to 3 dp and record weight (W2). Place the dish in 130° C. moisture extraction oven to dry for a minimum of 90 minutes. Dryness is indicated by the absence of condensation on a sheet of glass at ambient temperature, held just above the surface of the material immediately after it has been removed from the drying oven. Remove dish and sample from the oven using tongs and cool in a desiccator. Record the weight of the dish and the dry sample to 3 dp (W3).

The total solids content 'TS' is expressed as the percentage mass of the MFC material and is given by the formula:

$$TS = \frac{(W3 - W1)}{(W2 - W1)} \times 100$$

Where W1=the weight of the aluminum sample dish as recorded in 4.2

W2=the weight of the slurry plus the sample dish as recorded in 4.5

W3=the weight of dried material plus sample dish recorded in 4.8

The standard deviation is 0.1 for total solids.

Example 6. Total Percentage of Pulp Calculation

The Total % POP was determined in the following manner.

The % POP (Percentage of Pulp) is the percentage mass of the total solids that is fibre.

An empty crucible to 4 dp was weighed. (W1). Immediately after the % solids determination takes place >1 g oven-dry product was added to the crucible and weighed to 4 dp (W2). Using the long handled tongs, the crucible was place in furnace at 950° C. for 30 mins and then removed and cooled in a desiccator, and thereafter reweighed to 4 dp. (W3).

The % POP is calculated in the following manner.

The percentage of pulp '% POP' is expressed as the percentage mass of the total solids that is fibre and is given by:

For example if the MFC is fibrillated with Kaolin $$\text{POP \%} = ((W2 - W1) - ((W3 - W1))/((1 - \text{LOI})))/((W2 - W1)) \times 100$$

Where W1=the weight of the crucible as recorded in 4.1

W2=the weight of the oven-dry product plus the crucible as recorded in 4.2

W3=the weight of ash plus crucible recorded in 4.4

LOI=loss on ignition factor (expressed as a fraction—e.g. 10% should be expressed as 0.1)

For kaolin, the typical loss on ignition factor at 950° C. is 0.14

For talc, the typical loss on ignition factor at 950° C. is 0.08

For calcined clay, the typical loss on ignition factor at 950° C. is zero

Ideally, the LOI of the specific mineral sample from which the sample was made should be measured, but typical values can be used instead where this is not available.

The standard deviation is 0.5 for % POP.

In the Examples, the % POP since no minerals were utilized in the fibrillation procedure.

Percol 292NS (Retention Aid) Preparation:

Percol 292NS (BASF) was prepared as a stock at 0.5% w/v solution, and then subsequent dilutions were made to 0.06% w/v for dosing to hand sheets in accordance with the following method: 97 ml of tap water was measured out into a plastic 100 ml measuring cylinder.

0.5 g±0.0050 g of Percol 292NS granules were weighed-out into a 150 ml glass beaker.

3 g±0.5 g of Industrial Methylated Spirit (IMS) was added.

The IMS was swirled around the granules to ensure they are all 'wetted'.

A magnetic follower was added and the beaker was positioned on a magnetic stirrer.

The magnetic stirrer was turned on and the 97 ml of water was added.

The speed was adjusted (increased) so that a vortex was formed.

The suspension was mixed for 1 hour (so that the granules were fully dissolved).

This stock (0.5%) was discarded after 5 days.

From the 0.5% stock, a dilution to 0.06% w/v was performed using additional tap water. E.g. For 500 ml of stock at 0.06%, 60 ml of 0.5% stock and 440 ml of water was required.

The solution was well mixed by shaking and transferred to a glass bottle-necked jar.

Manufacture of Handsheets

Sheet Making Calculation.

Addition quantities were calculated for each trial point depending on the experimental design/trial plan. The amounts required of each component in the sheet were calculated based on 100% retention of all components. The first step was to calculate the dry mass of the sheet (g) required for the target sheet weight (80 g/m$^2$). This was obtained by multiplying the target g/m$^2$ (80) by the handsheet area in m$^2$. The Rapid Köthen sheet formers make a sheet of 19.95 cm diameter (approximately 312.59 cm$^2$ or 0.031259 $m^2$). Therefore, the dry mass required for each sheet is the g/$m^2$ multiplied by 0.031259 (i.e. divided by 32).

Example—Targeting 80 g/$m^2$: (80)/32=2.5 g total dry mass. Based on this, if 10% MFC is required to be in the sheet, that is the equivalent to: 2.5×(10)/100=0.25 g of MFC Given that the remainder of the sheet was pulp fibre then this was equivalent to 2.5 g−0.25 g=2.25 g of fibre. Since the fibrous proportion of the sheet will take up moisture during air-conditioning, the moisture uptake in the fibres was factored into the calculations, so that if targeting a certain substance, it is reached after air conditioning. For this, typically a value of 3% moisture was used.

Continuing using the example above, and using 3% moisture, the mass of fibre becomes: Mass of fibre (g)=2.5×(1−(3/100)); Mass of pulp (g)=2.425.

The next step was to factor in the total solid contents and consistencies of the feed materials to convert between dry mass and wet mass.

After this, the amounts calculated for 1 sheet were multiplied by the number of sheets required for that trial point including equilibrium build-up sheets (32 sheets). This provided the recipe for the whole trial point, which is mixed together to produce a final stock for each trial point. This ensures continuity between the sheets within a series. Trial Point Stock Preparation:

Using the calculated quantities for a given trial point, the desired volume of pulp thinstock was measured-out using 500 ml, 1 litre and 2 litre measuring cylinders. This was added to a 10 litre bucket. Into a 100 ml plastic pot, weighed out to 0.1 g precision was the desired quantity of NBSK MFC using the top-pan balance. The NBSK MFC was adequately homogeneous when sampling by thorough shaking in a 2 litre bottle. A small amount of the pulp thinstock was added to the plastic pot containing NBSK MFC and mixed together until the mixture became dilute and there were no clusters of NBSK MFC. This step helped to disperse the NBSK MFC when adding it to the rest of the thinstock. If it was added at too high solids, it clumped together and not disperse homogeneously throughout the thinstock. Whilst stirring the rest of the thinstock, the plastic pot containing the diluted NBSK MFC was poured into the stock. The stock was thoroughly mixed; performing multiple bucket transfers assisted in good mixing. Typically, the stock needs to contain enough mixture for all of the sheets within a given trial point. Mixing the stock together in this way ensures continuity between the sheets of a trial point and thus reduces variation between sheets within the same set.

Handsheet Forming.

The Rapid Köthen sheet forming system (including re-circulation chamber) was cleaned thoroughly and wire mesh was jet washed. Calculated amounts of final stock were measured-out (containing pulp and NBSK MFC) for each sheet into a 500 ml plastic measuring cylinder.

The system was checked to be empty of any water, and then the system was switched to re-circulation mode. The forming chamber was closed and locked in place. Pressing the start button, sheet forming cycle started; the chamber began to fill with 7 litres of filtered tap water.

Whilst the chamber was filling, the retention aid was dosed (targeting 0.03% on total dry sheet weight) into the measuring cylinder. The measuring cylinder was inverted twice so that the mixture was homogeneous. Before the chamber was full, the mixture was added. The system was allowed to run its cycle (agitation 5 seconds, settling 5 seconds, and dewatering/drainage).

The chamber was opened and a carrier board was positioned on top of the freshly formed sheet.

Using the couch roll, the sheet was couched on the wire forward and back and then from side to side (once in each direction). While the sheet was being couched, the drain water was automatically pumped to the re-circulation tank. The sheet was removed from the wire and a cover was placed on top of the sheet and then positioned on the Rapid Köthen drier for 7 minutes (−0.9 Bar vacuum, 90° C.±2° C.). Once dry the sheet was removed and labelled.

Using re-circulation water, the steps were repeated until all the sheets for that trial point were made (32 in total).

Based on previous experience it was assumed that the white-water re-circulation system reached a retention equilibrium by sheet 7 for each trial point.

Paper Testing

The following tests were performed on sheets 8 to 12: Substance, Ash at 950° C., Bendtsen Porosity, PPS Roughness 1000 kPa and Caliper (for Bulk). Optical properties at −400 nm: Opacity Brightness, Whiteness, Yellowness, L*, a*, b*, Rx, Ry and Rz.

Mechanical Properties: Burst, Tensile, Tear and Scott Bond.

The remaining sheets (13 to 32) were then soaked in 8 litres of water (calculating to be approximately 0.625% consistency) overnight, and then slushed in a large disintegrator for 10 minutes. These re-pulped suspensions were then consumed to form an additional 12 sheets per trial point, which were then paper tested in accordance with the above list to evaluate the impact of drying/re-pulping of pulp sheets containing MFC.

The pulp stocks of all the trial points were analyzed in terms of Drainability (CSF/SR and handsheet former drainage time) and fibre properties according to a Valmet FS5 Fibre Analyzer.

Canadian Standard Freeness (CSF) Measurements.

Approximately 450 ml of 'Thickstock' was taken from the valley beater or stock bucket 2 litres of filtered tap water was added. This was transferred to the small bench top disintegrator and mixed for 600 counts. The consistency of the pulp was measured and diluted using additional filtered tap water to precisely 0.3%±0.05% consistency. A thermometer was positioned in the stock and left it for 2 minutes to obtain the temperature. The CSF instrument was visually checked to ensure it was fully clean (i.e. there were no dried lumps of pulp blocking the outlet holes at the bottom). The bottom flap was closed. 1 litre of water was added to the chamber and the top flap closed. The tap on the top flap was closed. The bottom flap was opened and a 1 litre measuring cylinder was secured underneath the side-outlet to capture the water. The tap on the top flap was opened and the water passed through. The steps above were repeat steps using the stock at 0.3% consistency instead of water. A reading was taken from the cylinder at the side outlet and the temperature correlation chart was used to correct for temperature variation. The CSF was recorded.

Results & Discussion

Sheet-Making and Handsheet Composition

The actual basis weight and filler contents achieved for each trial point are shown in Table. The filler contents were as per residual ash found in pulp, therefore the addition of 100% POP FiberLean did not increase the ash content (as expected). The basis weights were in some cases considerably higher than the targets. The explanation for this is that the pulp was unrefined and therefore flocculated in terms of its handleability, which introduced greater error than usual when sampling. Given that the basis weight-dependant properties can be represented as indices, the subtle variations in basis weight can be reliably accounted for and the analysis is not hindered by the variation.

TABLE 6

Summary of average basis weights and filler contents achieved for each trial point.

Measured Values: Part One-Addition to Pulp

| Trail Point # | MFC Dose % | MFC Type | Target Basis Weight g/m$^2$ | Target Filler Content % | Actual Basis Weight g/m$^2$ | Actual Filler Content % | Difference in Basis Weight g/m$^2$ | Difference in Filler Content % |
|---|---|---|---|---|---|---|---|---|
| TP1 | 0 | No MFC | 80 | 0 | 85.1 | 0.1 | 5.1 | 0.1 |
| TP2 | 1 | Mineral | 80 | 0 | 82.9 | 0.2 | 2.9 | 0.2 |
| TP3 | 2 | Free | 80 | 0 | 87.8 | 0.1 | 7.8 | 0.1 |
| TP4 | 4 | Södra | 80 | 0 | 84.3 | 0.2 | 4.3 | 0.2 |
| TP5 | 6 | Blue | 80 | 0 | 88.4 | 0.1 | 8.4 | 0.1 |
| TP6 | 8 | | 80 | 0 | 86.0 | 0.2 | 6.0 | 0.2 |
| TP7 | 10 | | 80 | 0 | 85.6 | 0.2 | 5.6 | 0.2 |
| TP8 | 20 | | 80 | 0 | 82.4 | 0.2 | 2.4 | 0.2 |
| | | | | | Average | | 5.3 | 0.2 |
| | | | | | Standard deviation | | 2.1 | 0.0 |

Measured Values: Part Two-Re-slushed Handsets

| Trail Point # | MFC Dose % | MFC Type | Target Basis Weight g/m$^2$ | Target Filler Content % | Actual Basis Weight g/m$^2$ | Actual Filler Content % | Difference in Basis Weight g/m$^2$ | Difference in Filler Content % |
|---|---|---|---|---|---|---|---|---|
| TP1 | 0 | No MFC | 80 | 0 | 93.2 | 0.2 | 13.2 | 0.2 |
| TP2 | 1 | Mineral | 80 | 0 | 84.4 | 0.1 | 4.4 | 0.1 |
| TP3 | 2 | Free | 80 | 0 | 79.1 | 0.2 | −0.9 | 0.2 |
| TP4 | 4 | Södra | 80 | 0 | 81.8 | 0.2 | 1.8 | 0.2 |
| TPS | 6 | Blue | 80 | 0 | 81.5 | 0.2 | 1.5 | 0.2 |
| TP6 | 8 | | 80 | 0 | 80.6 | 0.1 | 0.6 | 0.1 |
| TP7 | 10 | | 80 | 0 | 90.2 | 0.2 | 10.2 | 0.2 |
| TP8 | 20 | | 80 | 0 | 84.8 | 0.2 | 4.8 | 0.2 |
| | | | | | Average | | 4.5 | 0.2 |
| | | | | | Standard deviation | | 4.9 | 0.0 |

Drainability and Fibre Properties.

The drainability results and fibre properties versus increasing MFC dose are shown in FIG. 7 and FIG. 8. The results demonstrate that the addition of MFC reduces drainability (increase in sheet former drainage time, reduction in CSF/increase in Schopper Riegler), as expected. However, drying and re-pulping decreases drainage time slightly but there is still an increase observed through the addition of MFC.

The ash content remains unchanged versus baseline residual ash that occurs in the pulp with increasing MFC addition.

Addition of MFC reduces the average fibre length and optical coarseness, whereas fibrillation increases. This is to be expected due to the unrefined fibres being replaced by fibrillated cellulose, MFC. The measurement of fibre width does not change with MFC addition. Drying and re-pulping reduces the fibre width and fibrillation slightly but does not affect the fibre length and optical coarseness. The fibrillation trend with increasing MFC addition remains the same in terms of its steepness.

Considering that the trend of increasing drainage time with MFC addition is less-steep once a drying and re-pulping step has occurred (particularly at higher MFC doses, >10%), the data collectively demonstrates that even if there are some losses in the impact from MFC upon drying and re-pulping there is still substantial enhancement versus the reference condition achievable when using MFC.

Paper Properties

The paper property results versus MFC dose for the addition to the furnish and re-slushed handsheets are shown in FIGS. 9 to 12.

The results shown in FIGS. 9 to 12 demonstrate that the addition of MFC to the NBSK furnish and the formation of handsheets from the furnish have increased mechanical properties and opacity. The handsheets also demonstrated reduced brightness, porosity, bulk and roughness.

When the foregoing handsheets were dried and re-pulped, the mechanical properties were diminished, but still showed substantial improvements in mechanical properties with increasing MFC dosages. The trends showing increased mechanical improvements with the addition of MFC were diminished most regarding Scott Bond measurements and less so with burst index and tensile properties. Interestingly there was no change to trend steepness for Tear Index. Roughness measurements were essentially unchanged and the improvements brought about by the addition of MFC were maintained. Similarly increases in bulk and porosity in handsheets containing MFC were similarly maintained. Finally, increases in opacity, light absorption and light scattering coefficients were recorded, as was a reduction in brightness.

The percentage changes to sheet properties relative to the 0% MFC reference condition when using 2% MFC are summarised in Table 7 below.

The results of the foregoing Examples 1 to 4 is that the addition of MFC to pulp sheets resulted in increases to mechanical properties and opacity. Drainability, bulk, porosity and roughness were reduced and there was also a marginal reduction in brightness.

Upon drying and re-pulping of the MFC containing sheets, some of the impact from the MFC was diminished; however, there were still substantial changes versus the 0%

MFC reference example, which demonstrates that a reasonable enhancement from the MFC can still be achieved after a cycle of drying and re-pulping.

Extending the range of MFC doses up to 10% or even 20% MFC had a profound impact on the pulp properties. Interestingly, by way of comparison, an improvement in tear index cannot be achieved through refining (usually a loss is observed), and the negative impact on bulk from the MFC is typically less than what is observed through refining.

TABLE 7

Percentage changes to sheet properties versus the 0% MFC reference conditions when using 2% MFC.

| Sheet Property | Percent Change from 0% MFC Reference When Using 2% MFC/% | |
|---|---|---|
| | Addition to Furnish | Dried/ Re-slushed Handsets |
| Bendtsen Porosity | −26 | −22 |
| PPS Roughness 1000 kPA | −5 | −5 |
| Bulk | −1.3 | −1.1 |
| Brightness (Absolute Units) | 00.3 | −.02 |
| Opacity (Absolute Units) | 0.9 | 0.5 |
| Drainage Time (sheet former) | 11 | 9 |
| Burst Index | 48 | 40 |
| Scott Bond | 45 | 31 |
| Breaking Energy | 109 | 77 |
| Breaking Elongation | 19 | 22 |
| Tensile Index | 23 | 22 |
| Tear Index | 28 | 37 |

The foregoing suggests that an MFC-containing pulp product may require less or even no refining to achieve desired properties (depending on the MFC dose used), whilst having superior bulk and tear Index. This observation combined with the observations of MFC enhancements upon drying and re-pulping suggests that MFC is an interesting approach to expand the consumption and accessibility of MFC in the market.

FIG. 13 sets forth the fibre analysis data recorded with the Valmet FS5 fibre analyzer.

Example 7

Particle size distribution as measured by Malvern Insitec L light scattering device. The particle size determinations were made in the following manner. This technique utilizes a Malvern Insitec laser diffraction instrument to obtain particle size information about kaolin and calcium carbonate based FiberLean samples.

Ensure that the MFC slurry is homogeneous by shaking the container contents vigorously. If grinding media is present in the sample use an 850 micron screen to remove the grinding media before running the Malvern analysis. If no grinding medium is present pipette the slurry from the sample. Switch the Malver Insitec unit on and start the pump by pressing The pump speed on/off button on top of the Malvern unit and set the speed at 2500 rpm and that and that the ultrasonic is off. Ensure that the Malvern Insitec is clean by flushing the unit 2-3 times with clean, room temperature water ±5° C. Raise the stirrer to the marked drain position and remove the outlet hose and syphon the solution from the system ensuring that the inlet hose is lifted to drain any trapped solution. Replace water with clean room temperature tap water ±5° C. (800 ml to 900 ml). Fully push down the Malvern stirrer and the pump will start automatically. If the water is very turbulent turn the pump off and on again to help settle the water. Lift the outlet hose to remove any trapped air.

Example 8

Determination of low shear viscosity using Brookfield vane spindle. The following describes a viscosity test used in the Examples employing a rookfiled R.V. viscometer (or similar instrument) utilizing Van spindle V-73 for MFC samples at 1.0% fibre solids. Reagent include tap water and the sample, as typically received, is approximately 2.0% fibre solids. The sample is shaken to ensure homogeneity. The MFC composition is prepared to the specified concentration by diluting with water. Temperature is maintain between 20° and 30° by applying heating or cooling. The pot containing the MFC composition is mixed thoroughly. The Vane is attached to the viscometer and set for 10 rpm. The spindle is allowed to rotate for 30 seconds after starting the test. The viscometer reading is recorded at 30 seconds after start. The viscosity of the MFC composition is expressed in millipascal-second (mPa.$). On digital viscometers it is read directly from the display. The Test is performed in compliance with ISO9001.

The dilution calculation is performed in the following manner.

$$FS+TS\times POP/100$$

Where FS=% Fibre solids; TS=% Total solids (Example 5); and POP=% Pulp on Product (Example 6).

Fibre solids is calculated according to the following equation:

$$FS=TS\times POP/100$$

Where FS=% Fibre Solids; TS—% Total Solids and POP=% Pulp on Product.

The Dilution Calculation determine the volume of water required to obtain a desired fibre solids of R, which is calculated in the following manner.

$$V=(\mathrm{FS}-R)\times W/R$$

Where V—volume of water required
FS=Initial wt % Fibre Solids
R=Required wt. % Fibre Solids.

Example 9. Operation of Sedigraph

Unless otherwise stated, particle size properties referred to herein for the inorganic particulate materials are as measured in a well-known manner by sedimentation of the particulate material in a fully dispersed condition in an aqueous medium using a Sedigraph 5100 machine as supplied by Micromeritics Instruments Corporation, Norcross, Ga., USA (telephone: +1 770 662 3620; web-site: www.micromeritics.com), referred to herein as a "Micromeritics Sedigraph 5100 unit". Such a machine provides measurements and a plot of the cumulative percentage by weight of particles having a size, referred to in the art as the 'equivalent spherical diameter' (e.s.d), less than given e.s.d values. The mean particle size $d_{50}$ is the value determined in this way of the particle e.s.d at which there are 50% by weight of the particles which have an equivalent spherical diameter less than that $d_{50}$ value.

For the determination of the weight median particle size $d_{50}$, for particles having a $d_{50}$ greater than 0.5 μm, a Sedigraph 5100 device from the company Micromeritics, USA may be used. The measurement may be performed in an aqueous solution of 0.1 wt-% $Na_4P_2O_7$. The samples may be dispersed using a high-speed stirrer and ultrasound. For the determination of the volume median particle size for particles having a $d_{50} \leq 500$ nm, a Malvern Mastersizer from the company Malvern, UK may be used. The measurement may be performed in an aqueous solution of 0.1 wt % $Na_4P_2O_7$. The samples may be dispersed using a high-speed stirrer and ultrasound. The Sedigraph 5100 provides measurements and a plot of the cumulative percentage by weight of particles having a size, referred to in the art as the "equivalent spherical diameter," or "esd.".

Example 10

Preparation and testing of 100 wt. % microfibrillated cellulose formed into sheets and redispersed and reformed into handsheets having enhanced mechanical properties, including enhanced tensile strength properties. The objective of this Example was to re-disperse 100% MFC sheets utilizing simpler equipment and lower energy inputs.

The mineral used was a Ground Calcium Carbonate supplied by Imerys Minerals called Intracarb 60 (IC60). This material is a marble-based, wet ground product that has a particle size of 60% less than 2 μm as determined by a Micromeretics Sedigraph particle size analyser. The procedure for the Micromeretics Sedigraph is given in Example 9.

The pulp utilized in this Example was Bleached Softwood Kraft Pulp and is called Botnia Nordic Pine RMA. The pulp was 70-100% Pine and 0-30% Spruce.

The pulping procedure utilized was: 2,700 litres water was added to the Pulper and after mixing starts, then one 250 kg bale of pulp was added to the Pulper followed by a further 2,700 litres water. The composition was mixed for 40 mins before discharge to the Pulp tank. The Total solids was 4% solids.

The MFC was produced by wet attrition milling of the cellulose-containing pulp in the presence of ceramic grinding material. The MFC slurry was prepared from IC60 ground calcium carbonate (GCC) and Botnia Pine RMA90 Pulp.

The resulting MFC product was analyzed for Total Solids content of the slurry (Example 5); the % POP (Percentage of Pulp) (Example 6); particle size distribution by Malvern Insitec L (Example 7); low shear viscosity (Example 8) and FLT Sheet Tensile Strength (Example 2). Sheets of MFC were produced by following the procedure described in the FiberLean sheet tensile procedure (Example 2) except that there was no dilution with mineral to 20 wt. % POP and that various amounts of slurry were used to produce different sheet weights.

The IC60/Botnia slurry had a total solids content of 1.7 wt. % (as measured in method described in Example 5 and a POP value of 50.0 wt. % (as measured according to the method of Example 6.

Example 11

This experiment was to use 150 g of the 1.7 wt. % solids 50 wt. % POP IC60/Botnia FiberLean. Sheets of FiberLean (of approximate weight 4.4 g) were produced by following the procedure described in the FiberLean sheet tensile procedure (Example 2) except that there was no dilution with mineral to 20 wt. % POP and that 150 g of the slurry was used. The resultant sheets were dried for various times on the Rapid Kothen drier as described in Example 2 to give sheets having a range of solids contents.

These sheets had their total solids content measured (see Example 5) so that the sheets could be re-wetted and tested for strength. The semi dry sheets were made down into 6.25 wt. % solids slurry at 20 wt. % POP (IC60 mineral used for dilution) using a laboratory Silverson mixer.

The Silverson mixer was used as a laboratory scale disperser to disperse a MFC pressed cake material into a slurry by application of high shear. The procedure employed was the following. Place an empty, clean poise pot on the balance and tare. Weigh out the required mass, of MFC press-cake material into the poise pot. Based on the mass in the pot, and depending on the % POP, dilute using water and respective. Mix on the Silverson, fitted with high shear square holed head, for 1 minute on 75% power, hold the poise pot at an angle to ensure a good flow regime in the poise pot, The slurries were then made into sheets once again following the procedure described in Example 2.

Figure 14:
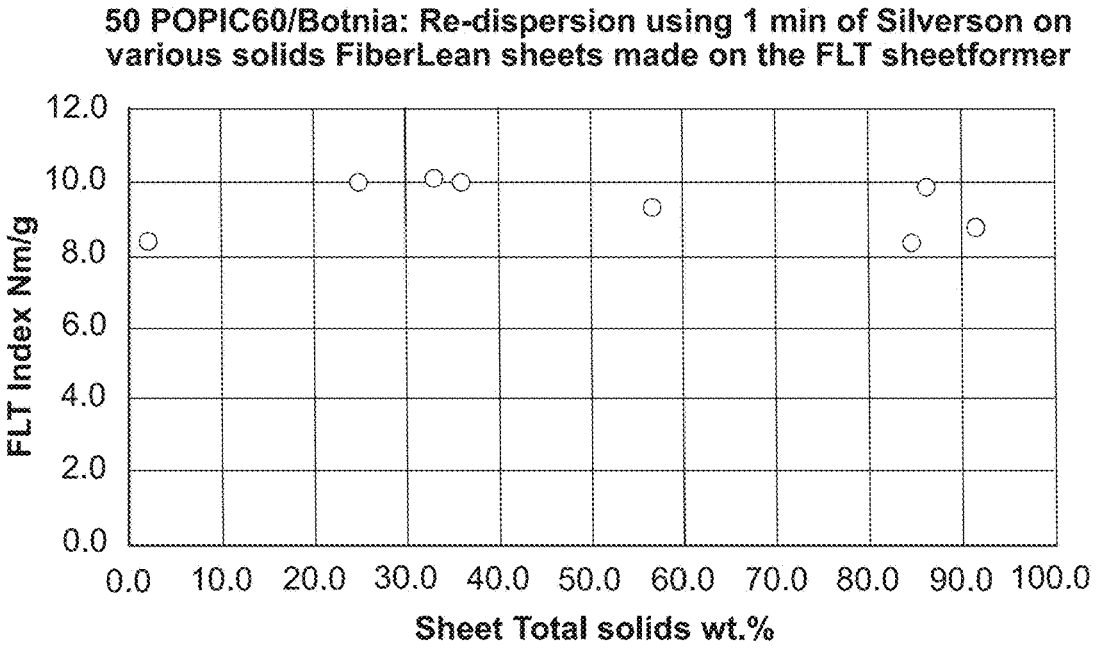
FIG. 14 depicts the initial properties of the MFC sheets.

FIG. 14 shows the Tensile strength (FLT Index) of the control and of the re-suspended semi dry sheets as measured in accordance with Example 2. These data indicate that the semi-dry sheets have FLT indices that are no lower than that of the control slurry prior to drying thus indicating that sheets of MFC can be re-suspended to the original FLT Index. These data show that FiberLean can be dried into sheets, easily re-dispersed, and the tensile strength does not suffer. At a commercial scale the Silverson mixer would be substituted with a commercial grade high shear disperser.

Example 12

The initial experiment of Example 11 was repeated.

This experiment used 150 g of the 1.7 wt. % solids 50 wt. % POP IC60/Botnia MFC. Sheets of MFC (of approximate weight 4.4 g) were produced by following the procedure described in the FiberLean sheet tensile procedure (Example 2) except that there was no dilution with mineral to 20 wt. % POP and that 150 g of the slurry was used. The resultant sheets were dried for various times on the Rapid Kothen drier as described in Example 2.

The sheets had their total solids content measured (see Example 5) so that the sheets could be re-wetted and tested for strength. The semi dry sheets were made down into 6.25 wt. % solids slurry at 20 wt. % POP (IC60 mineral used for dilution) using a laboratory Silverson mixer (as set forth above in Example 11). The slurries were then made into sheets once again following the procedure described in Example 2. The Brookfield viscosity was measured on the re-dispersed slurry using the method described in Example 8.

The TAPPI T 537Dirt count in paper and paperboard (optical character recognition—OCR) was measured on a 220 gsm FLT sheet measured in a 51.2×51.2 mm square The procedure is standard test known in the art for determining dirt in paper according to Test Method TAPPI/ANSI 437 om, −12.

Figure 15:
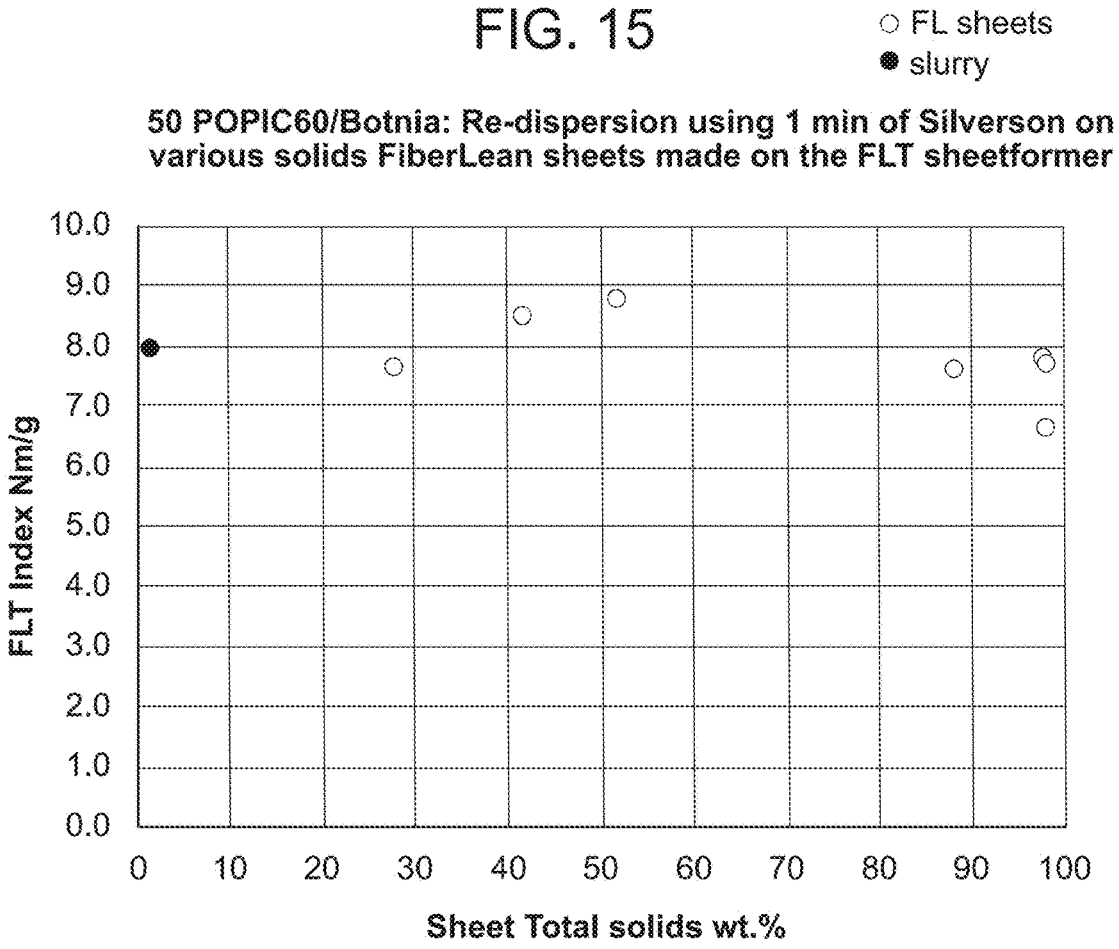
FIG. 15 depicts the properties of the MFC sheets.

Table 8 highlights the full set of data and FIG. 15 shows the tensile strength data.

| Sample | Drying Time Second | Total Solids Wt. % | FLT Index Nm/g | Viscosity mPas | FLT Tappi Count 51.2 × 51.2 ($mm^2$) 0.04 | 0.15 | 0.4 |
|---|---|---|---|---|---|---|---|
| Slurry as received | | 1.8 | 8.4 | 580 | 2 | 0 | 0 |
| 50 POP | 30 | 41.4 | 8.5 | 2040 | 4 | 0 | 0 |
| IC60/Botnia | 60 | 51.5 | 8.8 | 1940 | 2 | 0 | 0 |
| slurry | 120 | 88.1 | 7.7 | 1700 | 4 | 0 | 0 |
| | 180 | 97.9 | 7.7 | 1460 | 5 | 0 | 0 |
| | 240 | 97.5 | 7.8 | 1460 | 4 | 0 | 0 |

These data indicate that the FLT tensile strength of the re-suspended sheets are no worse than the slurry prior to drying thus indicating that sheets of MFC can be re-suspended to the original FLT Index using a simple re-suspension protocol. The Brookfield viscosity and TAPPI dirt count are no worse than the original samples prior to drying

Example 13

This experiment used 750 g of the 1.7 wt. % solids 50 wt. % POP IC60/Botnia MFC. Sheets of MFC (of approximate weight 22 g) were produced by following the procedure described in the FiberLean sheet tensile procedure (Example 2) except that there was no dilution with mineral to 20 wt. % POP and that 750 g of the slurry was used. The resultant sheets were dried for various times on the Rapid Kothen drier as described in Example 2.

These sheets had their total solids content measured (see Example 5) so that the sheets could be re-wetted and tested for strength. The semi dry sheets were made down into 6.25 wt. % solids slurry at 20 wt. % POP (IC60 mineral used for dilution) using a laboratory Silverson mixer (see Procedure in Example 11).

The slurries were then made into sheets once again following the procedure described in Example 2.

The data are shown in Table 9. These data indicate that the properties of the resuspended sheets are no worse than the slurry prior to drying thus indicating that sheets of MFC can be re-suspended to the original FLT Index using a simple re-suspension procedure. The Brookfield viscosity and TAPPI count are no worse than the original sample prior to drying.

TABLE 9

Properties of the MFC sheets (750 g)

| Sample | Drying Time Second | Total Solids Wt. % | FLT Index Nm/g | Viscosity mPas | FLT Tappi Count 51.2 × 51.2 ($mm^2$) 0.04 | 0.15 | 0.4 |
|---|---|---|---|---|---|---|---|
| Slurry as received | | 1.8 | 8.4 | 580 | 2 | 0 | 0 |
| 50 POP | 0 | 26.2 | 9.1 | 2060 | 4 | 0 | 0 |
| IC60/ | 30 | 34.7 | 8.9 | 2120 | 4 | 0 | 0 |
| Botnia slurry | 60 | 37.4 | 9.0 | 1940 | 3 | 0 | 0 |
| (750 g) | 120 | 36.5 | 8.5 | 2080 | 3 | 0 | 0 |
| | 180 | 40.6 | 9.1 | 2040 | 3 | 0 | 0 |
| | 240 | 39.9 | 9.0 | 2120 | 5 | 0 | 0 |
| | 300 | 47.4 | 9.2 | 2100 | 4 | 0 | 0 |
| | 600 | 76.7 | 8.5 | 2080 | 3 | 0 | 0 |

Example 14

This experiment used 1500 g of the 1.7 wt. % solids 50 wt. % POP IC60/Botnia MFC. Sheets of MFC (of approximate weight 44 g) were produced by following the procedure described in Example 2, except that there was no dilution with mineral to 20 wt. % POP and that 1500 g of the slurry was used. The resultant sheets were dried for various times on the Rapid Kothen drier as described in Example 2.

These sheets had their total solids content measured (see Example 5) so that the sheets could be re-wetted and tested for strength. The semi dry sheets were made down into 6.25 wt. % solids slurry at 20 wt. % POP (IC60 mineral used for dilution) using a laboratory Silverson mixer (see procedure described in Example 11). These slurries were then made into sheets once again following the procedure described in Example 2.

The data are shown in Table 10. These data indicate that the properties of these re-suspended sheets are no worse than the slurry prior to drying thus indicating that sheets of MFC can be re-suspended to the original FLT Index using a simple procedure. The Brookfield viscosity is no worse than the original sample prior to drying.

TABLE 10

Properties of the MFC sheets (1500 g)

| Sample | Drying Time seconds | Total solids Wt. % | FLT Index Mn/g | Viscosity mPas |
|---|---|---|---|---|
| Slurry as received | | 1.8 | 8.4 | 580 |
| 50 POP | 0 | 10.1 | 8.2 | 2200 |

TABLE 10-continued

| Properties of the MFC sheets (1500 g) | | | | |
|---|---|---|---|---|
| Sample | Drying Time seconds | Total solids Wt. % | FLT Index Mn/g | Viscosity mPas |
| IC60/Botnia slurry (1500 g) | 30 | 27.4 | 8.4 | 1900 |
| | 60 | 31.9 | 8.2 | 2080 |
| | 120 | 33.5 | 8.4 | 2140 |
| | 180 | 32.6 | 8.4 | 2320 |
| | 240 | 33.7 | 8.8 | 2340 |
| | 300 | 40.4 | 8.8 | 2600 |
| | 600 | 87.3 | 7.8 | 2100 |

The production of 100% MFC sheets at a variety of final solids contents is possible. Sheets made with 50 wt. % POP GCC/NBSK can be re-dispersed back to the original slurry's strength properties at various sheet weights.

Example 15. Nib Count Procedure

Nibs are agglomerated clusters of particles formed during pressing and/or drying of an MFC slurry. Most of the pressed/dried material is re-dispersible through the application of standard mixing followed by high shear, however, depending on the conditions and technologies used to press/dry/re-disperse the product, a population of nibs can remain present. Typically, the most challenging nib fraction to fully re-disperse are nibs with a diameter between 80-200 μm. Due to the size of this nib fraction relative to the surrounding microfibril networks, it is not possible to screen the nibs out without also removing fibrous material. The overall content of nibs present in the final re-dispersed slurry is managed through optimization of the re-dispersion methods used. The acceptable quantity and size of nibs in the product varies from application to application.

The purpose of this method is to quantify and measure the size of nibs within a 100 mm×25 mm area of 220±10 g/m$^2$, 20.0%±0.5% POP FLT sheets. To do this, MFC sheets are scanned using a flat-bed scanner (similar to those used in photography) in black and white (grayscale) transmission mode (viewing through the sample specimen). When viewed in this way the nibs appear as dark dots. Using image analysis software, the dark dots (nibs) can be distinguished against the lighter background, and therefore quantified and measured for size automatically without the need for human interpretation.

For MFC Sheets with Basis Weight and POP within the tolerances stated above (i.e. for standard MFC sheets), results can be considered absolute and therefore comparison between studies is possible. Samples analysed at alternative POP and Basis Weight should be compared relative to a control condition, typically a corresponding slurry sample prior to any pressing/drying. For samples of differing mineral/pulp type, different settings will be required due to differing FLT sheet Brightness. Guidance to obtain the settings is described in this method, as well as a table of 'known' settings for commonly used mineral types.

Apparatus, Equipment, Consumables & Services

Epson Perfection V600 Photo Scanner.

A4 size Displaypro Clear Acrylic Perspex Sheet/Panel (297 mm×210 mm) in 5 mm thickness.

Laptop or desktop (with a monitor, mouse and keyboard). N.B.: Monitor needs to be in good enough condition so images can be viewed clearly.

Cardboard stencil cut-out to ensure adequate positioning of the scanned area.

Air-conditioned laboratory (23.0° C.±2.0° C., 50% R.H.±5% R.H.). N.B.: This is not essential for the scanning and is only required to check the Basis Weight of the MFC Sheet.

4-figure Analytical Balance. N.B.: This is not essential for the scanning and is only required to check the Basis Weight of the MFC Sheet.

Software

Latest Epson Scanner Drivers relevant to model purchased.

ImageJ Image Analysis Software available at: https://imagej.nih.gov/ij/download.html Up-to-date Microsoft Office platform (Office 365 or sooner)—for reporting purposes only.

'Nib Calculation' Excel Spreadsheet

Air-condition MFC sheet for at least 20 minutes and weigh using the 4-figure analytical balance to ensure sheet Basis Weight is within target range. Turn on Scanner using the on/off switch and remove top panel. Open the EPSON Scan app.

Set for app for "Professional Mode". Select from the "Settings" drop-down list the pre-defined settings required for use (this varies for each POP/Mineral/Pulp type). Ensure the glass of the scanner is clean of any grease (finger prints etc.), debris, dust and scratches using the lens cleaning cloth. Ensure the Perspex sheet is also clean as per the details above. Position the card, MFC sheet (with the smoothest side of the sheet facing down).

Scanning: For the first scan of a batch of samples with like composition, run a 'Preview' (red arrow) and open the 'Histogram Adjustment' (green arrow) to check the settings match those tabulated in the 'Settings' section for the chosen mineral/pulp/POP (example shows H60 GCC 20% POP) and that the peak is positioned with the grey triangle approximately in the middle of the peak and black and white triangles are positioned approximately even spacing either side of the peak IF the settings do not match the peak positioning, then it is likely a different sheet composition/weight is being analysed and alternative settings will be required. Press 'Scan' and save the image. Image Analysis: Open the ImageJ app. Go to 'File' and 'Open', selecting the saved image from the folder: The image will appear. Repeat the process so there are two images visible next to each other. For one of the images only (the other is only there for visual reference), go to 'Image', 'Adjust' and 'Threshold.' The Threshold box will open. Press the 'Set' button (red arrow), define the settings required and press 'OK'. The leftmost Threshold bar should cover the entire range of the peak and by way of comparison with the original image any nibs should be clearly identified. Apply' 3 times, and the nibs will be identified 3 times to represent the stages, there will only be 1 image present when conducting the test). Go to 'Analyze', 'Analyze Particles . . . ' Set the Size to '5-Infinity' (red arrow) and ensure 'Display results' and 'Clear results' are checked. Finally, press 'OK'. The reported results can be saved in the 'Nib Calculation' spreadsheet and transferred from here to any further reporting systems. The reported results are: (Sample ID) Total Count, then the size fractions 80-200 μm, 200-400 μm, 400-800 μm, >800 μm (shown by red squares).

TABLE 11

| Settings | | |
|---|---|---|
| Setting | Parameter | Hydrocarb 60 GCC/Bleached Pulp, 20% POP, 220 g/m$^2$ |
| Scanner Settings | Document Type | Film |
| | Film Type | Positive Film |
| | Imagine Type | 8-bit Grayscale |
| | Resolution/dpi | 600 |
| | Document Size (W × H)/mm | 25.0 × 100.0 |
| | Trimming | On |
| | Unsharp Mask | Ticked |
| | Grain Reduction | Unticked |
| | Color Restoration | Unticked |
| | Backlight Correction | Unticked |
| Histogram Adjustment | Channel | Check RGB |
| | Input | 10, 1.05, 60 |
| | Output | 0, 255 |
| | Tone Curve Viewer | Normal, Normal |
| ImageJ | Lower Threshold Level | 115 |
| | Upper Threshold Level | 255 |
| | Dark Background | Unticked |
| | Stack histogram | Unticked |
| | Analyze Particles/pixel$^2$ | 5-Infinity |

Conversion of Pixel Area to Size in Microns.

The 'Analyze Particles' is defined as 5-Infinity (pixels).

At 600 dpi, a single pixel is 25.4/600=0.042 mm/pixel=42 μm/pixel

The largest size object being excluded has an area of 4 pixels=2×2 pixels=2*0.042 mm=2*42 μm=84 μm.

The largest area object being excluded has an area of 4 pixels=2×2 pixels=2*0.042×2*0.042 mm=2*42×2*42 μm=7056 μm$^2$.

The largest nibs not being detected have either a diameter of 84 μm or an area of 7056 μm$^2$.

Example 16

Production of 100% MFC Sheets on Commercial Scale Equipment.

MFC sheets were manufactured from Bleached Softwood Kraft pulp, identified as Botnia Nordic Pine RMA. The mineral used was Ground Calcium Carbonate supplied by OMYA International AG called Hydrocarb 60 MR77% (H60). This material is a limestone-based, wet ground product that has a particle size of 60% less than 2 um as determined by a Micromeretics Sedigraph particle size analyser. The procedure for the Micromeretics Sedigraph is presented above in Example 9.

The pulp was wetted and pulped in the large scale Pulper located at a production facility. This pulping procedure was: 2,700 litres water added to Pulper and mixed, then, 1×250 kg bale of pulp was added to the Pulper followed by a further 2,700 litres water, The pulp slurry was mixed for 40 minutes before discharge to Pulp tank. The Target was 4% solids A 50% POP FiberLean slurry of H60 GCC and Botnia pine RMA90 pulp was used for these experiments and the production of the FiberLean MFC product was achieved by the wet attrition milling of cellulose and mineral in the presence of ceramic grinding media.

A mineral free MFC slurry was produced by using 100% Botnia pine RMA90 pulp with the wet attrition milling of cellulose in the presence of a ceramic grinding media.

In addition, alternative MFC versions of the two products mentioned above were made by passing the products through a homogenizer and evaluated using the same test methods as the standard products.

The analysis of the MFC products included the following tests:

Total solids content of the slurry was performed in accordance with Example 5.

The % POP (Percentage of Pulp): (the percentage mass of the total solids that is fibre) was performed in accordance with Example 6.

The particle size distribution as measured by the Malvern Insitec L light scattering device was performed in accordance with Example 7.

The low shear viscosity using a Brookfield vane spindle was measured according to Example 11.

The FiberLean Sheet Tensile strength was determined in accordance with Example 2.

Silverson re-dispersion procedures were performed in accordance with Example 11.

The Nib count procedure was performed in accordance with Example 16.

The four MFC slurries evaluated were: Mineral free MFC; Mineral free MFC homogenized; 50 wt. % POP Botnia/H60 GCC MFC; and 50 wt. % POP Botnia/H60 GCC MFC homogenized.

Table 12 shows the properties of the MFC sheet products used for this study.

TABLE 12

| | Total | | FLT | | Total | 80-200 | | | | | | | Fractionation | | | |
|---|---|---|---|---|---|---|---|---|---|---|---|---|---|---|---|---|
| | Solids | POP | Index | Viscosity | Count/ | Um/ | | Malvern Insitec | | | | | | +25 | +150- | +300 |
| Sample | Wt. % | Wt. % | Mn/g | mPas | # | # | | 030 | 050 | 070 | 090 | Steepness | −25 um | 150 um | 300 um | um |
| MineralFree FiberLean | 0.8 | 99.5 | 10.3 | No dilute | 3 | 3 | 0 | 50 | 105 | 192 | 390 | 26 | 18 | 43 | 22 | 16 |
| MineralFree FiberLean Plus | 0.8 | 99.9 | 15.6 | No dilute | 2 | 2 | 0 | 41 | 87 | 153 | 300 | 27 | 21 | 48 | 21 | 10 |
| 50 POP H60/Botnia FiberLean | 1.8 | 51.2 | 8.7 | 2070 | 18 | 18 | 0 | 68 | 137 | 242 | 485 | 28 | 14 | 39 | 24 | 23 |
| 50 POP H60/Botnia FiberLean Plus | 1.8 | 52.6 | 14.8 | 2420 | nm | nm | nm | nm | nm | nm | nm | nm | nm | nm | Nm 21 | nm |

These data indicate that the "homogenized" versions of the MFC slurries have enhanced FLT tensile strength values compared to the standard products as measured by The FLT Sheet Tensile strength test as described in Example 2, Sheets of 100 wt. % MFC (all four versions as described above) were made in a continuous manner by using a novel method comprising sheet forming and thermal drying.

Example 17

This experiment utilized mineral free MFC continuous sheets. Six separate continuous sheets were made using the novel method. These sheets had their total solids content measured (see Example 5) so that the sheets could be re-wetted and tested for strength. The sheets were made down into 6.25 wt. % solids slurry at 20 wt. % POP (H60 mineral used for dilution) using a laboratory Silverson mixer (see Example 11).

These slurries were then made into sheets once again following the procedure described in Example 2.

Table 13 shows the Tensile strength (FLT Index) of the control and of the re-suspended sheets as measured in by the procedure of Example 2. These data indicate that the sheets have FLT index's that are lower than that of the control slurry prior to drying thus indicating that sheets of 100 wt. % MFC were not re-suspended to the original FLT Index. These data show that a mineral free MFC can be dried into sheets, re-dispersed, and the tensile strength does not return to that of the control. None-the-less, the tensile and nib properties obtained when the dried sheets are re-suspended are commercially useful and indicate that these dried sheets are a viable product form for high solids MFC sheets.

TABLE 13

Properties of the Mineral-Free MFC Sheets

| Sample | Total Solids Wt. % | POP Wt. % | FLT Index Nm/g | Viscosity mPas | Total Count/ # | 80-200/ # | 200-400 Um/# | Malvern Insitec 030 | 050 | 070 | 090 | Steepness | Fractionation −25 um | +25-150 um | +150-300 um | +300 um |
|---|---|---|---|---|---|---|---|---|---|---|---|---|---|---|---|---|
| MineralFree FiberLean Plus slurry | 0.8 | 99.5 | 10.3 | Too dilute | 3 | 3 | 0 | 50 | 705 | 12 | 390 | | | | | |
| MineralFree FiberLean | 90.7 | 98.8 | 9.0 | 1660 | 10 | 9 | 1 | 44 | 97 | 184 | 382 | | | | | |
| MineralFree FiberLean | 90.7 | 99.1 | 9.0 | 1660 | 11 | 11 | 0 | 41 | 91 | 174 | 366 | | | | | |
| MineralFree FiberLean | 91.0 | 98.7 | 9.2 | 1700 | 2 | 2 | 0 | 45 | 99 | 189 | 399 | | | | | |
| MineralFree FiberLean | 91.5 | 98.3 | 8.9 | 1660 | 6 | 6 | 0 | 42 | 94 | 181 | 385 | | | | | |
| MineralFree FiberLean | 91.1 | 99.2 | 9.0 | 1520 | 10 | 10 | 0 | 43 | 96 | 185 | 391 | | | | | |
| MineralFree FiberLean | 92.6 | 100.0 | 8.2 | 1620 | 12 | 11 | 1 | 20 | 42 | 102 | 236 | | | | | |

Figure 16:
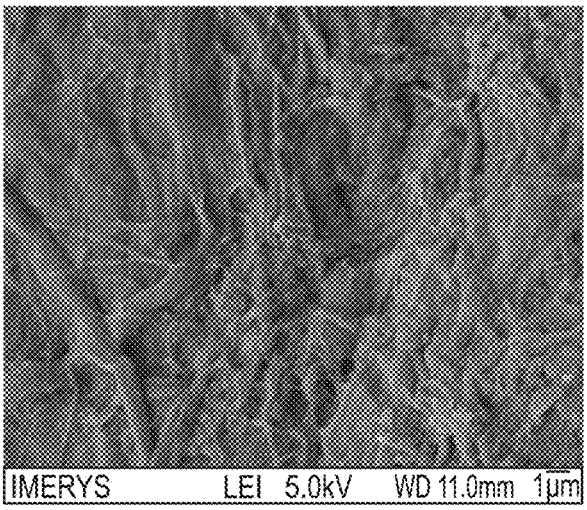
FIG. 16 shows three SEM images of the mineral free MFC sheets as made from the novel continuous method. It can be observed that there is no mineral present and there is an intricate web of tightly bound fibres.
Figure 16:
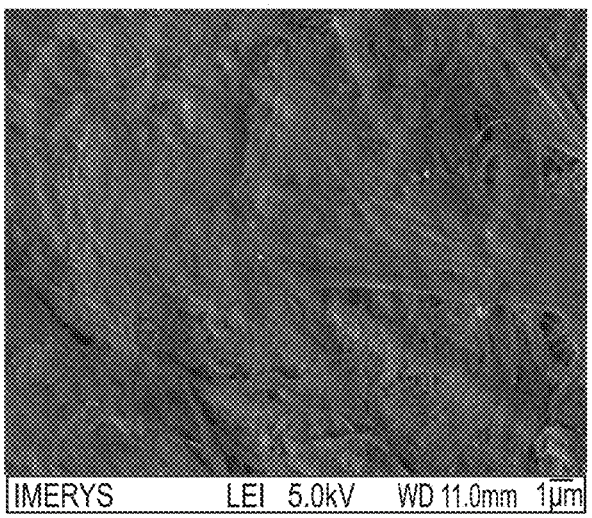
Figure 16:
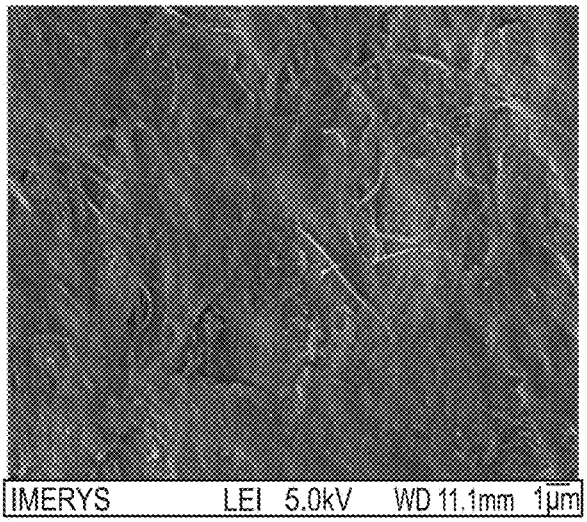

FIG. 16 shows three SEM images of the mineral free MFC sheets as made from the novel continuous method. It can be observed that there is no mineral present and there is an intricate web of tightly bound fibres.

Example 18

This experiment utilized the mineral-free MFC homogenized continuous sheets. One continuous sheet was made using the novel method. This sheet had its total solids content measured (see Example 5) so that the sheet could be re-wetted and tested for strength. The sheet was made down into 6.25 wt. % solids slurry at 20 wt. % POP (H60 mineral used for dilution) using a laboratory Silverson mixer according to Example 11.

This slurry was then made into sheets once again following the procedure as described in Example 2.

Table 14 shows the Tensile strength (FLT Index) of the control and of the re-suspended sheets as measured in accordance with the procedures of Example 2. These data indicate that the sheet has a FLT index that is lower than that of the control slurry prior to drying thus indicating that sheets of 100 wt. % MFC were not resuspended to the original FLT Index. These data show that a mineral free MFC homogenized slurry can be dried into sheets, re-dispersed, and the tensile strength does not return to that of the control. None-the-less, the tensile and nib properties obtained when the dried sheets are re-suspended are commercially useful and indicate that these dried sheets are a viable product form for high solids MFC.

TABLE 14

Properties of the Mineral-Free MFC Sheets

| Sample | Total Solids Wt. % | POP Wt. % | FLT Index Nm/g | Viscosity mPas | Total Count/ # | 80-200/ # | 200-400 Um/# | Malvern Insitec 030 | 050 | 070 | 090 | Steepness | Fractionation −25 um | +25-150 um | +150-300 um | +300 um |
|---|---|---|---|---|---|---|---|---|---|---|---|---|---|---|---|---|
| MineralFree FiberLean Plus slurry | 0.8 | 99.9 | 15.6 | Too dilute | 2 | 2 | 0 | 41 | 87 | 153 | 300 | 27 | 21 | 48 | 21 | 10 |
| MineralFree FiberLean | 92.1 | 99.7 | 10.6 | 1600 | 8 | 7 | 1 | 34 | 74 | 133 | 264 | 26 | 24 | 50 | 18 | 8 |

Example 19

This experiment utilized the 50 wt. % POP H60/Botnia MFC continuous sheets. Three separate continuous sheets were made using the novel method. These sheets had their total solids content measured (see Example 5) so that the sheets could be re-wetted and tested for strength. The sheets were made down into 6.25 wt. % solids slurry at 20 wt. % POP (H60 mineral used for dilution) using a laboratory Silverson mixer in accordance with Example 11).

These slurries were then made into sheets once again following the procedure described in Example 2.

The sample with ($H_2O$ 33%) in the table had water added to investigate whether a more dilute material gave enhanced properties.

Table 15 shows the Tensile strength (FLT Index) of the control and of the re-suspended sheets as measured in accordance with the procedures of Example 2. These data indicate that the re-suspended sheets have FLT indexes that are similar to the control slurry prior to drying thus indicating that sheets of MFC/mineral could possibly be re-suspended to the original FLT Index. The tensile and nib properties obtained when the dried sheets are re-suspended are commercially useful and indicate that these dried sheets are a viable product forms for high solids MFC sheets. It should be noted that the Silverson mixer re-suspension procedure used to re-suspend these sheets may need to be adjusted utilizing a different disperser for commercial quantities of the MFC sheets.

Figure 17:
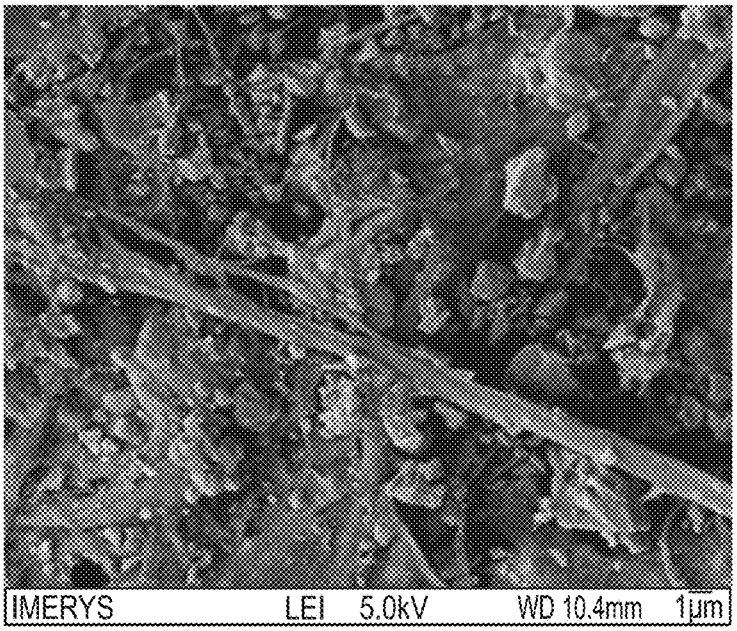
FIG. 17 shows two SEM images of the 50 wt. % POP H60/Botnia sheets made from the novel continuous method. It can be observed that there is mineral present and there is a web of fibres.
Figure 17:
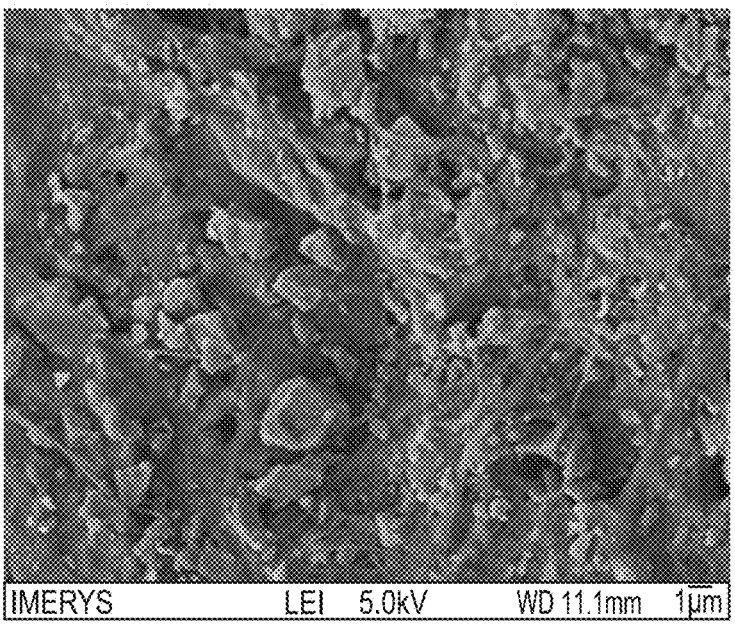

FIG. 17 shows some SEM images of the 50 wt. % POP H60/Botnia sheets made from the novel continuous method. It can be observed that there is mineral present and there is a web of fibres.

Example 20

This experiment utilized 50 wt. % POP H60/Botnia FiberLean PLUS continuous sheets. Two separate continuous sheets were made using the novel method. These sheets had their total solids content measured (see Example 5) so that the sheets could be re-wetted and tested for strength. The sheets were made down into 6.25 wt. % solids slurry at 20 wt. % POP (H60 mineral used for dilution) using a laboratory Silverson mixer in accordance with the procedures of Example 11.

These slurries were then made into sheets once again following the procedure described in Example 2.

Table 16 shows the Tensile strength (FLT Index) of the control and of the re-suspended sheets as measured in accordance with the procedures of Example 2. These data indicate that the sheets have FLT index's that are lower than that of the control slurry prior to drying thus indicating that sheets of 50 wt. % POP H60/Botnia MFC cannot be re-suspended to the original FLT Index. None-the-less, the tensile and nib properties obtained when the dried sheets are re-suspended are commercially useful and indicate that these dried sheets are a viable product form for high solids FiberLean

TABLE 15

Properties of 50% POP H60/Botnia MFC Sheets

| Sample | Total Solids Wt. % | POP Wt. % | FLT Index Nm/g | Viscosity mPas | Total Count/ # | 80-200/ # | 200-400 Um/# | Malvern Insitec 030 | 050 | 070 | 090 | Steepness | Fractionation −25 um | +25-150 um | +150-300 um | +300 um |
|---|---|---|---|---|---|---|---|---|---|---|---|---|---|---|---|---|
| 50 POP H60/Botnia FiberLean slurry | 1.8 | 51.2 | 8.7 | 2070 | 18 | 18 | 0 | 68 | 137 | 242 | 485 | 28 | 14 | 39 | 24 | 23 |
| 50 POP H60/Botnia FiberLean Plus | 95.5 | 52.8 | 7.2 | 1440 | 7 | 4 | 1 | 47 | 98 | 175 | 353 | 27 | 19 | 46 | 22 | 14 |
| 50 POP H60/Botnia FiberLean | 94.3 | 51.0 | 8.8 | 1600 | 3 | 3 | 0 | 63 | 134 | 257 | 543 | 25 | 15 | 38 | 21 | 25 |
| 50 POP H60/Botnia (H20 33%) | 95.1 | 52.4 | 7.9 | 1420 | 4 | 4 | 0 | 58 | 124 | 235 | 501 | 25 | 16 | 39 | 21 | 25 |

TABLE 16

Properties of the 50 wt.% POP H60/Botnia MFC Sheets

| Sample | Total Solids Wt. % | POP Wt. % | FLT Index Nm/g | Viscosity mPas | Total Count/ # | 80-200/ # | 200-400 Um/# | Malvern Insitec 030 | 050 | 070 | 090 | Steepness | Fractionation −25 um | +25-150 um | +150-300 um | +300 um |
|---|---|---|---|---|---|---|---|---|---|---|---|---|---|---|---|---|
| 50 POP H60/Botnia FiberLean slurry | 1.8 | 52.6 | 14.8 | 2420 | nm | nm | nm | nm | nm | nm | nm | nm | nm | nm | nm | |
| 50 POP H60/Botnia FiberLean Plus | 95.9 | 54.8 | 9.6 | 1160 | 7 | 4 | 3 | 19 | 42 | 84 | 191 | 23 | 37 | 48 | 12 | 3 |

Based on the foregoing studies with 100% MFS sheets, the production of 100% MFC sheets with or without mineral present is possible.

Sheets made with 50 wt. % POP GCC/NBSK can possibly be re-dispersed back to the original slurry's strength properties.

In both cases, the tensile and nib properties obtained when the dried sheets are re-suspended are commercially useful and indicate that these dried sheets are a viable product form for high solids FiberLean

Example 21

Production of MFC and Virgin Pulp Blended Sheets

The pulp used to produce MFC and Pulp blended sheets was Bleached Softwood Kraft Pulp identified as Botnia Nordic Pine RMA. This pulp was wetted and pulped in a large scale pulper at a production facility. This pulping procedure was: 2,700 litres water was added to the Pulper and mixing was started. Then, 1×250 kg bale of pulp was added followed by a further 2,700 litres of water. The slurry was mixed for 40 mins before discharge to a Pulp tank. The Target was 4% solids The mineral used was a Ground Calcium Carbonate supplied by OMYA International AG called Hydrocarb 60 MR77% (H60). This material is a limestone-based, wet ground product that has a particle size of 60% less than 2 μm as determined by a Micromeretics Sedigraph particle size analyser in accordance with the procedures of Example 9.

A FiberLean slurry of H60 GCC and Botnia pine RMA90 pulp was used for the following experiments and the production of the MFC-pulp blended sheet product was achieved by the wet attrition milling of cellulose and mineral in the presence of ceramic grinding media.

The mineral free MFC slurry was produced by using 100% Botnia pine RMA90 pulp with the wet attrition milling of cellulose in the presence of a ceramic grinding media.

The analysis of the MFC and pulp blended sheet product included the following measurements in each of the following Examples.

Total solids content of the slurry in accordance with the procedures of Example 5.

The % POP (Percentage of Pulp): (the percentage mass of the total solids that is fibre), in accordance with the procedures of Example 6.

The particle size distribution as measured by the Malvern Insitec L light scattering device, in accordance with the procedures of Example 7.

The low shear viscosity using a Brookfield vane spindle was measured in accordance with the procedures of Example 11.

The FLT Sheet Tensile strength as described in Example 2.

Silverson re-dispersion of the dried MFC—Pulp blended sheet product in accordance with the procedures of Example 11.

Nib count in accordance with the procedures of Example 15.

Example 22

This experiment blended various amounts of the mineral free MFC with the slushed virgin Botnia pine RMA90 pulp. The ratios of mineral free MFC added to the Botnia pulp were 5 wt. %, 10 wt. %, 25 wt. %, 50 wt. % and 75 wt. %. Once these additions were made the combined materials were shaken for 60 seconds to ensure good mixing. Sheets of MFC (of approximate weight 4.4 g) were produced by following the procedure described in the MFC FLT sheet tensile procedure (Example 2), except that there was no dilution with mineral to 20 wt. % POP. The resultant sheets were dried on the Rapid Kothen drier as described in Example 2.

Table 17 shows the effect of adding the mineral free MFC to the Botnia pulp. The total solids content (as described in Example 5) decreases as more mineral free MFC is added. The FLT Index as described in Example 2 produced high tensile strength. These data are the controls but none-the-less the data are illustrative of the properties that can be obtained from blended MFC/pulp sheets.

The "off scale" comment is due to the fact the strength exceeded the range of the load cell

TABLE 17

Pulp and Mineral-Free MFC at 100 wt. % POP

| Pulp Wt. % | Mineral free FiberLean Wt. % | FTL Index Nm/g | Total Solids Wt. % | POP Wt. % |
|---|---|---|---|---|
| 100 | 0 | 14.2 | 92.2 | 100 |
| 95 | 5 | 17.9 | 92.4 | 100 |
| 90 | 10 | 25.7 | 93.6 | 100 |
| 75 | 25 | 39.7 | 93.5 | 100 |
| 50 | 50 | off scale | 90.2 | 100 |
| 25 | 75 | off scale | 91.9 | 100 |
| 0 | 100 | off scale | 91.1 | 100 |

Example 23

This experiment blended various amounts of the 50 wt. % H60/Botnia MFC with the slushed virgin Botnia pine RMA90 pulp. The ratios of 50 wt. % H60/Botnia MFC added to the Botnia pulp were 5 wt. %, 10 wt. %, 25 wt. %, 50 wt. % and 75 wt. %. Once these additions were made the combined materials were shaken for 60 seconds to ensure good mixing.

Sheets of MFC (of approximate weight 4.4 g) were produced by following the procedure described in the FLT sheet tensile procedure (Example 2), except that there was no dilution with mineral to 20 wt. % POP. The resultant sheets were dried on the Rapid Kothen drier as described in Example 2.

Table 18 shows the effect of adding the 50 wt. % H60/Botnia FiberLean to the Botnia pulp. The total solids content (as described in Example 5) increases as more 50 wt. % H60/Botnia MFC is added. The FLT Index, as described in Example 2, produced high tensile strength values. These data are the controls but none-the-less the data are illustrative of the properties that can be obtained from blended MFC/pulp sheets

TABLE 18

| Pulp + 50 wt. % POP H60/Botnia MFC | | | | |
|---|---|---|---|---|
| Pulp Wt. % | 50 POP FiberLean Wt. % | FLT Index Nm/g | Total Solids Wt. % | POP Wt. % |
| 100 | 0 | 14.2 | 92.2 | 100 |
| 95 | 5 | 15.9 | 93.7 | 97.6 |
| 90 | 10 | 18.9 | 93.7 | 95.3 |
| 75 | 25 | 28.3 | 92.7 | 88.6 |
| 50 | 50 | 27.1 | 95.0 | 75.9 |
| 25 | 75 | 31.0 | 92.1 | 64.4 |
| 0 | 100 | 36.4 | 95.2 | 49.8 |

Example 24

This experiment blended various amounts of the mineral free FiberLean with the Trebal slushed virgin Botnia pine RMA90 pulp. The ratios of mineral free FiberLean added to the Botnia pulp were 5 wt. %, 10 wt. %, 25 wt. %, 50 wt. % and 75 wt. %. Once these additions were made the combined materials were shaken for 60 seconds to ensure good mixing Sheets of MFC-pulp blends (of approximate weight 4.4 g) were produced by following the procedure described in the FiberLean sheet tensile procedure (Example 2). The sheets were made down into 6.25 wt. % solids slurry at 20 wt. % POP (H60 mineral used for dilution) using a laboratory Silverson mixer, as described in Example 11.

Table 19 shows the Tensile strength (FLT Index) and nib count of the re-suspended sheets as measured in accordance with the test procedures of Examples 2 and 16. These data indicate that the re-suspended sheets have FLT index's that increase as more mineral free MFC is added to the Botnia virgin pulp. The FLT index's and nib counts achieved indicate that these blended FiberLean/Pulp sheets are a commercially viable product form for high solids MFC-Pulp blended sheets.

TABLE 19

| Pulp + mineral free MFC at 20 wt. % POP | | | | | | |
|---|---|---|---|---|---|---|
| Slurry with NO Silverson | | | | | | |
| Pulp wt. % | 50 POP FL wt. % | FLT Index Nm/g | Total Nib count | Nibs 80-200 um | Nibs 200-400 um | Nibs 400-800 um |
| 100 | 0 | 0.6 | 7 | 5 | 1 | 1 |
| 95 | 5 | 1.2 | 1 | 1 | 0 | 0 |
| 90 | 10 | 1.1 | 4 | 4 | 0 | 0 |
| 75 | 25 | 2.2 | 0 | 0 | 0 | 0 |
| 50 | 50 | 4.2 | 4 | 1 | 3 | 0 |
| 25 | 75 | 7.3 | 13 | 10 | 2 | 1 |
| 0 | 100 | 11.6 | 16 | 10 | 4 | 2 |

Example 25

This experiment blended various amounts of the mineral free MFC with the slushed virgin Botnia pine RMA90 pulp. The ratios of mineral free MFC is added to the Botnia pulp were 5 wt. %, 10 wt. %, 25 wt. %, 50 wt. % and 75 wt. %. Once these additions were made the combined materials were mixed for 60 seconds using a laboratory Silverson mixer (in accordance with the procedures for Example 11) to ensure good mixing. The difference between examples 25 and 26 is only that the initial blends were mixed with a high shear Silverson mixer.

Sheets of MFC (of approximate weight 4.4 g) were produced by following the procedure described in the FLT sheet tensile procedure (Example 2). The sheets were made down into 6.25 wt. % solids slurry at 20 wt. % POP (H60 mineral used for dilution) using a laboratory Silverson mixer in accordance with the procedure of Example 11.

Table 20 shows the Tensile strength (FLT Index) and nib count of the re-suspended sheets as measured by the procedures of Examples 2 and 16. These data indicate that the sheets have FLT index's that increase as more mineral free MFC is added to the Botnia virgin pulp. The FLT index's and nib counts achieved indicate that these blended MFC/Pulp sheets are a commercially viable product form for high solids MFC.

TABLE 20

| Pulp + mineral free FiberLean at 20 wt. % POP with 1 minute of Silverson mixing | | | | | | |
|---|---|---|---|---|---|---|
| Slurry with 1 minute of Silverson | | | | | | |
| Pulp wt. % | 50 POP FL wt. % | FLT Index Nm/g | Total Nib count | Nibs 80-200 um | Nibs 200-400 um | Nibs 400-800 um |
| 100 | 0 | 0.8 | 3 | 1 | 2 | 0 |
| 95 | 5 | 1.7 | 0 | 0 | 0 | 0 |
| 90 | 10 | 1.5 | 3 | 2 | 1 | 0 |
| 75 | 25 | 2.7 | 0 | 0 | 0 | 0 |
| 50 | 50 | 5.8 | 17 | 14 | 3 | 0 |
| 25 | 75 | 7.2 | 8 | 6 | 2 | 0 |
| 0 | 100 | 11.6 | 7 | 4 | 2 | 1 |

Figure 18:
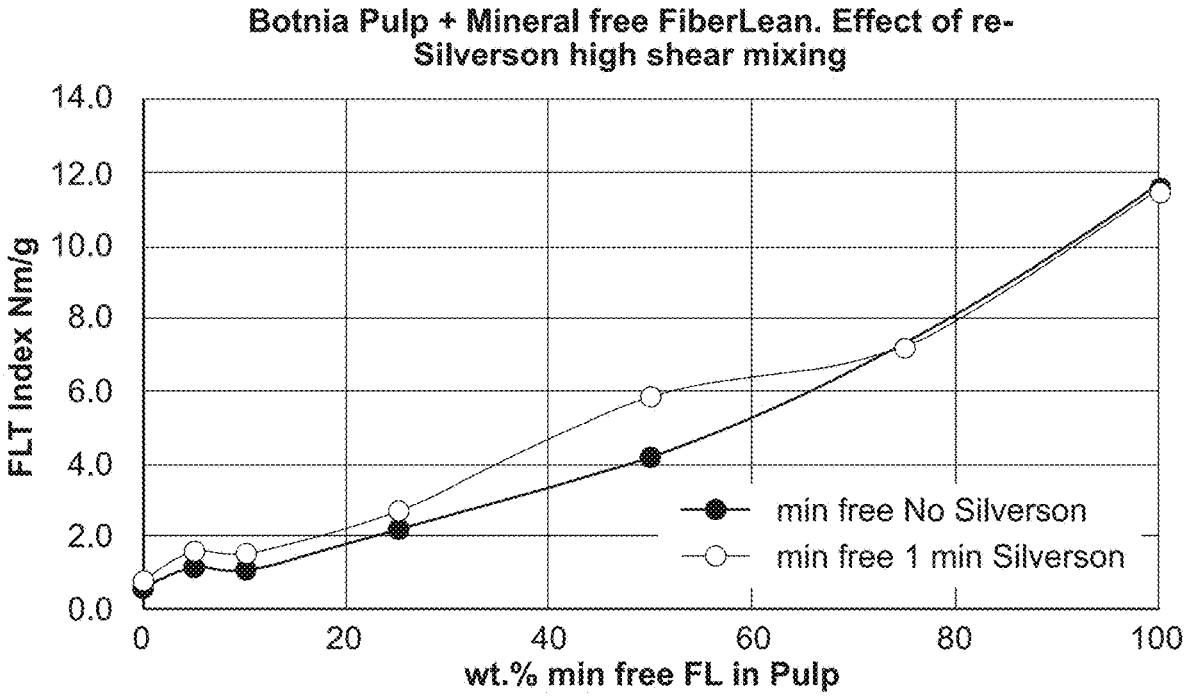
FIG. 18 is a plot of the FLT tensile index of Pulp plus mineral free MFC at 20 wt. % POP and illustrates the effect of subjecting the mineral free MFC and Botnia pulp blends to 1 minute of Silverson as described in Example 11.

FIG. 18 illustrates the effect of subjecting the mineral free MFC and Botnia pulp blends to 1 minute of Silverson as described in Example 11. These data show very little effect on the FLT values when comparing the use of a Silverson mixer.

Figure 19:
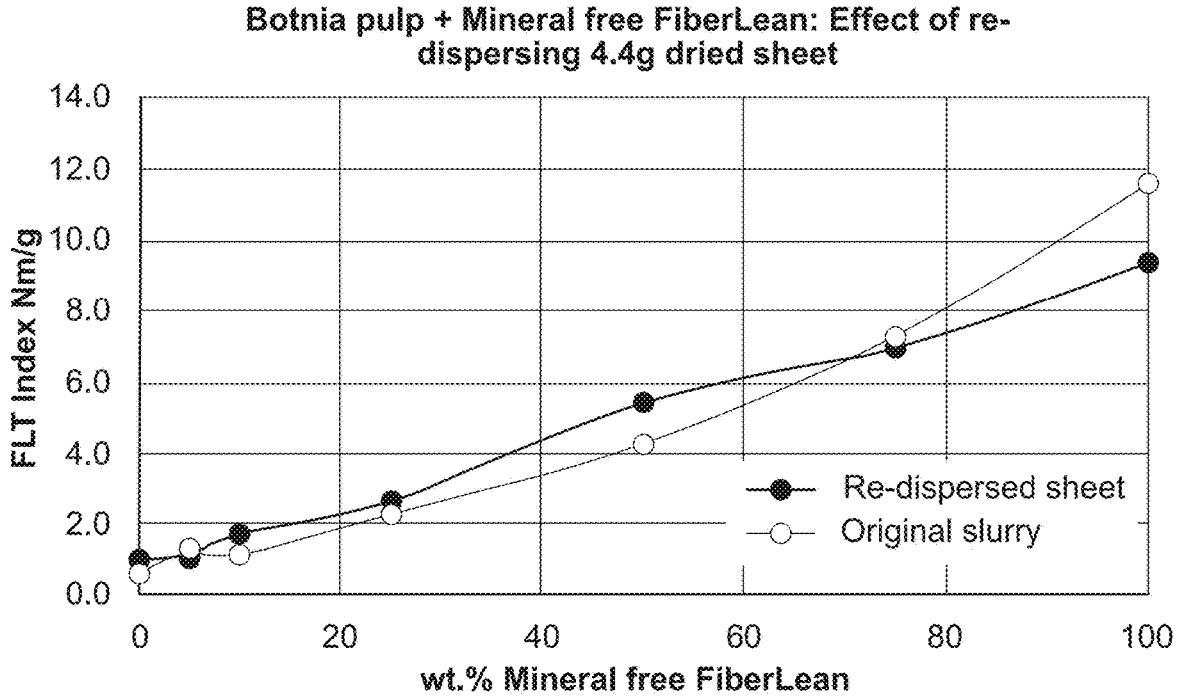
FIG. 19 is a plot of the FLT tensile index of Pulp plus mineral free MFC re-dispersed 4.4 g sheet.

FIG. 19 shows the Tensile strength (FLT Index) of the control and of the re-suspended dry sheets as measured in accordance with Example 2. These data indicate that the sheets have FLT index's that are no lower than that of the control slurry prior to drying thus indicating that sheets of MFC/pulp can be re-suspended to the original FLT Index. These data show that mineral free MFC/Botnia pulp blends can be dried into sheets, easily re-dispersed, and the tensile strength does not suffer.

Example 26

This experiment blended various amounts of the mineral free MFC with the slushed virgin Botnia pine RMA90 pulp. The ratios of mineral free MFC added to the Botnia pulp were 5 wt. %, 10 wt. %, 25 wt. %, 50 wt. % and 75 wt. %. Once these additions were made the combined materials were shaken for 60 seconds to ensure good mixing.

Sheets of FiberLean (of approximate weight 8.8 g) were produced in accordance with Example 2. The sheets were made down into 6.25 wt. % solids slurry at 20 wt. % POP (H60 mineral used for dilution) using a laboratory Silverson mixer in accordance with the procedures of Example 11. These slurries were then made into sheets once again following the procedure described in Example 2.

Figure 20:
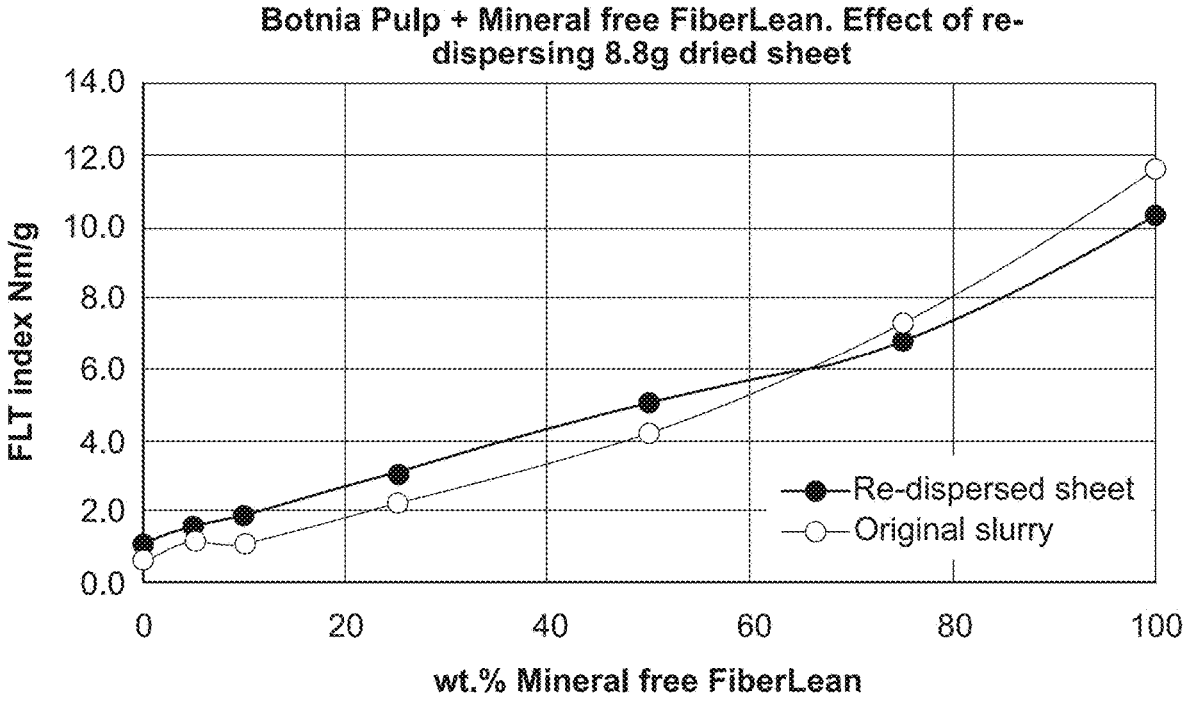
FIG. 20 is a plot of the FLT tensile index of Pulp plus mineral free MFC re-dispersed 8.8 g sheet.

FIG. 20 shows the Tensile strength (FLT Index) of the control and of the re-suspended dry sheets as measured in accordance with Example 2. These data indicate that the sheets have FLT index's that are no lower than that of the control slurry prior to drying thus indicating that sheets of MFC/pulp can be re-suspended to the original FLT Index. These data show that mineral free MFC/Botnia pulp blends can be dried into sheets, easily re-dispersed, and the tensile strength does not suffer.

These results show that the drying of a mineral free MFC/Pulp blend has no effect on the resultant tensile strength of the re-made sheet. (Example 2). There is a slight reduction on the 100% mineral free MFC sheet. The FLT indexes achieved indicate that these blended MFC/Pulp sheets are a commercially viable product form for high solids MFC.

Example 27

This experiment blended various amounts of the 50 wt. % POP H60/Botnia MFC with the slushed virgin Botnia pine RMA90 pulp. The ratios of mineral free FiberLean added to the Botnia pulp were 5 wt. %, 10 wt. %, 25 wt. %, 50 wt. % and 75 wt. %. Once these additions were made the combined materials were shaken for 60 seconds to ensure good mixing.

Sheets of MFC (of approximate weight 4.4 g) were produced by following the procedure described in the MFC sheet tensile procedure set forth in Example 2. The sheets were made down into 6.25 wt. % solids slurry at 20 wt. % POP (H60 mineral used for dilution) using a laboratory Silverson mixer as set forth in Example 11.

Table 21 shows the Tensile strength (FLT Index) and nib count of the re-suspended sheets as measured in the procedures of Examples 2 and 16. These data indicate that the sheets have FLT index's that increase as more 50 wt. % POP H60/Botnia MFC is added to the Botnia virgin pulp. The FLT indexes achieved indicate that these blended MFC/Pulp sheets are a commercially viable product form for high solids MFC.

TABLE 21

| Pulp 50 wt. % POP H60/Botnia FiberLean at 20 wt. % POP | | | | | | |
|---|---|---|---|---|---|---|
| Slurry with NO Silverson | | | | | | |
| Pulp wt. % | 50 POP FL wt. % | FLT Index Nm/g | Total Nib count | Nibs 80-200 um | Nibs 200-400 um | Nibs 400-800 um |
| 100 | 0 | 0.6 | 7 | 5 | 1 | 1 |
| 95 | 5 | 0.9 | 0 | 0 | 0 | 0 |
| 90 | 10 | 1.2 | 3 | 2 | 1 | 0 |
| 75 | 25 | 1.8 | 0 | 0 | 0 | 0 |

TABLE 21-continued

| Pulp 50 wt. % POP H60/Botnia FiberLean at 20 wt. % POP | | | | | | |
|---|---|---|---|---|---|---|
| Slurry with NO Silverson | | | | | | |
| Pulp wt. % | 50 POP FL wt. % | FLT Index Nm/g | Total Nib count | Nibs 80-200 um | Nibs 200-400 um | Nibs 400-800 um |
| 50 | 50 | 3.4 | 1 | 1 | 0 | 0 |
| 25 | 75 | 5.2 | 15 | 10 | 4 | 1 |
| 0 | 100 | 10.0 | 17 | 11 | 4 | 2 |

Example 28

This experiment blended various amounts of the 50 wt. % POP H60/Botnia MFC with the slushed virgin Botnia pine RMA90 pulp. The ratios of 50 wt. % POP H60/Botnia MFC added to the Botnia pulp were 5 wt. %, 10 wt. %, 25 wt. %, 50 wt. % and 75 wt. %. Once these additions were made the combined materials were mixed for 60 seconds using a laboratory Silverson mixer in accordance with the procedure of Example 11 to ensure good mixing. The difference between Examples 28 and 29 is only that the initial blends were mixed with a high shear Silverson mixer.

Sheets of FiberLean (of approximate weight 4.4 g) were produced by following the procedure described in the FLT sheet tensile procedure (Example 2). The sheets were made down into 6.25 wt. % solids slurry at 20 wt. % POP (H60 mineral used for dilution) using a laboratory Silverson mixer in accordance with the procedure of Example 11.

Table 4 shows the Tensile strength (FLT Index) and nib count of the re-suspended sheets as measured according to Example 2 and Example 16. These data indicate that the sheets have FLT index's that increase as more mineral free MFC is added to the Botnia virgin pulp.

TABLE 22

| Pulp 50 wt. % POP FiberLean at 20 wt. % POP with 1 minute of Silverson mixing | | | | | | |
|---|---|---|---|---|---|---|
| Slurry with 1 minute of Silverson | | | | | | |
| Pulp wt. % | 50 POP FL wt. % | FLT Index Nm/g | Total Nib count | Nibs 80-200 um | Nibs 200-400 um | Nibs 400-800 um |
| 100 | 0 | 0.8 | 3 | 1 | 2 | 0 |
| 95 | 5 | 1.3 | 0 | 0 | 0 | 0 |
| 90 | 10 | 2.3 | 8 | 7 | 1 | 0 |
| 75 | 25 | 2.2 | 3 | 2 | 1 | 0 |
| 50 | 50 | 3.7 | 1 | 1 | 0 | 0 |
| 25 | 75 | 6.5 | 2 | 0 | 1 | 1 |
| 0 | 100 | 10.6 | 15 | 8 | 6 | 1 |

Figure 21:
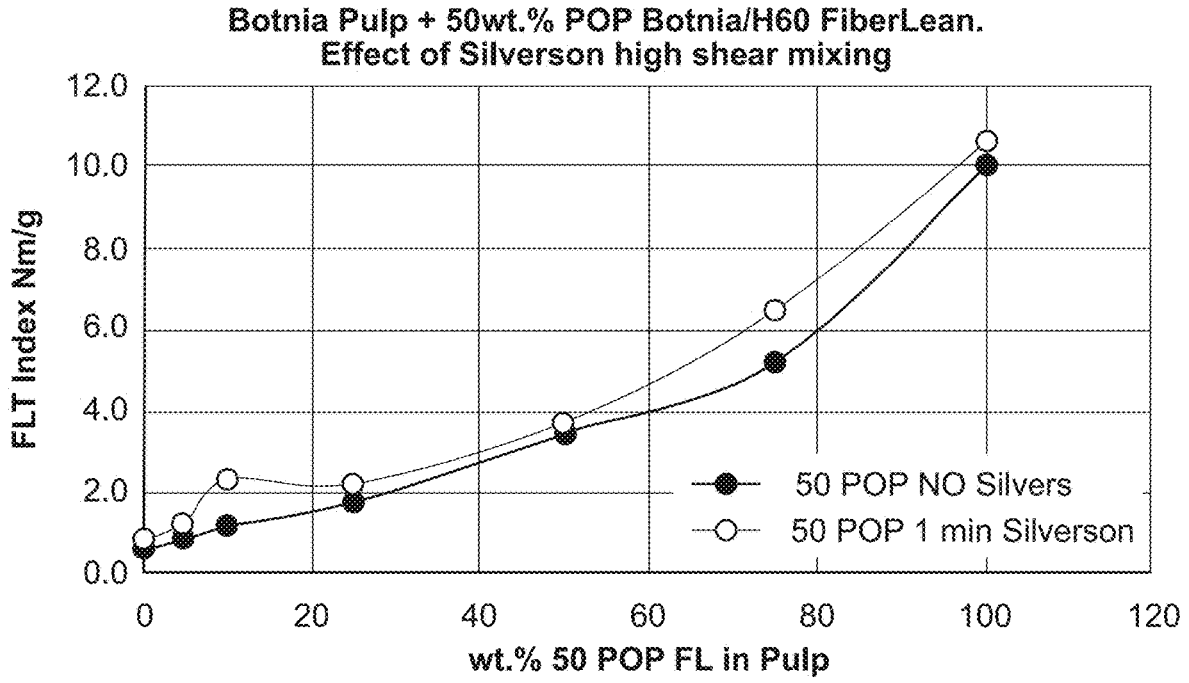
FIG. 21 is a plot of the effect of Silverson mixing of a Pulp+50 wt. % POP MFC sheet.

FIG. 21 illustrates the effect of subjecting the 50 wt. % POP H60/Botnia mfc and Botnia pulp blends to 1 minute of Silverson as described in Example 11.

These data show a slight advantage on FLT with the use of the Silverson mixer. The FLT indexes achieved indicate that these blended MFC/Pulp sheets are a commercially viable product form for high solids MFC.

Figure 22:
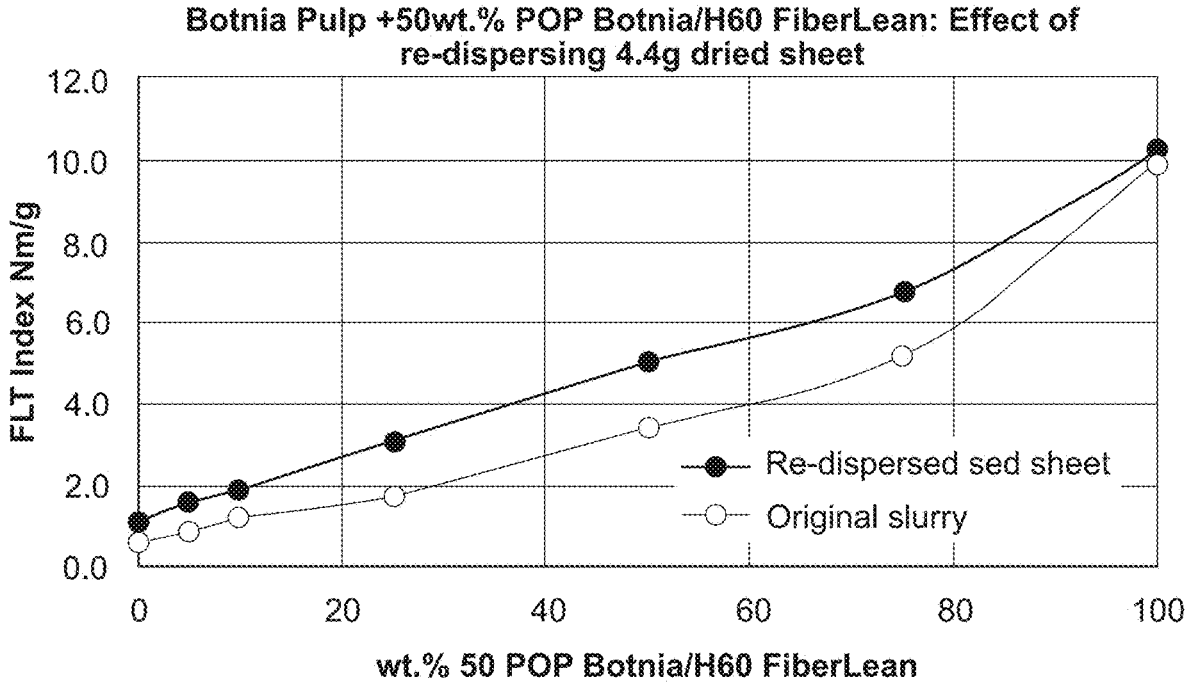
FIG. 22 is a plot of the FLT tensile index of Botnia pulp+50 wt. % POP Botnia/H60 FiberLean re-dispersed 4.4 g sheet.

FIG. 22 shows the Tensile strength (FLT Index) of the control and of the re-suspended dry sheets as measured according to Example 2. These data indicate that the sheets have FLT index's that are no lower than that of the control slurry prior to drying thus indicating that sheets of MFC/pulp can be re-suspended to the original FLT Index. These data show that 50 wt. % POP H60/Botnia MFC/Botnia pulp blends can be dried into sheets, easily re-dispersed, and the tensile strength does not suffer.

Example 29

This experiment blended various amounts of the 50 wt. % POP H60/Botnia MFC with the slushed virgin Botnia pine RMA90 pulp. The ratios of 50 wt. % POP H60/Botnia MFC added to the Botnia pulp were 5 wt. %, 10 wt. %, 25 wt. %, 50 wt. % and 75 wt. %. Once these additions were made the combined materials were shaken for 60 seconds to ensure good mixing.

Sheets of FiberLean (of approximate weight 8.8 g were produced by following the procedure described in Example 2. The sheets were made down into 6.25 wt. % solids slurry at 20 wt. % POP (H60 mineral used for dilution) using a laboratory Silverson mixer in accordance with the procedure of Example 11.

FIG. 6 shows the Tensile strength (FLT Index) of the control and of the re-suspended dry sheets as measured in the SOP, Appendix 8. These data indicate that the sheets have FLT index's that are no lower than that of the control slurry prior to drying thus indicating that sheets of MFC/pulp can be resuspended to the original FLT Index. These data show that 50 wt. % POP H60/Botnia FiberLean/Botnia pulp blends can be dried into sheets, easily re-dispersed, and the tensile strength does not suffer.

Figure 23:
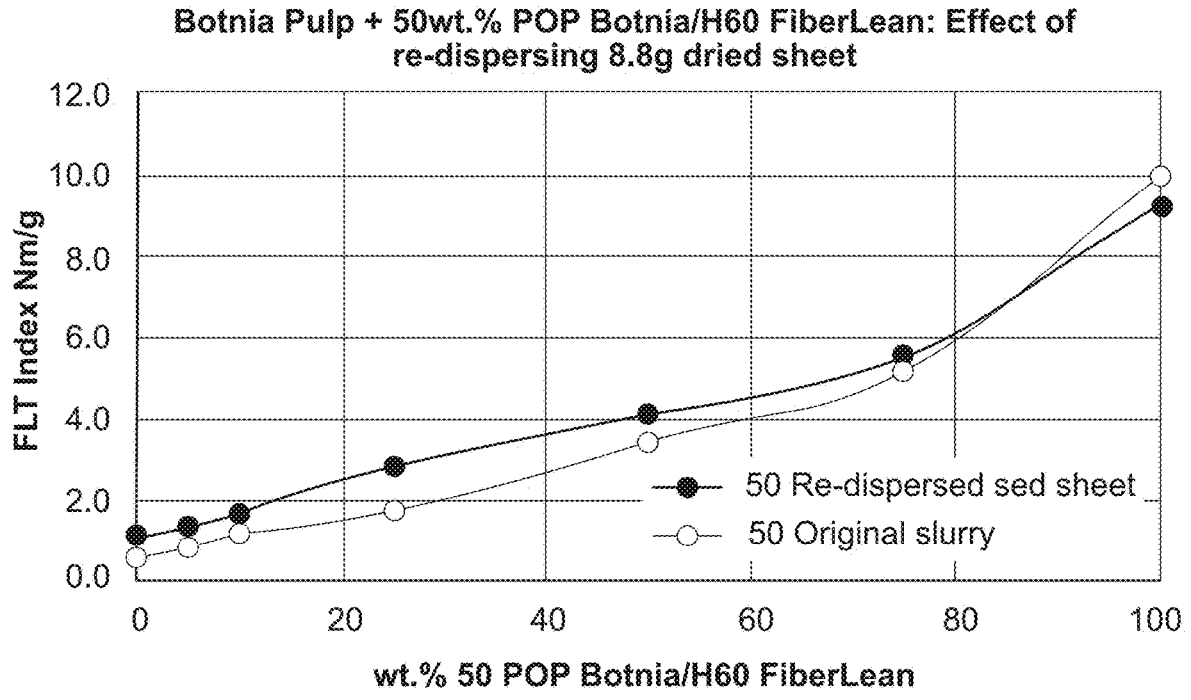
FIG. 23 is a plot of the FLT tensile index of Botnia pulp+50 wt. % POP Botnia/H60 FiberLean re-dispersed 8.8 g sheet.

FIG. 23 shows the Tensile strength (FLT Index) of the control and of the re-suspended dry sheets as measured in accordance with Example 2. These data indicate that the sheets have FLT index's that are no lower than that of the control slurry prior to drying thus indicating that sheets of MFC/pulp can be re-suspended to the original FLT Index. These data show that 50 wt. % POP H60/Botnia MFC/Botnia pulp blends can be dried into sheets, easily re-dispersed, and the tensile strength does not suffer These results show that the drying of a 50 wt. % POP FiberLean/Pulp blend has no effect on the resultant tensile strength of the re-made sheet. The FLT indexes achieved indicate that these blended MFC/Pulp sheets are a commercially viable product form for high solids MFC The addition of mineral free MFC or 50 wt. % POP Botnia/H60 MFC to a Botnia pulp increases the resultant Tensile strength of a sheet.

The re-dispersion of a dried sheet containing mineral free MFC or 50 wt. % POP Botnia/H60 MFC and Botnia pulp has the tensile properties of the original sheet.

These data indicate that blended MFC/Pulp sheets are a commercially viable product form for high solids MFC.

Those skilled in the art will recognize, or be able to ascertain using no more than routine experimentation, many equivalents to the specific embodiments of the invention described herein. The scope of the present invention is not intended to be limited to the above Description, but rather is as set forth in the following claims.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context. The invention includes embodiments in which exactly one member of the group is present in, employed in, or otherwise relevant to a given product or process. The invention also includes embodiments in which more than one, or the entire group members are present in, employed in, or otherwise relevant to a given product or process. Furthermore, it is to be understood that the invention encompasses all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise. Where elements are presented as lists, (e.g., in Markush group or similar format) it is to be understood that each subgroup of the elements is also disclosed, and any element(s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification. The publications, websites and other reference materials referenced herein to describe the background of the invention and to provide additional detail regarding its practice are hereby incorporated by reference.

What is claimed is:

1. A method of manufacturing a partially-dried market pulp sheet or a dried market pulp sheet comprising microfibrillated cellulose for use as a binder, the method comprising the steps of:

a. preparing a pulp slurry in a range of about 0.5 wt. % to about 30 wt. % total solids;

b. preparing a slurry comprising microfibrillated cellulose;

wherein the microfibrillated cellulose has a fibre steepness of from about 20 to about 50;

c. mixing the pulp slurry and the slurry comprising microfibrillated cellulose, wherein the content of microfibrillated cellulose in the pulp slurry is about 0.5 wt. % to about 99.5 wt. % of the total dry mass of the pulp slurry and slurry comprising microfibrillated cellulose;

d. forming a market pulp sheet comprising microfibrillated cellulose and pulp from the pulp slurry and slurry comprising microfibrillated cellulose;

e. dewatering and drying the market pulp sheet to a desired moisture content;

wherein the moisture content of the dewatered and dried market pulp sheet in step e is in the range of about 20% by weight to about 85% by weight moisture; or wherein the moisture content of the dewatered and dried market pulp sheet in step e is about 20% by weight or less; and f. repulping dewatered and dried market pulp sheet of step e by redispersing the dewatered and dried market pulp sheet in an aqueous medium with a disperser, mixer, or refiner operated at energy inputs of about 10 kWh/t to about 2,000 kWh/t, wherein the tensile strength (FLT Index) repulped market pulp compared to market pulp formed from a comparable amount of microfibrillated cellulose prior to dewatering and drying in step e is not reduced by more than 15%.

2. The method according to claim 1, wherein the partially-dried market pulp sheet or the dried market pulp sheet further comprises one or more inorganic particulate material.

3. The method according to claim 2, wherein the microfibrillated cellulose is obtained by a co-grinding microfibrillation process wherein a fibrous substrate comprising cellulose is microfibrillated in an aqueous environment in a grinding apparatus in the presence of one or more inorganic particulate material, wherein the fibrous substrate to the inorganic particulate material are in a ratio of about 99.5:0.5 to about 0.5:99.5 and, optionally, wherein the microfibrillating is performed in the presence of a grinding medium which is to be removed after completion of grinding.

4. The method according to claim 3, wherein the fibrous substrate comprising cellulose has a Canadian Standard Freeness equal to or less than 450 $cm^3$.

5. The method according to claim 3, further comprising a grinding medium.

6. The method according to claim 5, wherein the grinding medium is present in an amount of at least about 10% by volume of the aqueous medium.

7. The method according to claim 5, wherein the grinding medium is present in an amount up to about 70% by volume of the aqueous medium.

8. The method according to claim 5, wherein the grinding medium comprises particles having an average diameter ranging from about 0.5 mm to about 6 mm.

9. The method according to claim 5, wherein the grinding medium comprises particles having a specific gravity of at least about 2.5.

10. The method according to claim 5, wherein the grinding medium is selected from the group consisting of alumina, zirconia, zirconium silicate, aluminum silicate or the mullite-rich material which is produced by calcining kaolinitic clay at a temperature in the range of from about 1300° C. to about 1800° C.

11. The method according to claim 10, wherein the grinding medium is the mullite-rich material which is produced by calcining kaolinitic clay at a temperature in the range of from about 1300° C. to about 1800° C.

12. The method according to claim 3, wherein the fibrous substrate comprising cellulose is present in the aqueous medium at an initial solids content of at least about 5 wt. %.

13. The method according to claim 3, wherein the grinding is performed in a tower mill or a screened grinder.

14. The method according to claim 13, wherein the screened grinder is a stirred media detritor.

15. The method according to claim 13, wherein the screened grinder comprises one or more screens having a nominal aperture size of at least about 250 um.

16. The method according to claim 3, wherein the grinding is performed in a cascade of grinding vessels.

17. The method according to claim 2, wherein microfibrillated cellulose is present in an amount of about 0.5 wt. % to about 50 wt. % of the total dry mass of the dewatered and dried market pulp sheet of step e.

18. The method according to claim 2, wherein microfibrillated cellulose is present in an amount of about 0.5 wt. % to about 10 wt. % of the total dry mass of the dewatered and dried market pulp sheet of step e.

19. The method according to claim 2, wherein the one or more inorganic particulate material comprises a platy mineral, kaolin and/or talc.

20. The method according to claim 2, wherein the one or more inorganic particulate material is calcium carbonate or kaolin, or mixtures thereof.

21. The method according to claim 20, wherein the calcium carbonate is ground calcium carbonate, precipitated calcium carbonate, or mixtures thereof.

22. The method according to claim 2, wherein the inorganic particulate material is selected from the group consisting of an alkaline earth metal carbonate or sulphate, a calcium carbonate, a magnesium carbonate, a dolomite, a gypsum, a bentonite, a hydrous kandite clay, a kaolin, a halloysite, a ball clay, an anhydrous (calcined) kandite clay, a metakaolin, a fully calcined kaolin, a talc, a mica, a perlite, a sepiolite, a huntite, a diatomite, a magnesite, a silicate, a diatomaceous earth, a brucite, an aluminum trihydrate, and combinations thereof.

23. The method according to claim 2, wherein the method further comprises use of the re-dispersed dried sheet in, or in the manufacture of, an article, product or composition.

24. The method according to claim 1, wherein microfibrillated cellulose is present in an amount of about 0.5 wt. % to about 50 wt. %. of the total dry mass of the dewatered and dried market pulp sheet of step e.

25. The method according to claim 1, wherein microfibrillated cellulose is present in an amount of about 0.5 wt. % to about 10 wt. % of the total dry mass of the dewatered and dried market pulp sheet of step e.

26. The method according to claim 1, wherein microfibrillated cellulose is present in an amount of about 0.5 wt. % to about 75% wt. % of the dewatered and dried market pulp sheet of step e.

27. The method according to claim 1, wherein microfibrillated cellulose is present in an amount of about 0.5 wt. % to about 90 wt. %. of the dewatered and dried market pulp sheet of step e.

28. The method according to claim 1, wherein microfibrillated cellulose is present in an amount of about 20 wt. % to about 40 wt. % of the dewatered and dried market pulp sheet of step e.

29. The method according to claim 1, wherein microfibrillated cellulose is present in an amount of about 10 wt. % to about 20 wt. % of the dewatered and dried market pulp sheet of step e.

30. The method according claim 1, wherein, the microfibrillated cellulose is obtained from a pulp selected from the group consisting of a chemical pulp, a chemithermomechanical pulp, a mechanical pulp, a thermomechanical pulp, a recycled pulp, a paper broke pulp, a papermill waste stream, waste from a papermill, and combinations thereof.

31. The method according to claim 1, wherein, the pulp slurry comprises a Northern Bleached Softwood Kraft pulp ("NBSK"), or a Bleached Chemi-Thermo Mechanical Pulp ("BCTMP), or combinations thereof.

32. The method according to claim 1, wherein the pulp slurry comprises a kraft pulp, or a bleached long fibre kraft pulp.

33. The method according to claim 1, wherein the pulp slurry comprises a softwood pulp selected from the group consisting of a spruce pulp, a pine, a fir pulp, a larch pulp, a hemlock pulp and mixed softwood pulps.

34. The method according to claim 1, wherein the pulp slurry comprises a hardwood pulp selected from the group consisting of a eucalyptus, aspen and birch, or mixed hardwood pulps.

35. The method according to claim 1, wherein the pulp slurry comprises a hardwood pulp selected from the group consisting of a eucalyptus pulp, an aspen pulp, a birch pulp and mixed hardwood pulps.

36. The method according to claim 1, wherein the method further comprises use of the re-dispersed partially-dried sheet in, or in the manufacture of, an article, product or composition.

* * * * *